US007634220B2

(12) United States Patent
Asakura et al.

(10) Patent No.: US 7,634,220 B2
(45) Date of Patent: Dec. 15, 2009

(54) IMAGE FORMING APPARATUS WHERE THE ROTATION AND CONTACT/RELEASE OF A FIXING FLUID APPLYING MEMBER IS CONTROLLED

(75) Inventors: Kenji Asakura, Kyoto (JP); Shinji Yamana, Yamatokoriyama (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 217 days.

(21) Appl. No.: 11/656,474

(22) Filed: Jan. 23, 2007

(65) Prior Publication Data

US 2007/0212128 A1 Sep. 13, 2007

(30) Foreign Application Priority Data

Jan. 23, 2006 (JP) ..... P2006-014407

(51) Int. Cl.
*G03G 15/20* (2006.01)

(52) U.S. Cl. ..... 399/340

(58) Field of Classification Search ..... 399/340, 399/307

See application file for complete search history.

(56) References Cited

U.S. PATENT DOCUMENTS 6,141,524 A * 10/2000 Berkes et al. ..... 399/307
6,947,700 B2 9/2005 Kurotori et al.
7,203,447 B2 * 4/2007 Koshida ..... 399/124
2002/0037185 A1 * 3/2002 Mochimaru et al. ..... 399/309
2004/0101333 A1 * 5/2004 Wu et al. ..... 399/325
2006/0024075 A1 * 2/2006 Watanabe ..... 399/45
2006/0133863 A1 * 6/2006 Asakura et al. ..... 399/307

FOREIGN PATENT DOCUMENTS

JP 2004-109747 A 4/2004
JP 2004-294847 A 10/2004
JP 2004-333866 A 11/2004
JP 5-323816 A 12/2007

* cited by examiner

*Primary Examiner*—Quana M Grainger
(74) *Attorney, Agent, or Firm*—Birch, Stewart, Kolasch and Birch, LLP

(57) ABSTRACT

An image forming apparatus includes a toner-image forming section, an intermediary transfer section including an intermediary transfer belt, a fixing-fluid applying section, a transferring and fixing section, a recording-medium supply section, and an ejection section. The fixing-fluid applying section includes a coating roller, an eccentric cam for moving the coating roller approachably and separably with respect to the intermediary transfer belt, a contact and release detecting section for detecting whether the coating roller is contacted by or away from the intermediary transfer belt, a rotational driving section for rotatably driving the coating roller, and a control unit for controlling the eccentric cam and the rotational driving section.

16 Claims, 14 Drawing Sheets

IMAGE FORMING APPARATUS WHERE THE ROTATION AND CONTACT/RELEASE OF A FIXING FLUID APPLYING MEMBER IS CONTROLLED

CROSS-REFERENCE TO RELATED APPLICATION

This application claims priority to Japanese Patent Application No. JP 2006-14407, which was filed on Jan. 23, 2006, the contents of which, are incorporated herein by reference, in their entirety.

BACKGROUND OF THE INVENTION

1. Field of the Invention

The present invention relates to an image forming apparatus.

2. Description of the Related Art

The adoption of electrophotographic image forming apparatuses as copying machines, printers, facsimile machines, and the like equipment has been widespread. In general, image formation is carried out by an electrophotographic image forming apparatus as follows. As a photoreceptor, the one having formed on its surface a photosensitive layer containing a photoconductive substance is used. After electric charge is applied to the surface of the photoreceptor in such a way that the entire surface is charged evenly, an electrostatic latent image corresponding to specific image data is formed thereon through various process steps for image formation. The electrostatic latent image is developed into a toner image by using a developing agent containing toner that has been supplied from developing means. The toner image is directly transferred onto a recording medium such as a paper sheet, or is transferred onto an intermediary transfer medium once and is thereafter transferred onto a recording medium. Lastly, the toner image transferred onto the recording medium is fixed into place. The fixation of the toner image onto the recording medium can usually be achieved by heating and pressurizing the recording medium with use of fixing means constructed based on a heat fixing method, for example, a fixing roller comprising heating means. However, there has been a growing trend in recent years to achieve energy conservation as a countermeasure against global warming. As a natural consequence thereof, a reduction in power consumption required to fix a toner image onto a recording medium has come to be increasingly demanded of an electrophotographic image forming apparatus. Unfortunately, the heat fixing method presents the following disadvantages. Firstly, heating means is used inside the apparatus, wherefore the apparatus is interiorly heated to a high temperature. This creates the need to enhance the heat resistance of constituent components, which results in an undesirable increase in material costs. Secondly, image fixation cannot be effected until a part to be fixed has been heated to a predetermined temperature. In this case, the time required for the to-be-fixed part to reach the predetermined temperature, namely, warm-up time, tends to be increased. Thirdly, much time heeds to be spent in fixing a multi-color toner image onto a recording medium as compared to the case of fixing a monochromatic toner image. Accordingly, a reduction in time required to fix a multi-color toner image has been sought after.

In view of the foregoing requirements, there has been proposed a wet fixing method that employs a fixing fluid containing water and a liquid which is dissoluble or dispersible in water and produces the effect of softening or swelling out toner. According to the wet fixing method, a toner image is brought into a softened or swollen state through the application of the fixing fluid. In this state, the toner image is adhered to a recording medium, and is then fixed into place by pressurization. The wet fixing method consumes far less power than does the heat fixing method, and is thus of a useful method from energy-saving standpoint. Another advantage is that the wet fixing method does not require a large amount of heat to fix a multi-color toner image. This, in contrast to the case of adopting the heat fixing method, enables a reduction in fixation time. Accordingly, various improvements have been made to date to make practical use of the wet fixing method. For example, an image forming apparatus composed of preliminary fixing means, fixing fluid applying means, and fixing means has been proposed (for example, refer to Japanese Unexamined Patent Publication JP-A 2004-294847). Specifically, in the preliminary fixing means, a toner image transferred onto a recording sheet is subjected to pressurization to augment the adhesion of the toner image to the recording sheet. In the fixing fluid applying means, a fixing fluid is applied only to a certain region on the recording sheet where the toner image is adhered by means of an ink jet head, a mist producing head, or otherwise. In this way, the toner can be softened or swollen. In the fixing means, the toner image, now kept in a softened or swollen state by the application of the fixing fluid, is fixed onto the recording sheet through application of heat and pressure. According to the techniques disclosed in JP-A 2004-294847, the toner image is softened or swollen by the application of the fixing fluid prior to the final fixing operation conducted by the fixing means. This makes it possible to set a heating temperature for the fixing means to fall in a range of from approximately 70° C. to 100° C. This temperature level is lower than the level of a normal thermal fixing temperature. Moreover, in a case where the percentage of print coverage on an image to be formed is low, no heating operation is carried out to reduce power consumption. In this image forming apparatus, however, the fixing fluid is directly applied only to the region on the recording sheet where the toner image is adhered. Note that this toner image bearing region is not covered with toner completely but has a part to which no toner is adhered. The fixing fluid applied to this toner-absent part finds its way into the recording sheet swiftly, which is causative of generation of wrinkles, curls, or the like in the recording sheet. Inconveniently, the generation of wrinkles, curls, or the like is particularly notable in this image forming apparatus, because the water content in the fixing fluid cannot be vaporized readily due to the relatively low fixing temperature set for the fixing means.

Moreover, an image forming apparatus composed of toner image forming means, an intermediary transfer belt, a roller-shaped applying member, and transferring and fixing means is known. The intermediary transfer belt is driven to rotate while bearing on its surface a toner image formed by the toner image forming means. The roller-shaped applying member acts to apply a fixing fluid to an unfixed toner image formed on the intermediary transfer belt in a contact manner. The transferring and fixing means acts to transfer and fix the toner image borne on the intermediary transfer belt onto a recording sheet. In this construction, the fixing fluid is applied to the toner image borne on the intermediary transfer belt in a contact manner, so that the toner constituting the toner image can be swollen and softened. In this state, the toner image is transferred and fixed onto the recording sheet. In this image forming apparatus, just as is the case with the image forming apparatus disclosed in JP-A 2004-294847, in order to achieve a reduction in power consumption, it is absolutely necessary to keep low the heating temperature for the application of the fixing fluid and for the image transference and fixation. Accordingly, this image forming apparatus failed to overcome the drawback associated with the wet fixing method, namely, the generation of wrinkles, curls, or the like in the recording sheet that occurs when the fixing fluid applied to the toner-absent part of the toner image borne on the intermediary transfer belt finds its way into the recording sheet in accompaniment with the image transference and fixation. There is also known an image forming apparatus composed of toner image forming means, an intermediary transfer belt, heating means for applying heat to the intermediary transfer belt, a roller-shaped applying member, and transferring and fixing means. In this construction, a fixing fluid is applied to a toner image borne on the intermediary transfer belt kept in a heated state in a contact manner, so that the toner constituting the toner image can be swollen and softened. In addition to that, the water content in the fixing fluid applied to a toner-absent part is vaporized. This helps prevent wrinkles, curls, or the like from occurring in a recording sheet at the time of carrying out image transference and fixation thereon. In this image forming apparatus, however, the applying member is kept in constant contact with the intermediary transfer belt in a heated state. Furthermore, a customarily-used fixing fluid is highly volatile. Therefore, the amount of the fixing fluid on the surface of the applying member becomes uneven, which leads to a failure of applying the fixing fluid to the toner image evenly. As a result, there arise lack of uniformity in the application of the fixing fluid and thus irregularity in an image obtained.

Moreover, a fixing apparatus composed of a fixing fluid chamber for storing a fixing fluid, a applying member formed in the shape of roller, and shutter means has been proposed (for example, refer to Japanese Unexamined Patent Publication JP-A 2004-333866 (see FIG. 7 in particular)). The fixing fluid chamber has an opening formed in the perpendicularly lower part thereof. The applying member is disposed in the fixing fluid chamber interiorly thereof, part of which protrudes downwardly from the opening so as to stop up the opening. The applying member is immersed in the fixing fluid, is rotatably supported, and has formed on its surface grooves for retaining the fixing fluid thereon. The shutter means allows the closing and opening of that exposed part of the applying member which protrudes downwardly from the opening. In this fixing apparatus, when the application of the fixing fluid is needed, the exposed part of the applying member is opened by actuating the shutter means, whereupon the fixing fluid can be applied to a toner image bearing recording sheet arranged below the fixing apparatus in a contact manner by the applying member. On the other hand, when the application of the fixing fluid is not needed, the exposed part of the applying member is closed by actuating the shutter means. Moreover, since an excess of the fixing fluid remaining on the surface of the applying member is removed by a contact action between the applying member and the end of the opening of the fixing fluid chamber, it follows that the fixing fluid exists only in the grooves created on the surface of the applying member. This helps prevent a larger amount of the fixing fluid than is necessary from being applied to the recording sheet. In this fixing apparatus, upon the shutter means being closed, the shutter means and the applying member are brought into contact with each other, wherefore the applying member is no longer rotated. The resumption of rotation of the applying member is effected immediately before the fixing fluid is applied to the recording sheet conveyed to a certain position therebelow, with the shutter means opened to the ready state. In this case, the fixing fluid cannot be spread evenly across the groove on the surface of the applying member, in consequence whereof there results lack of uniformity in the application of the fixing fluid to the recoding sheet. This could lead not only to image irregularity but also to image defects resulting from improper fixation. Another problem is that the grooves created on the applying member are made uniform in dimension, and thus the amount of the fixing fluid to be applied remains invariant. Therefore, in a case where the percentage of print coverage on an image to be formed is varied, depending upon the value of the percentage, the amount of the fixing fluid to be applied is so small that fixation ends in failure, or is so large that the occurrence of image flow and generation of wrinkles, curls, or the like induced by the fixing fluid are inevitable. For example, even if the number of rotation of the applying member is so controlled as to cope with a change in print coverage rate, since the applying member and the end of the opening of the fixing fluid chamber are kept in sliding contact with each other, this construction presents a problem in the provision of long-term durability. Moreover, whenever the shutter means is opened or closed, the applying member makes contact therewith. At this time, the surface of the applying member may suffer from scratches, which gives rise to lack of uniformity in the application of the fixing fluid. Further, when the fixing fluid is adhered to the surface of the shutter member contacted by the applying member, the fixing fluid may be scattered inside the image forming apparatus in accompaniment with the opening of the shutter member. Besides, in this construction, since the shutter member is so disposed as to cover the applying member from underneath, the fixing fluid may leak from the gap between the shutter member and the fixing fluid chamber or the applying member. In this case, the image forming apparatus may be interiorly contaminated with the fixing fluid leakage. In addition, JP-A 2004-294847 makes no specific suggestion about means for opening and closing the shutter means, the configuration of the lengthwise end of the shutter means corresponding to the lengthwise ends of the fixing fluid chamber and the applying member, and so forth. This makes it difficult to implement the invention disclosed in JP-A 2004-294847.

SUMMARY OF THE INVENTION

An object of the invention is to provide an image forming apparatus characterized in that lack of uniformity in application of a fixing fluid and ensuing image irregularity can be prevented, that high-quality images can be formed with stability, that the interior thereof is free from fixing fluid contamination, and that a reduction in power consumption can be achieved by adopting wet fixing method.

The invention provides an image forming apparatus comprising:

a toner image forming section for forming a toner image;

a toner image bearing section which is rotated while bearing an unfixed toner image thereon;

a fixing fluid applying section for applying a volatile fixing fluid, which provides an effect of fixing toner onto a recording medium, to the unfixed toner image formed on the toner image bearing section; and a transferring and fixing section for transferring and fixing the unfixed toner image formed on the toner image bearing section onto the recording medium, wherein the fixing fluid applying section comprises:

a applying section including a applying member which is rotated to apply the volatile fixing fluid to the unfixed toner image formed on the toner image bearing section;

a contact and release operation section for supporting the applying section in a manner such that the applying member is moved approachably and separably with respect to the toner image bearing section;

a contact and release detecting section for detecting whether the applying member is kept in contact with or kept away from the toner image bearing section;

a rotational driving section for driving the applying member to rotate about its axis; and a control unit for controlling of the contact and release operation section in a manner so as to assure contact or separation between the applying member and the toner image bearing section, and controlling of the rotational driving section in a manner so as to assure the rotation of the applying member.

According to the invention, the image forming apparatus is composed of the toner image forming section, the toner image bearing section, the fixing fluid applying section, and the transferring and fixing section. The image forming apparatus adopts the wet fixing method for fixing a toner image onto a recording medium using the volatile fixing fluid (hereafter referred to simply as "fixing fluid" unless otherwise specified) The fixing fluid applying section comprises: the applying section including a applying member for applying the fixing fluid to the toner image borne on the toner image bearing section; the contact and release operation section for supporting the applying section in a manner such that the applying member is moved approachably and separably with respect to the toner image bearing section; the contact and release detecting section for detecting whether the applying member is kept in contact with or kept away from the toner image bearing section; the rotational driving section for rotating the applying member; and the control unit.

The image forming apparatus of the invention presents many advantages as follows.

(i) The control unit effects control of the contact and release operation section in a manner so as to assure contact or separation between the applying member and the toner image bearing section, and controlling of the rotational driving section in a manner so as to assure the rotation of the applying member. This makes it possible to bring the applying member into contact with the toner image bearing section for application of the fixing fluid on an as needed basis, and thereby minimize fixing fluid consumption.

(ii) The number of rotation of the applying member can alternately be raised and lowered by the rotational driving section in accordance with the percentage of print coverage on an image to be formed under the control of the control unit. This makes it possible to cope with a change in print coverage rate, and thereby form images of different print coverage rates continuously without a hitch.

(iii) It is possible to deal with the percentage of print coverage on an image to be formed also by operating the contact and release operation section. By adjusting the pressure under which the applying member is brought into contact with the toner image bearing section in accordance with a corresponding print coverage rate through the operation of the contact and release operation section, it is possible to make the application amount of the fixing fluid optimum.

(iv) By virtue of the advantages (ii) and (iii) for example, it is possible to optimize the application amount of the fixing fluid, and thereby achieve further reduction in fixing fluid consumption.

(v) As will be described later, by giving the applying member at least one turn through the operation of the rotational driving section under the control of the control unit before the start of the application of the fixing fluid; that is, before bringing the applying member kept away from the toner image bearing section into contact therewith, it is possible for the fixing fluid to spread evenly over the surface of the applying member. Accordingly, lack of uniformity in the application of the fixing fluid and ensuing image irregularity can be prevented from occurring for a longer period of time since the initiation of image formation, with the result that high-quality images can be formed with stability.

(vi) Before bringing the applying member into contact with the toner image bearing section, the number of rotation of the applying member can be adjusted by the rotational driving section in accordance with the percentage of print coverage on an image to be formed, for example. In this way, the amount of the fixing fluid on the surface of the applying member can be so adjusted that the application amount of the fixing fluid is kept optimum since the initiation of image formation.

(vii) The image forming apparatus of the invention employs the fixing fluid as principal means for fixing toner onto a recording sheet and thus consumes less electric power. Moreover, with use of the fixing fluid having volatility, outputted fixed images can be dried in a short time. Accordingly, it never occurs that, between printed matters produced one after the other, the fixing fluid of the printed matter produced earlier is adhered to the one produced later, which results in improvement in throughput.

In the invention, it is preferable that the applying section is disposed vertically below the toner image bearing section so as for the applying member to face a toner image bearing surface of the toner image bearing section.

According to the invention, the applying section is disposed vertically below the toner image bearing section so as for the applying member to face the toner image bearing surface of the toner image bearing section. In this case, the fixing fluid is stored in the lowermost part of the applying section under gravitational force. Therefore, even though the components constituting the applying section are not sealed completely, as contrasted with the fixing apparatus disclosed in JP-A 2004-333866, the leakage of the fixing fluid can be suppressed, wherefore the image forming apparatus can be prevented from being contaminated interiorly with the fixing fluid. Moreover, since the toner image bearing section and the fixing fluid are spaced away from each other, as will be described later, even if a heating section is provided for heating the toner image bearing section, the fixing fluid temperature is barely increased. This helps prevent quality degradation of the fixing fluid and an increase in fixing fluid consumption resulting from volatilization of the fixing fluid.

In the invention, it is preferable that the control unit controls of the rotational driving section in a manner so as to give the applying member at least one rotating before bringing the applying member into contact with the toner image bearing section.

In the invention, it is preferable that the control unit effects controlling of the rotational driving section in a manner so as to assure the rotation of the applying member for 0.5 to 10 seconds before bringing the applying member into contact with the toner image bearing section.

According to the invention, under the control of the control unit, before bringing the applying member kept away from the toner image bearing section into contact therewith by the contact and release operation section, the applying member is allowed to make at least one turn, and preferably the rotation is continued for 0.5 to 10 seconds by the rotational driving section. With the applying member kept away from the toner image bearing section in a non-rotating state, the volatile fixing fluid, in particular the fixing fluid existing on the surface of the applying member tends to be volatilized, thus causing changes in fluid amount and concentrations of active components contained in the fixing fluid, for example. If, in this state, the application of the fixing fluid is started upon the contact between the applying member and the toner image bearing section, there arises lack of uniformity in the application of the fixing fluid and thus image irregularity. In light of this, by exercising control in the above-described manner, it is possible to make uniform the amount of the fixing fluid to be retained on the surface of the applying member, the concentrations of active components contained in the fixing fluid, etc., and thereby form high-quality images free from irregularity with stability since the initiation of image formation.

In the invention, it is preferable that the image forming apparatus further comprises a heating section for heating the toner image bearing section that is arranged upstream from a location where the volatile fixing fluid is applied to the toner image bearing section by the applying member in a direction in which the toner image bearing section is driven to rotate, and that, under the control of the control unit, heating of the toner image bearing section by the heating section is carried out, and the applying member kept away from the toner image bearing section is rotated by the rotational driving section during an interval when the toner image bearing section is being heated by the heating section.

According to the invention, the image forming apparatus further comprises the heating section for heating the toner image bearing section that is arranged upstream from the location where the fixing fluid is applied to the toner image bearing section by the applying member in the direction in which the toner image bearing section is driven to rotate. Under the control of the control unit, heating of the toner image bearing section by the heating section is carried out, and the applying member kept away from the toner image bearing section is rotated by the rotational driving section during the interval when the toner image bearing section is being heated by the heating section. That is, with the toner image bearing section kept heated, even if the applying member is kept away from the toner image bearing section, its surface may undergo changes in fixing fluid amount and concentrations of active components contained in the fixing fluid due to the volatilization of the fixing fluid resulting from the radiation of heat from the toner image bearing section. Furthermore, being kept in a non-rotating state, the applying member is locally heated. If image formation is resumed in this state, the amount of the fixing fluid applied onto the locally heated part of the applying member tends to change, thus causing lack of uniformity in the application of the fixing fluid. In light of this, with the above-described constitution, it is possible to make uniform the amount of the fixing fluid on the surface of the applying member, the concentrations of active components contained in the fixing fluid, etc., as well as to prevent the applying member from being heated locally.

In the invention, it is preferable that the image forming apparatus further comprises:

a heating section for heating the toner image bearing section that is arranged upstream from a location where the volatile fixing fluid is applied to the toner image bearing section by the applying member in a direction in which the toner image bearing section is driven to rotate; and a temperature detecting section for detecting the temperature of the toner image bearing section, that the volatile fixing fluid which is applied to the toner image bearing section by the applying member contains at least two kinds of organic solvents and water, and that, under the control of the control unit, heating of the toner image bearing section by the heating section is carried out, and the applying member kept away from the toner image bearing section is rotated by the rotational driving section on the basis of the result of the temperature detecting section.

According to the invention, the image forming apparatus further comprises, in addition to the heating section such as that described above, the temperature detecting section for detecting the temperature of the toner image bearing section. The fixing fluid for use contains at least two kinds of organic solvents and water. Under the control of the control unit, the heating section is operated, and the applying member kept away from the toner image bearing section is rotated by the rotational driving section on the basis of the result of the temperature detecting section. In this way, the fixing fluid on the surface of the applying member can be maintained uniform, and the applying member can be prevented from being heated locally. Accordingly, irrespective of the time for the resumption of image formation, high-quality images free from irregularity can be produced since the initiation of image formation.

In the invention, it is preferable that, when it is detected by the temperature detecting section that the temperature of the toner image bearing section is higher than, of the boiling points of at least two kinds of organic solvents contained in the volatile fixing fluid, the lowest boiling point, then the applying member kept away from the toner image bearing section is rotated by the rotational driving section under the control of the control unit.

According to the invention, the image forming apparatus further comprises the heating section and the temperature detecting section such as those described above. The fixing fluid for use contains at least two kinds of organic solvents and water. In this construction, when the temperature detecting section detects that the temperature of the toner image bearing section is higher than, of the boiling points of at least two kinds of organic solvents contained in the fixing fluid, the lowest boiling point, then the applying member kept away from the toner image bearing section is rotated by the rotational driving section under the control of the control unit. As the applying member and the toner image bearing section in a heated state spacedly confront each other, the constituent of the fixing fluid is volatilized due to radiant heat. In a case where the fixing fluid contains two or more kinds of active components for toner fixation in particular, the components are volatilized one after another in order of increasing boiling point, which results in variation in the proportions of the constituent components in the fixing fluid. If the fixing fluid is applied in a contact manner in this state, occurrence of problems such as lack of uniformity in fixing fluid application, improper fixation, and changes in image quality are inevitable. In light of this, in response to the result of detection showing that the temperature of the toner image bearing section is higher than, of the boiling points of the organic solvents contained in the fixing fluid, the lowest boiling point, the applying member is rotated to make uniform the amount of the fixing fluid on the surface thereof, the composition of the fixing fluid, and so forth, as well as to avoid local heating. This makes it possible to form high-quality images as intended regardless of when image formation process is resumed.

In the invention, it is preferable that the image forming apparatus further comprises:

a heat-insulating protection member interposed between the toner image bearing section and the applying member in contact with or away from the applying member, the heat-insulating protection member being so supported as to be movable between a closing position for closing between the toner image bearing section and the applying member and an opening position for allowing the toner image bearing section and the applying member to face each other in a space between the toner image bearing section and the applying member; and a protection member moving section for moving the heat-insulating protection member between the closing and opening positions.

According to the invention, the heat-insulating protection member is interposed between the toner image bearing section and the applying member in contact with or away from the applying member. The heat-insulating protection member is so supported as to be movable between the closing position and the opening position. When the heat-insulating protection member is sitting at the closing position, separation is achieved between the toner image bearing section and the applying member. When it is sitting at the opening position, the toner image bearing section and the applying member are brought into direct confrontation with each other. The movement of the heat-insulating protection member is effected by the protection member moving section. In this construction, even if the toner image bearing section is in a heated state to develop radiant heat, the amount of the fixing fluid on the surface of the applying member, the concentrations of active components, the constituent ratio, etc. can be maintained constant and uniform. This helps prevent occurrence of image irregularity resulting from lack of uniformity in the application of the fixing fluid. Moreover, in a case where the heat-insulating protection member and the applying member are arranged in a non-contact manner, the surface of the applying member is not subjected to any damage during the movement of the heat-insulating protection member. This makes it possible to make a layer of the fixing fluid on the applying member uniform, and thereby avoid lack of uniformity in the application of the fixing fluid and ensuing image irregularity. Hence, high-quality images can be produced with stability for a longer period of time.

In the invention, it is preferable that the heat-insulating protection member is disposed in contact with the applying member, and that at least a surface thereof contacted by the applying member is made of a material whose hardness is lower than the surface hardness of the applying member.

According to the invention, in the heat-insulating protection member disposed in contact with the applying member, at least its surface contacted by the applying member is made of a material whose hardness is lower than the surface hardness of the applying member. In this case, when the heat-insulating protection member is moved between the closing and opening positions, the surface of the applying member is not subjected to any damage, and is also free from a trace of deformation when the heat-insulating protection member is sitting at the closing position. Accordingly, even if image formation is resumed, lack of uniformity in fixing fluid application resulting from damage, a trace of deformation, etc. on the surface of the applying member can be prevented. Further, when sitting at the closing position, the heat-insulating protection member makes contact with the applying member to cut off the radiation of heat from the toner image bearing section. This helps prevent vaporization of the fixing fluid and thereby reduce unnecessary fixing fluid consumption.

In the invention, it is preferable that, in the heat-insulating protection member, at least the surface thereof contacted by the applying member is made of a material which exhibits a contact angle of 60 degrees or above with respect to the volatile fixing fluid.

According to the invention, in the heat-insulating protection member disposed in contact with the applying member, at least its surface contacted by the applying member is made of a material which exhibits a contact angle of 60 degrees or above with respect to the fixing fluid. In this case, the fixing fluid is inhibited from exuding to an end of the surface of the heat-insulating protection member contacted by the applying member to eventually leak outside. Moreover, since the surface of the heat-insulating protection member contacted by the applying member is free of the adhesion of the fixing fluid, during the shift of the heat-insulating protection member from the closing position to the opening position, it never occurs that the fixing fluid drops down from the heat-insulating protection member that will eventually cause contamination of the interior of the image forming apparatus.

In the invention, it is preferable that the heat-insulating protection member is constructed of a flexible film.

According to the invention, a flexible film is used as the heat-insulating protection member. In this case, when the heat-insulating protection member is moved between the closing and opening positions, the surface of the applying member is not subjected to any damage, and is also free from a trace of deformation when the heat-insulating protection member is sitting at the closing position. Moreover, since the heat-insulating protection member can be brought into intimate contact with the applying member, the volatilization of the fixing fluid can be prevented even further and unnecessary fixing fluid consumption can be reduced accordingly. Further, the thickness of the heat-insulating protection member can be reduced, wherefore the interval between the toner image bearing section and the applying member can be narrowed.

In the invention, it is preferable that the heat-insulating protection member has, at least along its outer periphery, a fixing fluid retaining portion for retaining the fixing fluid.

According to the invention, the heat-insulating protection member has, at least along its outer periphery, the fixing fluid retaining portion for retaining the fixing fluid. In this case, the fixing fluid is inhibited from exuding to the end of the surface of the heat-insulating protection member contacted by the applying member to eventually leak outside. Moreover, even if the fixing fluid is adhered to the surface of the heat-insulating protection member contacted by the applying member, since the adherent fixing fluid is retained by the fixing fluid retaining portion, it never occurs that the fixing fluid drops down from the heat-insulating protection member that will eventually cause contamination of the interior of the image forming apparatus.

In the invention, it is preferable that the fixing fluid retaining portion is composed of a porous material capable of adsorbing and retaining the volatile fixing fluid.

According to the invention, the fixing fluid retaining portion formed at least along the outer periphery of the heat-insulating protection member is composed of a porous material. Since the porous material is capable of absorbing and retaining a large amount of the fixing fluid, the fixing fluid can be prevented successfully from running from the heat-insulating protection member.

In the invention, it is preferable that the porous material is a sponge having an open-cell structure inside.

According to the invention, a sponge having an open-cell structure inside is used as the porous material to constitute the fixing fluid retaining portion which is formed at least along the outer periphery of the heat-insulating protection member. In this case, not only it is possible to retain a larger amount of the fixing fluid, but it is also possible to avoid that, for example, a scrap piece of the sponge is adhered to the surface of the applying member that will eventually cause unevenness in the fixing fluid layer on the surface of the applying member, and thus there is no lack of uniformity in fixing fluid application. For example, if a closed-celled sponge is used, the amount of the fixing fluid to be absorbed and retained in the fixing fluid retaining portion will be low, and, if a material composed of felt-like fibers is used, the surface of the applying member will be lint-laden, which leads to unevenness in the fixing fluid layer on the surface of the applying member and thus to lack of uniformity in fixing fluid application.

In the invention, it is preferable that the applying section comprises:

a fixing fluid storage chamber for storing the fixing fluid in its interior space, which has an opening formed so as to face the toner image bearing section;

a applying member which is supported within the fixing fluid storage chamber so as to be rotated, at least part of which confronts the toner image bearing section through the opening;

a heat-insulating protection member interposed between the toner image bearing section and the fixing fluid storage chamber, which is so supported as to be movable between a closing position for blocking the opening of the fixing fluid storage chamber to make the interior space of the fixing fluid storage chamber closed space and an opening position for bringing the toner image bearing section and the applying member faced with each other through the opening of the fixing fluid storage chamber; and a protection member moving section for moving the heat-insulating protection member between the closing and opening positions.

According to the invention, the applying section comprises the fixing fluid storage chamber having an opening, the applying member which is supported within the fixing fluid storage chamber so as to be rotated, the heat-insulating protection member interposed between the toner image bearing section and the fixing fluid storage chamber, and the protection member moving section. At least part of the applying member confronts the toner image bearing section through the opening. The heat-insulating protection member is so supported as to be movable between closing and opening positions. When it is sitting at the closing position, the opening of the fixing fluid storage chamber is blocked to make the interior space of the fixing fluid storage chamber closed space. When it is sitting at the opening position, the toner image bearing section and the applying member are brought into direct confrontation with each other. The protection member moving section moves the heat-insulating protection member between the closing and opening positions. In this construction, the fixing fluid storage chamber can be hermetically sealed when the application of the fixing fluid is not carried out. This makes it possible to prevent vaporization of the fixing fluid, and thereby eliminate unnecessary fixing fluid consumption and also avoid variation in constituent ratio in the fixing fluid containing constituent components of different vapor pressures.

In the invention, it is preferable that the control unit effects controlling of the rotational driving section in a manner so as to assure the rotation of the applying member that has been separated from the toner image bearing section by the heat-insulating protection member.

According to the invention, the control unit effects controlling of the rotational driving section in a manner so as to assure the rotation of the applying member that has been separated from the toner image bearing section by the heat-insulating protection member. That is, with the applying member kept at rest in a non-rotating state, the fixing fluid on the surface of the applying member may flow under gravitational force to eventually build up locally. If the applying member is rotated in this state in the absence of the heat-insulating protection member, there arises the possibility of splash and dropping of the buildup of the fixing fluid. In light of this, by rotating the applying member in a closed space, it is possible to avoid splash and dropping of the fixing fluid caused by the rotation of the applying member effected upon the resumption of image formation, and thereby protect the interior of the image forming apparatus against contamination.

Moreover, even in the presence of the heat-insulating protection member, when left standing for an extended period of time, the applying member may undergo local variation in the proportions of the constituent components in the fixing fluid deposited on its surface. In light of this, by rotating the applying member immediately after the image forming apparatus is turned on and after a lapse of a predetermined time interval following the completion of the previous image formation process, it is possible to eliminate the local variation in equality of the fixing fluid on the surface of the applying member. Accordingly, the fixing fluid layer on the surface of the applying member can be maintained uniform, and thus image irregularity resulting from lack of uniformity in the application of the fixing fluid can be prevented. Hence, high-quality images can be produced with stability for a longer period of time.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
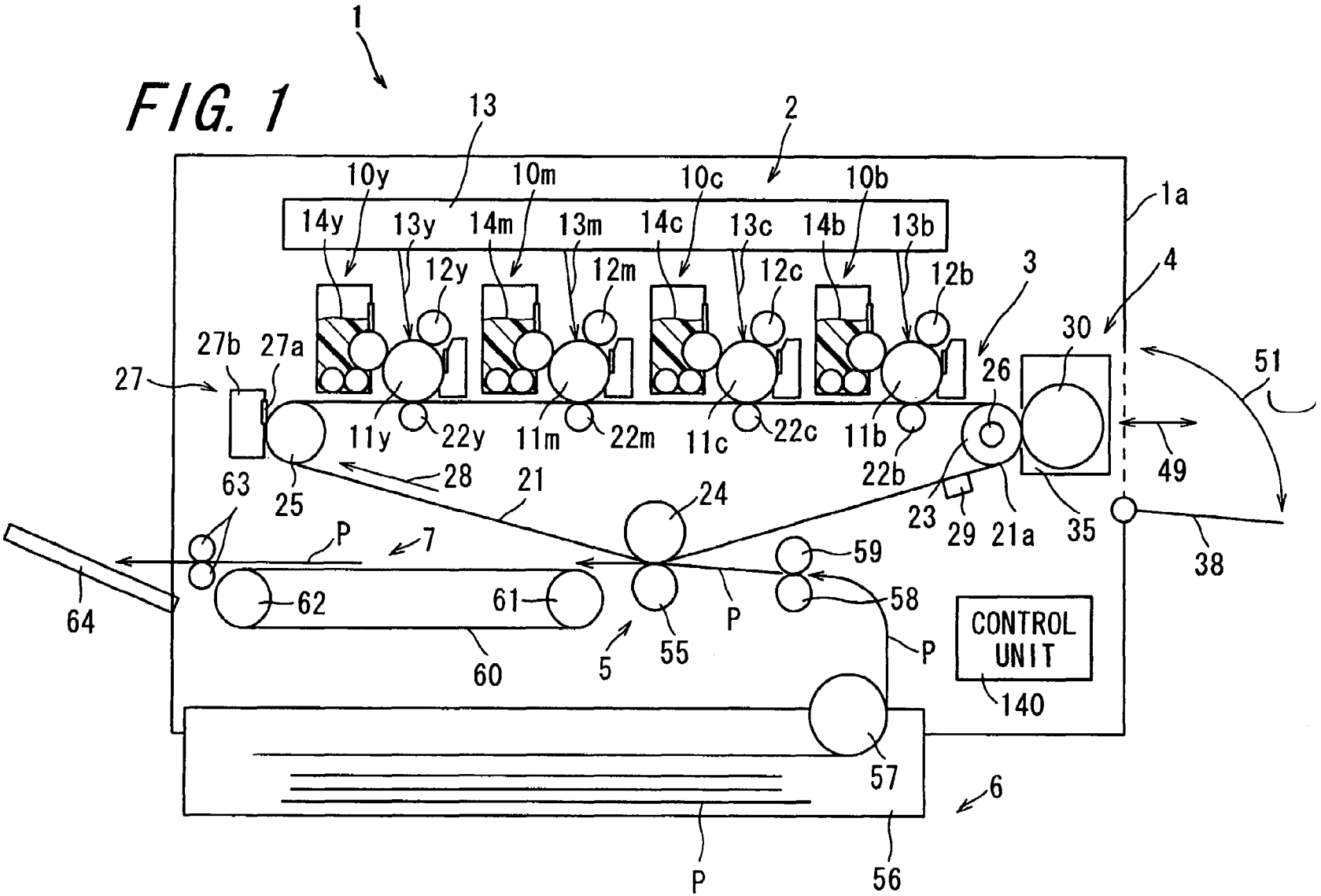
FIG. 1 is a sectional view schematically showing the constitution of an image forming apparatus 1 implemented according to a first embodiment of the invention.

Now referring to the drawings, preferred embodiments of the invention are described below.

Figure 2:
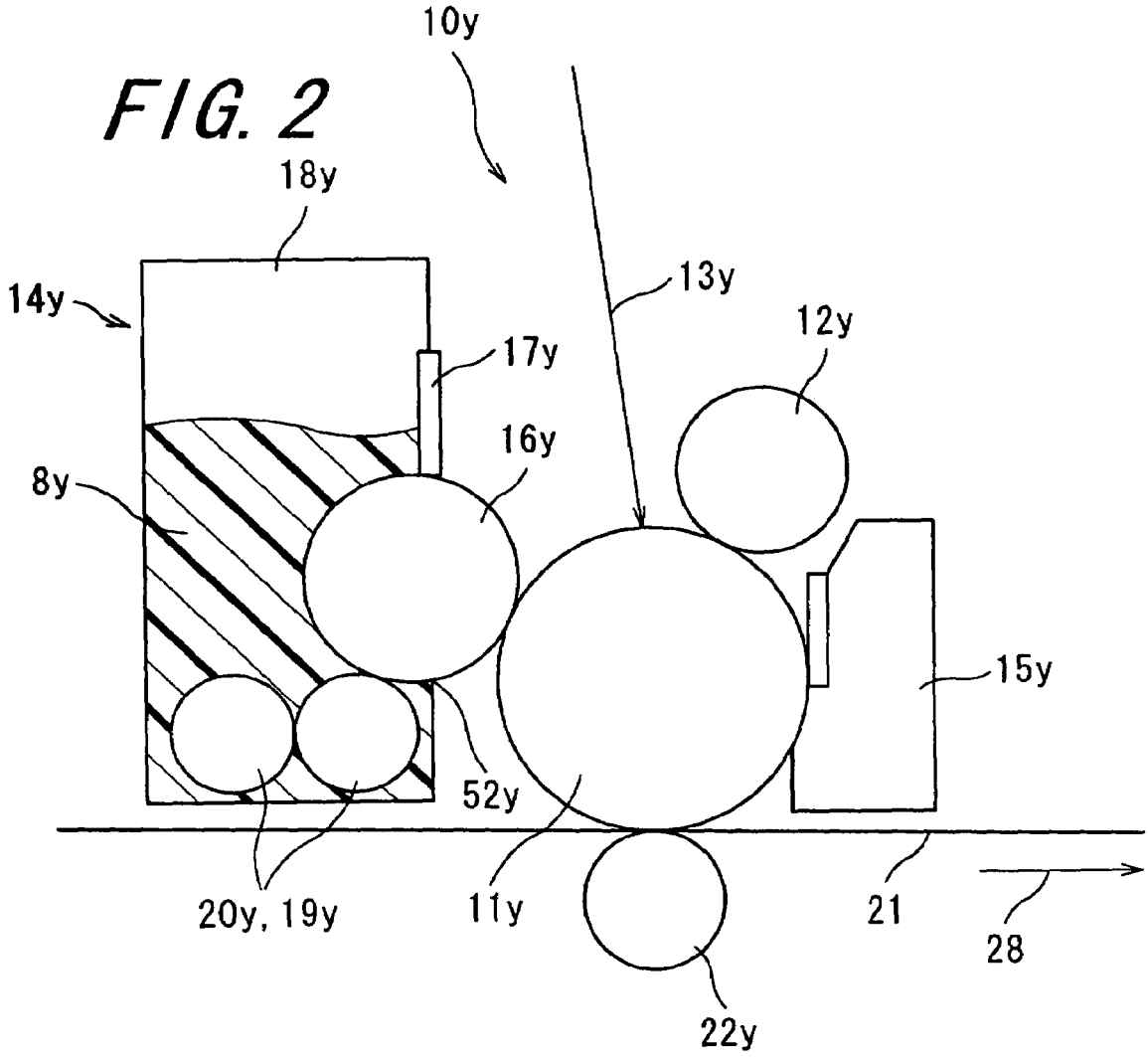
FIG. 2 is a sectional view showing the structure of the main portion.
Figure 3:
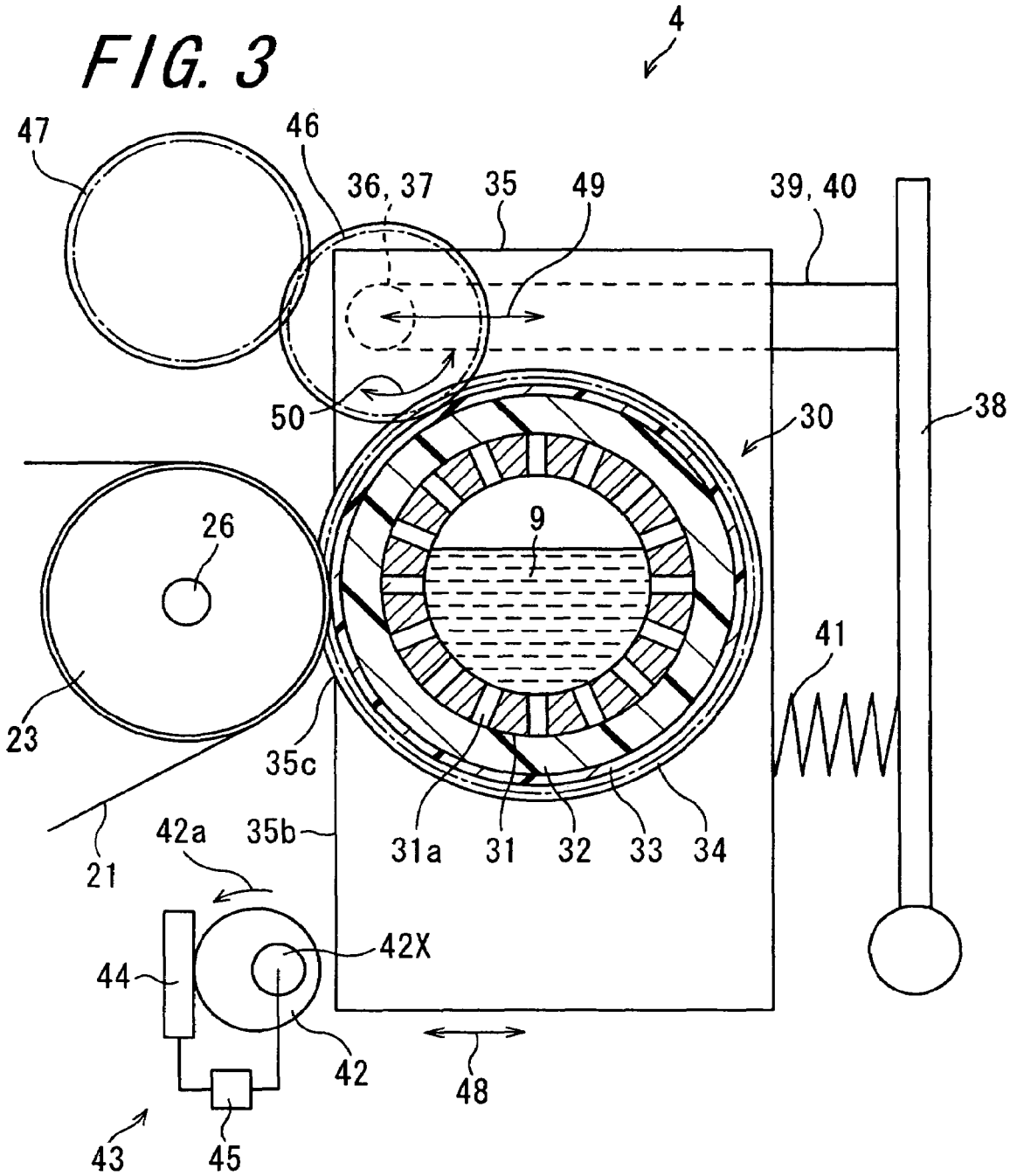
FIG. 3 is a sectional view showing the structure of the main portion.

FIG. 1 is a sectional view schematically showing the constitution of an image forming apparatus 1 implemented according to a first embodiment of the invention. FIG. 2 is a sectional view showing the structure of the main portion (a toner image forming section 2 as will be described later) of the image forming apparatus 1 depicted in FIG. 1 in enlarged form. FIG. 3 is a sectional view showing the structure of the main portion (a fixing fluid applying section 4 as will be described later) of the image forming apparatus 1 depicted in FIG. 1 in enlarged form.

The image forming apparatus 1 is built as a tandem-system electrophotographic image forming apparatus in which toner images of four colors: yellow; magenta; cyan; and black are superimposedly transferred one after another. The image forming apparatus 1 is composed of the toner image forming section 2, intermediary transfer section 3, the fixing fluid applying section 4, transferring and fixing section 5, recording medium supply section 6, and ejection section 7.

The toner image forming section 2 includes an image forming unit 10*y*, an image forming unit 10*m*, an image forming unit 10*c*, and an image forming unit 10*b*. The image forming units 10*y*, 10*m*, 10*c*, and 10*b* are aligned in a row in this order from the upstream side in a direction in which an intermediary transfer belt 21, which will be described later, is driven to rotate (sub-scanning direction), namely, a direction indicated by arrow 28. In the image forming units 10*y*, 10*m*, 10*c*, and 10*b*, electrostatic latent images corresponding to digital signals of predetermined different colors (hereafter referred to simply as "image data") are formed, and the resultant electrostatic latent images are individually developed into toner images of the predetermined different colors. More specifically, the image forming unit 10*y* is responsible for formation of a toner image corresponding to yellow-color image data; the image forming unit 10*m* is responsible for formation of a toner image corresponding to magenta-color image data; the image forming unit 10*c* is responsible for formation of a toner image corresponding to cyan-color image data; and the image forming unit 10*b* is responsible for formation of a toner image corresponding to black-color image data. The image forming unit 10*y* is composed of a photoreceptor drum 11*y*, a charging roller 12*y*, a light scanning unit 13*y*, a developing device 14*y*, and a drum cleaner 15*y*.

The photoreceptor drum 11*y*, which is so supported as to be driven to rotate about its axis by non-illustrated driving section, is composed of a non-illustrated electrically conductive substrate formed in the shape of cylinder, cylindrical column, or membrane (preferably, a cylindrical-shaped conductive substrate) and a photosensitive layer formed on the surface of the conductive substrate. As the photoreceptor drum 11*y*, those used customarily in this field can be used. For example, there is known a 30 mm-diameter photoreceptor drum connected at ground potential (GND), which is constituted by forming an organic photosensitive layer on a surface of an aluminum elementary pipe prepared for use as a conductive substrate. For example, the organic photosensitive layer is formed by laminating together a charge generating layer (resin layer) containing a charge generating substance and a charge transporting layer (resin layer) containing a charge transporting substance. Alternatively, the organic photosensitive layer may be formed of a single resin layer containing both the charge generating substance and the charge transporting substance. For example, the layer thickness of the organic photosensitive layer is set at 20 μm. It is also possible to interpose an undercoat layer between the photoreceptor drum and the organic photosensitive layer, as well as to provide a protection layer on the surface of the organic photosensitive layer. Instead of the organic photosensitive layer, an inorganic photosensitive layer made of zinc oxide, selenium, amorphous silicon, or the like substance may also be used. In this embodiment, the photoreceptor drum 11*y* is driven to rotate in a clockwise direction at a circumferential velocity of 200 mm/s.

The charging roller 12*y* is constructed of a roller-shaped member. By the charging roller 12*y*, the surface of the photoreceptor drum 11*y* is electrically charged with a predetermined polarity and at a predetermined potential. The charging roller 12*y* receives application of a voltage through a power source connected thereto (not shown in the figure) to discharge electricity for electrifying the surface of the photoreceptor drum 11*y*. In this embodiment, a voltage of −1200 V is applied to the charging roller 12*y*, and thereby the surface of the photoreceptor drum 11*y* is electrically charged at −600 V Instead of the charging roller 12*y*, a brush-type charging device, a charger-type charging device, and a corona charging device such as a scorotron charger may also be used. The light scanning unit 13 applies laser light 13*y* corresponding to the yellow-color image data to the surface of the photoreceptor drum 11*y* having been electrically charged by the charging roller 12*y*. In this way, an electrostatic latent image corresponding to the yellow-color image data is formed on the surface of the photoreceptor drum 11*y*. As a source of the laser light 13*y*, for example, a semiconductor laser is employed. In this embodiment, the −600 V-charged surface of the photoreceptor drum 11*y* is exposed to light, and thereby an electrostatic latent image at an exposure potential of −70 V is formed.

The developing device 14*y* is composed of a developing roller 16*y* constructed of a roller-shaped member, a developing blade 17*y* constructed of a platy member, a toner reservoir 18*y* constructed of a tank-shaped member having an inner space, and agitating rollers 19*y* and 20*y* each constructed of a roller-shaped member. The toner reservoir 18*y* has an opening 52*y* formed face to face with the photoreceptor drum 11*y*. Part of the developing roller 16*y* protrudes outwardly from the opening 52*y*. The developing roller 16*y* is spaced a certain distance (gap) away from the photoreceptor drum 11*y* and is made rotatable about its axis. Although not shown in the figure, a stationary magnetic pole is disposed inside the developing roller 16*y*. The developing roller 16*y* feeds an yellow-color toner 8*y* to the electrostatic latent image formed on the surface of the photoreceptor drum 11*y*. In this embodiment, the length of the gap between the developing roller 16*y* and the photoreceptor drum 11*y* is set at 0.5 mm. Moreover, the developing roller 16*y* is driven to rotate in the same direction as the rotation direction of the photoreceptor drum 11*y* in closest proximity to the photoreceptor drum 11*y*, namely, in a development nip portion. That is, the developing roller 16*y* and the photoreceptor drum 11*y* are driven to rotate in opposite directions in terms of axial rotation. In this embodiment, the circumferential velocity of the developing roller 16*y* is set at 300 mm/s, which is 1.5 times faster than that of the photoreceptor drum 11*y*. In order to feed the yellow-color toner 8*y* to the electrostatic latent image formed on the surface of the photoreceptor drum 11*y*, the developing roller 16*y* receives application of a d.c. voltage through a non-illustrated power source connected thereto. In this embodiment, as a development potential, a d.c. voltage of −240 V is applied to the developing roller 16*y*. The developing blade 17*y* has its one end supported by the toner reservoir 18*y*, and the other end spaced a certain distance (gap) away from the developing roller 16*y*. The developing blade 17*y* acts to provide uniformity in a yellow-color toner layer deposited on the surface of the developing roller 16*y* (layer regulation). The toner reservoir 18*y* for storing therein the yellow-color toner 8*y* has, as has already been explained, the opening 52*y* formed on its surface facing with the photoreceptor drum 11*y*. In the inner space of the toner reservoir 18*y* are arranged the developing roller 16*y* and the agitating rollers 19*y* and 20*y*. The toner reservoir 18*y* is replenished with the yellow-color toner 8*y* from a non-illustrated toner cartridge as required based on the usage amount of the yellow-color toner 8*y*. In this embodiment, the yellow-color toner 8*y* in admixture with magnetic carriers is used as a dual-component developing agent. However, the invention is not limited thereto, and therefore the yellow-color toner 8*y* may also be used as a one-component developing agent by itself. In the inner space of the toner reservoir 18*y*, the agitating rollers 19*y* and 20*y* are spaced apart by a certain distance (gap) and are each made rotatable about its axis. The agitating roller 19*y* is arranged face to face with the developing roller 16*y*, with a certain distance (gap) secured therebetween. As the agitating rollers 19*y* and 20*y* are rotated, the yellow-color toner 8*y* supplied into the toner reservoir 18*y* from the non-illustrated toner cartridge and magnetic carriers charged inside the toner reservoir 18*y* in advance are blended together, and the admixture is fed to the region around the developing roller 16*y*. In this embodiment, the photoreceptor drum 11*y*, the developing roller 16*y*, the developing blade 17*y*, and the agitating rollers 19*y* and 20*y* are arranged in spaced relation to one another. However, the invention is not limited thereto, and therefore these constituent components may also be arranged in conformity with a one-component toner development process; that is, the photoreceptor drum 11*y* and the developing roller 16*y* are arranged in pressure-contact with each other, and so are the developing roller 16*y* and the developing blade 17*y*, the developing roller 16*y* and the agitating roller 19*y*, and the agitating roller 19*y* and the agitating roller 20*y*. According to the developing device 14*y*, the yellow-color toner 8*y* stored in the toner reservoir 18*y* is fed to the region around the developing roller 16*y* by the agitating rollers 19*y* and 20*y*. Upon the yellow-color toner 8*y* being adhered to the surface of the developing roller 16*y*, a toner layer is formed thereon. The toner layer is made uniform in layer thickness by the developing blade 17*y*. After that, the toner constituting the uniformly thick toner layer is substantially selectively fed to the electrostatic latent image formed on the surface of the photoreceptor drum 11*y* by exploiting a potential difference or other factors, whereupon a toner image corresponding to the yellow-color image data is formed. As will be described later on, after the yellow-color toner image formed on the surface of the photoreceptor drum 11*y* is transferred onto the intermediary transfer belt 21, the drum cleaner 15*y* serves to remove and collect the residual yellow-color toner remaining on the surface of the photoreceptor drum 11*y*.

According to the image forming unit 10*y*, the surface of the photoreceptor drum 11*y*, now placed in an electrically charged state by the electricity discharge action of the charging roller 12*y*, is irradiated with signal light, the laser light 13*y* corresponding to the yellow-color image data emitted from the light scanning unit 13. In this way, an electrostatic latent image is formed. Then, the yellow-color toner 8*y* is fed from the developing device 14*y* to the electrostatic latent image under the influence of a potential difference, whereupon the electrostatic latent image is developed into an yellow-color toner image. As will be described later on, the yellow-color toner image is transferred onto the intermediary transfer belt 21 which is brought into pressure-contact with the surface of the photoreceptor drum 11*y* and is driven to rotate in the direction of arrow 28. The yellow-color toner 8*y* remaining on the surface of the photoreceptor drum 11*y* is removed and collected by the drum cleaner 15*y*. The image forming units 10*m*, 10*c*, and 10*b* have basically the same structure as that of the image forming unit 10*y*, the sole difference being the color of toner for use. That is, the image forming unit 10*m* uses a magenta-color toner 8*m*, the image forming unit 10*c* uses a cyan-color toner 8*c*, and the image forming unit 10*b* uses a black-color toner 8*b*. Therefore, such constituent components as are common to those in the image forming unit 10*y* will be identified with the same reference symbols, and yet the reference symbols will be added with suffixes "m", "c", and "b" that indicate a magenta color, a cyan color, and a black color, respectively, instead of "y", case by case. Overlapping descriptions will be omitted accordingly.

The toners of different colors 8*y*, 8*m*, 8*c*, and 8*b* (in the following description, there may be cases where they are collectively called "the toner 8" unless otherwise specified) each contain a binder resin, a coloring agent, and a mold releasing agent. No particular limitation is imposed on the selection of the binder resin so long as it can be softened or swollen by a fixing fluid 9 which will be explained later on. The examples thereof include: polystyrene; a homopolymer of a styrene derivative substitution; a styrene-series copolymer; polyvinyl chloride; polyvinyl acetate; polyethylene; polypropylene; polyester; and polyurethane. These binder resin materials may be used in a singular manner or in combination of two or more kinds. Among them, with consideration given to color toner formation, it is desirable to use a binder resin material having a softening point ranging from 100° C. to 150° C. and a glass transition temperature ranging from 50° C. to 90° C. in terms of preservability, durability, and control of the softening or swelling effect produced by the fixing fluid 9. The use of such a polyester material as has a softening point and a glass transition temperature falling in the aforementioned range is particularly desirable. This is because polyester is easily softened or swollen by an easy-to-find organic solvent, and turns out to be transparent in a softened or swollen state. Accordingly, upon a multi-color toner image, which is formed by superimposing toner images of four colors: yellow; magenta; cyan; and black one upon another, being fixed into place by the fixing fluid 9, then polyester used as the binder resin per se turns out to be transparent. This makes it possible to attain excellent coloration in accordance with a subtractive color mixing process. Moreover, image fixation using the fixing fluid 9 can be achieved also in the case of using a resin material such as that which is higher in softening point and in hardness than a binder resin to be contained in a toner for use in the heat fixing method. The use of a resin material having a high softening point and a high hardness makes it possible to prevent image degradation resulting from application of a load during the course of development, and thereby obtain high-quality images for a longer period of time. Although such a resin material as has a high softening point and a high hardness will fail to exhibit good fixation property and good coloration when used in the heat fixing method, in a case where a toner is chemically swollen and softened through the application of the fixing fluid 9, the resin material makes formation of high-quality images possible. In this embodiment, polyester having a glass transition temperature of 90° C. and a softening point of 120° C. is used. As the coloring agent, pigments and dyestuffs adaptable to toner formation that have conventionally been used in electrophotographic image formation can be used. In particular, the use of a pigment material which is insoluble in the fixing fluid 9 is desirable from the standpoint of preventing the occurrence of smearing resulting from the application of the fixing fluid 9. The examples of suitable pigments include: organic pigments such as azo-base pigments, benzimidazolone-base pigments, quinacridon-base pigments, phthalocyanine-base pigments, isoindolinone-base pigments, isoindoline-base pigments, dioxazine-base pigments, anthraquinone-base pigments, perylene-base pigments, thioindigo-base pigments, quinophthalone-base pigments, and metal complex-base pigments; inorganic pigments such as carbon black, titanium oxide, molybdenum red, chrome yellow, titanium yellow, chrome oxide, and Berlin blue; and metal powder such as aluminum powder. These pigment materials may be used in a singular manner or in combination of two or more kinds. As the mold releasing agent, for example, a wax can be used. Wax materials that have been used customarily in this field can be used. In particular, the use of a wax which is softened or swollen by the fixing fluid 9 is desirable. Specific examples thereof include: a polyethylene wax; a polypropylene wax; and a paraffin wax. In this embodiment, there is used a low-molecular polyethylene wax having a softening point of 70° C., which is lower than the softening point of the binder resin contained in the toner 8. The wax which is lower in softening point than the binder resin can be softened readily through application of heat. That is, the use of such a wax makes it possible to increase toner-to-toner adherability and also the adherability of the toner with respect to the toner carrier and the recording medium P, even under a temperature lower than the softening point of the binder resin and thus that of the toner. Accordingly, at the time of the application of the fixing fluid 9, the occurrence of problems such as undesirable flowing and coagulation of the toner can be avoided. Another advantage is that, as the wax is softened, the fixing fluid 9 finds its way smoothly into the toner particles through the wax-present part, wherefore the toner, in its entirety, can be swollen and softened in a short period of time at the time of the application of the fixing fluid 9. This makes is possible to attain sufficiently high fixation strength when a toner image is transferred and fixed onto the recording medium P, as well as to achieve good coloration by the superposition of toner images. Note that the toner 8 may contain, in addition to the binder resin, the coloring agent, and the mold releasing agent, one kind or two kinds or more of commonly used toner additives selected among from a charge controlling agent, a flowability enhancer, a fixation accelerator, a conducting agent, and so forth.

The toner 8 can be produced in accordance with conventionally-known manufacturing methods. For example, according to a pulverization method, a toner is obtained by dispersing a coloring agent, a mold releasing agent, and other additive as required in a binder resin, and subjecting the admixture to pulverization. According to a polymerization method, a toner is obtained by blending together a coloring agent, a mold releasing agent, binder resin monomer, and so forth evenly, and subjecting the binder resin monomer to polymerization. Although the volumetric average particle diameter of the toner 8 is not particularly restricted, preferably it is set to fall in a range of from 2 μm to 7 μm. The use of such a toner as has a small particle size makes it possible to increase the surface area of the toner per unit area of toner image, and thereby increase the area of contact with the fixing fluid 9, with the result that the toner 8 can be fixed onto the recording medium P in a shorter period of time. Another advantage is that, since the fixing fluid 9 can be dried swiftly, it never occurs that wrinkles, curls, or the like are generated in the recording medium P. Moreover, when it is assumed that there are toners of the same weight, the one having a smaller particle diameter than the other will exhibit a higher toner coverage rate with respect to the recording medium P. That is, the smaller is the particle diameter of the toner 8, the more likely it is that a high-quality image can be formed with a smaller amount of the adherent toner 8. This makes it possible to satisfy conflicting requirements: a reduction in toner consumption and enhancement of image quality. In this embodiment, as the toner 8, there is used an insulating non-magnetic toner which is negatively charged, has a volumetric average particle diameter of 6 μm, and exhibits an angle of contact with the fixing fluid 9 of 47 degrees. In this toner 8, the content of the coloring agent and the content of the wax stand at 12% and 7%, by weight, respectively, relative to the total amount of the toner, and the remainder is the binder resin. In order to obtain a predetermined image density (a reflection density value of 1.4 obtained when measured by a reflection densitometer type 310 manufactured by X-Rite Corporation), it is necessary to use the toner in an amount of 5 g/m$^2$ per unit area.

The intermediary transfer section 3 is composed of the intermediary transfer belt 21, intermediary transfer rollers 22*y*, 22*m*, 22*c*, and 22*b*, supporting rollers 23, 24, and 25, a belt cleaner 27, and temperature detecting section 29. The intermediary transfer belt 21 acting as toner image bearing section is designed as an endless belt stretched across the supporting rollers 23, 24, and 25, for forming a loop-like traveling path. The intermediary transfer belt 21 is rotated in the direction of arrow 28 at a circumferential velocity which is substantially equal to that of the photoreceptor drum 11*y*, 11*m*, 11*c*, 11*b*. There is no particular limitation to the structure of the intermediary transfer belt 21 so long as it is made impervious to the fixing fluid 9. For example, the intermediary transfer belt 21 may be constructed of a laminated body composed of a film-shaped substrate, an elastic resin layer formed on the surface of the film-shaped substrate, and a fluorine resin-containing cover layer formed on the surface of the elastic resin layer. In this case, the surface of the cover layer acts as a toner image bearing surface 21*a*. As the film-shaped substrate, for example, it is possible to use a resin material such as polyimide and polycarbonate, or a rubber material such as fluorine rubber formed in the shape of film. The fluorine resin-containing cover layer is made to contain fluorine resin such as PTFE (polytetrafluoroethylene), PFA (tetrafluoroethylene-perfluoroalkylvinylether copolymer), or an admixture thereof. One of the film-shaped substrate, the elastic resin layer, and the fluorine resin-containing cover layer, or two or more of them, may contain an electrically conductive substance to effect adjustment of the value of electrical resistance for the intermediary transfer belt 21. As the electrically conductive substance, for example, furnace type black, thermal type black, channel type black, and graphite carbon can be used. The intermediary transfer belt 21 is not limited to the belt shape, but may be of another shape, for example, a drum shape. In this embodiment, the intermediary transfer belt 21 for use has the belt shape, and is constructed of a laminated body obtained by forming, on a surface of a 100 μm-thick polyimide film, a 300 μm-thick silicon rubber layer and a 20 μm-thick fluorine resin-containing cover layer successively. The fluorine resin-containing cover layer is made of a fluorine resin composition in which PTFE and PFA are contained at a ratio of 8:2 (ratio by weight), and has an angle of contact with the fixing fluid 9 of 70 degrees. In this way, with the intermediary transfer belt 21 constructed of a material which is impervious to the fixing fluid 9, most part of the fixing fluid 9 to be applied can be adhered to the surface of the toner 8. This makes it possible to avoid generation of wrinkles, curls, or the like resulting from the permeation of the fixing fluid 9 into the recording medium P, as well as to achieve a reduction in fixing fluid 9 consumption. The toner image bearing surface 21*a* of the intermediary transfer belt 21 is, from the upstream side in its rotation direction (in the direction of arrow 28), brought into pressure-contact with the photoreceptor drums 11*y*, 11*m*, 11*c*, and 11*b* one after another in the order named. At the location where the intermediary transfer belt 21 is brought into pressure-contact with the photoreceptor drum 11*y*, 11*m*, 11*c*, 11*b*, a toner image of corresponding color is transferred onto the intermediary transfer belt 21 (an intermediary transfer nip portion).

The intermediary transfer rollers 22*y*, 22*m*, 22*c*, and 22*b* formed as roller-shaped members are arranged face to face with the photoreceptor drums 11*y*, 11*m*, 11*c*, and 11*b*, respectively, with the intermediary transfer belt 21 lying therebetween. The intermediary transfer rollers 22*y*, 22*m*, 22*c*, and 22*b* are each brought into pressure-contact with the surface of the intermediary transfer belt 21 opposite to the toner image bearing surface 21*a*, and are each driven to rotate about their axes by a non-illustrated driving section. For example, the intermediary transfer rollers 22*y*, 22*m*, 22*c*, and 22*b* are each constructed of a roller member composed of a metal-made shaft body having its surface covered with an electrically conductive layer. The shaft body is made of a metal material, for example, stainless steel. Although the diameter of the shaft body is not particularly restricted, preferably it is set to fall in a range of from 8 mm to 10 mm. The electrically conductive layer, which is provided to apply a high voltage to the intermediary transfer belt 21 evenly, is made of an electrically conductive elastic element, for example. As the electrically conductive elastic element, those used customarily in this field can be used. For example, it is possible to use an electrically conductive elastic element obtained by dispersing a conductive substance, for example, carbon black in a matrix such as ethylene propylene diene rubber (EPDM), foamed EPDM, and foamed urethane. In order for toner images formed on the surfaces of the photoreceptor drums 11*y*, 11*m*, 11*c*, and 11*b* to be transferred onto the intermediary transfer belt 21, an intermediary transfer bias of a polarity reverse to the polarity of the charged toner is impressed on the intermediary transfer rollers 22*y*, 22*m*, 22*c*, and 22*b* under constant-voltage control. In this way, the toner images of four colors: yellow; magenta; cyan; and black formed on the surfaces of the photoreceptor drums 11*y*, 11*m*, 11*c*, and 11*b*, respectively, are superimposedly transferred to the intermediary transfer nip portion on the toner image bearing surface 21*a* of the intermediary transfer belt 21 one after another, whereupon a multi-color toner image is formed. Note that, in a case where only part of the yellow-color image data, the magenta-color image data, the cyan-color image data, and the black-color image data is inputted, of the image forming units 10*y*, 10*m*, 10*c*, and 10*b*, only the one/ones corresponding to the input image data is/are operated to achieve toner image formation.

The supporting rollers 23, 24, and 25 are each driven to rotate about their axes by the non-illustrated driving section, on which the intermediary transfer belt 21 is driven to rotate in the direction of arrow 28. For example, the supporting rollers 23, 24, and 25 are each constructed of an aluminum-made pipe-shaped roller which is 30 mm in diameter and 1 mm in wall thickness. The supporting roller 23 has a heating section 26 in its inside and thus serves also as a heating roller. The heating section 26 is operated under the control of a control unit 140 which controls all of the workings of the image forming apparatus 1, in response to a detection result as to the temperature of the intermediary transfer belt 21 produced by the temperature detecting section 29 located downstream from the supporting roller 23 in the direction in which the intermediary transfer belt 21 is driven to rotate. The control unit 140 is realized by a CPU (Central Processing Unit). The details of the control will be explained later on. It is preferable that a toner image is heated by the heating section 26 to a temperature which is equal to or higher than the glass transition temperature of the binder resin contained in the toner 8 constituting the toner image. In this case, as the binder resin is softened, the toner 8-to-toner 8 adherability and the adherability of the toner 8 with respect to the intermediary transfer belt 21 can be increased. Accordingly, when the fixing fluid 9 is provided by a coating roller 30 serving as a applying member it never occurs that the toner 8 is offset with respect to the coating roller 30 and that the toner image suffers from irregularity. This makes it easy for the coating roller 30 to apply the fixing fluid 9 to the toner image in a contact manner. In this embodiment, the toner 8 for use contains the binder resin having a glass transition temperature of 90° C., and the temperature of the intermediary transfer belt 21 is adjusted to be kept at 100° C., which is higher than the glass transition temperature of the binder resin contained in the toner 8. By exercising temperature control in this way, the toner image borne on the intermediary transfer belt 21 can be heated to substantially the same temperature as that of the intermediary transfer belt 21 when passing through the surface of the supporting roller 23. Note that, when the fixing fluid 9 is provided by the subsequently-described coating roller 30 in a contact manner, the intermediary transfer belt 21 and the toner image borne thereon undergo a drop in temperature due to the application of the fixing fluid 9. At this time, a certain amount of heat is immediately provided to make up for the decrease of temperature, wherefore the toner constituting the toner image can be swollen and softened more smoothly. Moreover, the heating section 26 is adjusted to function only when the intermediary transfer belt 21 is being driven to rotate. The heating section 26 is disposed for the purpose of assisting toner image fixation that is effected by the fixing fluid 9 to achieve further reduction of fixing fluid 9 consumption. Therefore, the heating section 26 does not have to be designed to produce heat to the extent necessary to achieve thermal fixation of toner images. That is, even if the heating section 26 is disposed, the image forming apparatus 1 consumes far less power than does a typical image forming apparatus that adopts the heat fixing method. For example, a halogen lamp may be used for the heating section 26. The supporting roller 24 is electrically connected to ground, and serves also as a back up roller for image transference and fixation that is effected by the subsequently-described transferring and fixing section. The supporting roller 25 serves as a tension roller for imparting a tension to the intermediary transfer belt 21.

After the toner image borne on the toner image bearing surface 21*a* of the intermediary transfer belt 21 is transferred onto the recording medium P in the subsequently-described transferring and fixing section 5, the belt cleaner 27 removes the residual toner remaining on the toner image bearing surface 21*a*. The belt cleaner 27 is composed of a cleaning blade 27*a* and a toner vessel 27*b*. The cleaning blade 27*a* is arranged in confrontation with the supporting roller 25, with the intermediary transfer belt 21 lying therebetween, and is brought into pressure-contact with the toner image bearing surface 21*a* by a non-illustrated pressurizing section. The cleaning blade 27*a* is constructed of a platy member so as to scrape off the residual toner remaining on the toner image bearing surface 21*a*, paper powder, and so forth. For example, a blade made of a rubber material such as urethane rubber may be used for the cleaning blade 27*a*. The toner vessel 27*b* stores therein the residual toner, offset toner, paper powder, and so forth scraped off by the cleaning blade 27*a*.

The temperature detecting section 29 detects the temperature of the intermediary transfer belt 21. The result of detection produced by the temperature detecting section 29 is transmitted to the control unit 140 for controlling all of the workings of the image forming apparatus 1. The control unit 140 is provided with a storage section, a computation section, and a control section. The result of detection produced by the temperature detecting section 29 is inputted to the storage section. In the storage section is provided in advance a certain temperature for the intermediary transfer belt 21 determined on the basis of physical property data such as the softening points of the binder resin and the mold releasing agent contained in the toner 8 (controlled temperature). In the computation section of the control unit 140, a comparison is made between the result of detection produced by the temperature detecting section 29 and the controlled temperature of the intermediary transfer belt 21. When the computation result shows that the temperature detected by the temperature detecting section 29 is lower than the controlled temperature, the control unit 140 effects control of the control section in a manner so as to send a control signal to the heating section 26 to raise the temperature of the intermediary transfer belt 21. On the other hand, when the computation result shows that the detected temperature is higher than the controlled temperature, the control unit 140 effects control of the control section in a manner so as to send a control signal to the heating section 26 to stop the heating operation of the heating section 26. In this embodiment, a temperature sensor is used for the temperature detecting section 29. According to the intermediary transfer section 3, the toner images of different colors formed on the surfaces of the photoreceptor drums 11*y*, 11*m*, 11*c*, and 11*b* are superimposedly transferred to the intermediary transfer nip portion on the toner image bearing surface 21*a* of the intermediary transfer belt 21 one after another, whereupon a toner image is formed. The toner image thus formed receives the application of the fixing fluid 9 from the fixing fluid applying section 4, and is then transferred onto the recording medium P by the transferring and fixing section 5. After that, the residual toner remaining on the toner image bearing surface 21*a* of the intermediary transfer belt 21 and so forth are removed by the belt cleaner 27 in preparation for subsequent toner image transference on the toner image bearing surface 21*a*.

In the fixing fluid applying section 4, the fixing fluid 9 is applied to the toner image borne on the toner image bearing surface 21*a* of the intermediary transfer belt 21 in a contact manner, thereby softening and/or swelling out the toner image. By designing the fixing fluid applying section 4 to apply the fixing fluid 9 in a contact manner, it is possible to apply the fixing fluid 9 also to a so-called fogged toner which is adhered to a non-image portion, and thus fix the fogged toner into place. This helps prevent the adhesion of the fogged toner to user's hands or clothing, for instance. Note that the amount of the fogged toner is so minute that the fixation of the fogged toner onto the recording medium P exerts little influence upon a resultant image. The fixing fluid applying section 4 is disposed, in a location downstream from the supporting roller 23 in the direction in which the intermediary transfer belt 21 is driven to rotate, vertically below the intermediary transfer belt 21 so as to face with the toner image bearing surface 21*a*. The fixing fluid applying section 4 is composed of the coating roller 30, a fixing fluid storage chamber 35, an open/close gate 38, guide grooves 39 and 40, a press spring 41, an eccentric cam 42, a contact and release detecting section 43, an intermediary gear 46, and a driving gear 47.

The coating roller 30 is constructed of a roller-shaped member, part of which protrudes outwardly from an opening 35*c* created on a surface of the fixing fluid storage chamber 35 that faces the intermediary transfer belt 21, and is designed to move approachably and separably with respect to the intermediary transfer belt 21. The coating roller 30 is composed of a core metal 31, an impregnation control layer 32 formed on the surface of the core metal 31, and a porous layer 33 formed on the surface of the impregnation control layer 32. The core metal 31 has non-illustrated flanges at both lengthwise ends, and its rotary shaft, which is formed integrally with the flanges, is supported on a non-illustrated bearing disposed within the fixing fluid storage chamber 35. With this arrangement, the coating roller 30 is rotatably supported by the fixing fluid storage chamber 35. As the core metal 31, those used customarily in this field can be used. In this embodiment, an aluminum-made core bar which is 30 mm in outer diameter and 0.5 mm in wall thickness is used. Moreover, the core metal 31 has formed therein a plurality of through holes for allowing passage of the fixing fluid 9 as passing holes 31*a*. In this embodiment, 16 pieces of 0.1 mm-diameter passing holes 31*a* are arranged at equal angles to each other in a direction circumferentially of the core metal 31. They are spaced 5 mm apart, and the adjacent passing holes 31*a* are relatively shifted by half a phase in a direction axially of the core metal 31. Inside the core metal 31 is held and stored the fixing fluid 9. Accordingly, the core metal 31 serves not only to increase the rigidity of the coating roller 30, but also to store the fixing fluid 9 as a storage layer. The fixing fluid 9 stored inside the core metal 31 exhibits volatility. In this embodiment, a vapor pressure as observed at a temperature of 20° C. is taken as an index of volatility. That is, it is preferable that the fixing fluid 9 exhibits a vapor pressure of 0.005 MPa or above at 20° C., and more preferably the vapor pressure falls in a range of from 0.005 MPa to 0.028 MPa. In this case, the fixing fluid 9 can be volatilized in a short time, wherefore a fixed toner image can be dried at once. For example, even if recording media bearing images are put out successively at a throughput rate of 40 pieces/min., it never occurs that, between the recording media produced one after the other, the toner image and the fixing fluid 9 of the recording medium produced earlier are adhered to the one produced later. Note that, if the vapor pressure of the fixing fluid 9 exceeds 0.028 MPa, the fixing fluid 9 is dried so fast that it becomes difficult to apply the fixing fluid 9 to a toner image with stability. Furthermore, the fixing fluid 9 is being volatilized during the course of the application, which results in an undesirable increase in fixing fluid 9 consumption. By using the fixing fluid 9 having a vapor pressure falling within the aforementioned range, it is possible to increase the number of output to be produced from the image forming apparatus 1 per unit of time, as well as to achieve a reduction in fixing fluid 9 consumption and thus a reduction in the number of supply of the fixing fluid 9 to the image forming apparatus 1. Moreover, in the case of disposing a storage tank for storing the fixing fluid 9 within the image forming apparatus 1; the storage tank can be made compact. Further, being prepared as an aqueous solution with a low viscosity, the fixing fluid 9 finds its way smoothly into a toner 8-to-toner 8 interface and the surface of contact between the toner 8 and the intermediary transfer belt 21. That is, the component for swelling and softening the toner 8 is allowed to reach swiftly to the toner 8-to-toner 8 interface and the surface of contact between the toner 8 and the intermediary transfer belt 21, and at the same instant the toner 8 can be swollen and softened. In addition, since the intermediary transfer belt 21 is heated by the heating section 26, the fixing fluid 9 applied to the toner image borne on the intermediary transfer belt 21 can be dried in a short time following the completion of the swelling and softening of the toner 8 constituting the toner image.

As the fixing fluid 9, any of liquid components that are able to swell and soften the binder resin, the mold releasing agent, and other additive contained in the toner 8 can be used. In particular, the use of an admixture of water and one kind or two kinds or more of organic solvent is desirable. As the organic solvent, the one which is able to swell and soften the binder resin, the mold releasing agent, and so forth and is dissoluble or dispersible in water can be used. The examples thereof include: alcohol group-components such as methyl alcohol, ethyl alcohol, propyl alcohol, butyl alcohol, octyl alcohol, decyl alcohol, diethylene glycol, glycerin, polyethylene glycol, phenol, benzyl alcohol, and methyl benzyl alcohol; ketone group-components such as acetone, methyl ethyl ketone, methyl butyl ketone, methyl isobutyl ketone, and diethyl ketone; ether group-components such as methyl ethyl ether, diethyl ether, methyl butyl ether, methyl isobutyl ether, dimethyl ether, diisopropyl ether, and octyl phenyl ether; and ester group-components such as methyl acetate, ethyl acetate, ethyl oleate, ethyl acrylate, methyl methacrylate, dibutyl succinate, diethyl phthalate, diethyl tartrate, ethyl palmitate, and dioctyl phthalate. Among them, ether group-components and ester group-components are preferably used, and the selection of ester group-components is optimal. Such an organic solvent is excellent at swelling and softening the binder resin contained in the toner 8, typified by polyester. The organic solvent components may be used in a singular manner or in combination of two or more kinds. The content of water in the fixing fluid 9 should preferably fall in a range of from 20% to 95%, by weight, and more preferably in a range of from 30% to 90%, by weight, relative to the total amount of the fixing fluid 9. On the other hand, the content of organic solvent in the fixing fluid 9 should preferably fall in a range of from 5% to 80%, by weight, and more preferably in a range of from 10% to 70%, by weight, relative to the total amount of the fixing fluid 9. The aforementioned ranges of content ratio are ideal for effecting the swelling and softening of the binder resin contained in the toner 8. If the water content is greater than 95% by weight, the effect of swelling and softening the toner 8 produced by the fixing fluid 9 is so low that sufficiently high fixation strength cannot be attained. By contrast, if the water content is less than 20% by weight, the permeability of the fixing fluid 9 with respect to a toner image is so low that, where the recording medium P has transferred thereon an unfixed toner image which is high in toner amount, only the toner portion of the upper part of the toner image can be swollen and softened, and the toner portion of the lower part of the toner image closer to (contacted by) the recording medium P cannot be swollen and softened properly. This makes it impossible to fix the toner image onto the recording medium P with sufficiently high fixation strength. In addition to water and the organic solvent, the fixing fluid 9 may contain a surfactant. For example, the addition of a surfactant makes it possible to keep the organic solvent in a dispersed state in the fixing fluid 9, as well as to enhance the wettability of the fixing fluid 9 with respect to the toner 8. The examples thereof include: negative ion (anionic) surfactants such as higher alcohol sulfuric ester salt such as lauryl sulfate ester sodium salt, higher fatty acid metal salt such as sodium oleate, fatty acid derivative sulfuric ester salt, and phosphoric ester; positive ion (cationic) surfactants such as quaternary ammonium salt and heterocyclic amine; amphoteric ion (nonionic) surfactants such as amino acid ester and amino acid; nonionic surfactants; polyoxyalkylene alkyl ether; and polyoxy ethylene alkyl amine. The surfactant components may be used in a singular manner or in combination of two or more kinds. The fixing fluid 9 may further contain a dispersion aid, for example, a coupling agent such as diethylene glycol, triethylene glycol, polyethylene glycol, monobutyl ether, and diethylene glycol monomethyl ether.

The impregnation control layer 32 formed on the surface of the core metal 31 is made of an elastically deformable material which allows impregnation and retention of the fixing fluid 9 in order to avoid that the fixing fluid 9 provided through the passing holes 31*a* of the core metal 31 is fed in excess amounts to the porous layer 33 formed outwardly of the impregnation control layer 32. Being kept in contact with the core metal 31 for holding and storing the fixing fluid 9, the impregnation control layer 32 is able to receive supply of a sufficient amount of the fixing fluid 9. The impregnation control layer 32 retains the fixing fluid 9 at its internal minute pores. The pores become elastically deformed together with the porous layer 33 in conformity with the surface condition of a target object kept in contact with the coating roller 30. In a case where the object on contact has a relatively smooth surface, the degree of the elastic deformation is low, and thus the amount of the fixing fluid 9 squeezed out of the pores through the elastic deformation is small. That is, the amount of application of the fixing fluid 9 per unit area is small when viewed macroscopically. On the other hand, in a case where the object on contact is a multi-color toner image having large asperities, the degree of the elastic deformation of the pore is high, and thus the amount of the fixing fluid 9 squeezed out of the pores is large. That is, the amount of application of the fixing fluid 9 per unit area is large when viewed macroscopically. In this way, the amount of application of the fixing fluid 9 is adjusted by the impregnation control layer 32. For example, the impregnation control layer 32 may be made of a felt or a rubber material of open-celled foam (sponge). In this embodiment, a 5 mm-thick felt is used. Moreover, in this embodiment, the impregnation control layer 32 is designed to exhibit a Young's modulus (taken as an index of elasticity) of 3 MPa. This value is only 1/100 or below of the Young's modulus of the toner 8. Since the material constituting the impregnation control layer 32, such as a felt and an open-celled rubber (sponge, for instance) has the function of retaining the fixing fluid 9, even if the layer thickness of the porous layer 33 is reduced to keep the amount of the fixing fluid 9 retained thereon small, it is possible to apply a sufficient amount of the fixing fluid 9 to the toner image borne on the intermediary transfer belt 21. Accordingly, by reducing the thickness of the porous layer 33 made of an expensive porous membrane, as well as by forming the inner impregnation control layer 32 of an inexpensive material such as an open-celled rubber or a felt, it is possible to achieve a reduction in cost for producing the coating roller 30.

Through the porous layer 33, the fixing fluid 9 fed from the impregnation control layer 32 is applied to the toner image borne on the toner image bearing surface 21*a* of the intermediary transfer belt 21 in a contact manner. The porous layer 33 includes a multiplicity of minute pores for retaining the fixing fluid 9. A characteristic of the porous layer 33 is that it absorbs the fixing fluid 9 existing in the vicinity of the surface thereof when the amount is large, but emits it when the amount is small. Accordingly, it never occurs that the fixing fluid 9 builds up at the entrance of the nip portion between the coating roller 30 and the intermediary transfer belt 21 that will eventually cause a so-called meniscus phenomenon. As a result, the toner image is free from irregularity caused by the flowing action of the fixing fluid 9, wherefore an image of high quality and high resolution can be produced. There is no particular limitation to the material used to form the porous layer 33 so long as it can be elastically deformed and made to have a porous structure. For example, PTFE, polyurethane, and polyimide can be used. The conditions to be fulfilled by the porous layer 33 such as a material for use, a pore diameter, and a porosity can be selected arbitrarily in accordance with the composition of the fixing fluid 9. In this embodiment, the porous layer 33 is formed of a 50 μm-thick PTFE layer, the pore diameter and the porosity of which are set at 0.5 μm and 80%, respectively. Moreover, in this embodiment, a contact angle of the porous layer 33 with respect to the fixing fluid 9 is set at 65 degrees. Although the pore diameter of the porous layer 33 is not particularly restricted, preferably it is set to fall in a range of from 0.1 μm to 2 μm. If the pore diameter is less than 0.1 μm, the amount of permeation of the fixing fluid 9 becomes so small that that part of the toner image which is high in toner amount cannot be fixed with high fixation strength. By contrast, if the pore diameter is greater than 2 μm, the particles of the toner 8 get caught and stuck firmly in the pore, which results in the occurrence of clogging in the porous layer 33. Moreover, although the porosity of the porous layer 33 is not particularly restricted, preferably it is set to fall in a range of from 60% to 90%. If the porosity is less than 60%, the amount of permeation of the fixing fluid 9, as well as the amount of the fixing fluid 9 to be retained, becomes so small that that part of the toner image which is high in toner amount cannot be fixed with high fixation strength. By contrast, if the porosity is greater than 90%, it becomes difficult to design the porous layer 33 as a shape-recoverable elastically deformable layer. Further, although the layer thickness of the porous layer 33 is not particularly restricted, preferably it is set to fall in a range of from 10 μm to 200 μm. If the layer thickness is less than 10 μm, it becomes difficult to create a desired porous layer 33. By contrast, if the layer thickness is greater than 200 μm, the amount of permeation of the fixing fluid 9 becomes so small that that part of the toner image which is high in toner amount cannot be fixed with high fixation strength. It is preferable that the porous layer 33 is designed to be smaller in contact angle with the fixing fluid 9 than the toner image bearing surface 21*a* of the intermediary transfer belt 21. In this case, upon contact between the porous layer 33 and the intermediary transfer belt 21, the porous layer 33 permits the fixing fluid 9 to be preferentially adhered thereto. This makes it possible to reduce the amount of the fixing fluid 9 which is applied from the porous layer 33 to a non-image portion, namely that part of the surface of the intermediary transfer belt 21 to which no toner is adhered, and thereby achieve a reduction in fixing fluid 9 consumption and thus a reduction in the number of supply of the fixing fluid 9. The difference in contact angle between the porous layer 33 and the intermediary transfer belt 21 should preferably be set at or above 5 degrees. It is also preferable that the porous layer 33 is designed to be larger in contact angle with the fixing fluid 9 than the toner 8. In this case, upon contact between the porous layer 33 and the toner image, the toner image permits the fixing fluid 9 to be preferentially adhered thereto. This makes it possible to apply a sufficient amount of the fixing fluid 9 from the porous layer 33 to the toner image, namely an image portion. As a result, that part of the toner image which is high in per-area toner amount can also be fixed with sufficiently high fixation strength. The difference in contact angle between the porous layer 33 and the toner 8 should preferably be set at or above 10 degrees.

The coating roller 30 has a coating roller gear 34 formed at one lengthwise end thereof. The coating roller gear 34 constitutes, together with the intermediary gear 46 and the driving gear 47 that will be explained later, a rotational driving section for driving the coating roller 30. The coating roller gear 34 is made rotatable in engagement with the intermediary gear 46.

As the coating roller gear 34 is rotated, the coating roller 30 is rotated. It is preferable that the coating roller 30 having the above-described structure is designed to be brought into contact with the intermediary transfer belt 21 lightly under a predetermined press force. In this case, even if a large-area, solid image which is thick with toner enters a region where the intermediary transfer belt 21 and the coating roller 30 make pressure-contact with each other (a fixing fluid nip portion), since a large interval can be secured between the coating roller 30 and the intermediary transfer belt 21, a layer of the fixing fluid 9 on the surface of the coating roller 30 is allowed to pass through the fixing fluid nip portion. As a result, the coating roller 30 is brought into pressure-contact with the intermediary transfer belt 21, with the lamellar fixing fluid 9 lying therebetween. This makes it possible to apply a sufficient amount of the fixing fluid 9 to the toner image. Moreover, it never occurs that the fixing fluid 9 builds up at the entrance of the fixing fluid nip portion that will eventually cause a large meniscus. Accordingly, the fixing fluid 9 can be prevented from flowing greatly under the state that the fixing fluid 9 and the toner image are kept in contact with each other, and thus the toner image is free from irregularity. That is, an image of high quality and high resolution can be produced. By configuring the coating roller 30 as a roller-shaped member, it is possible to create a closed space inside the coating roller 30, and thereby facilitate the retention of the fixing fluid 9. Moreover, the coating roller 30 may be designed in the form of a cartridge. In this case, when the fixing fluid 9 accommodated in the coating roller 30 becomes depleted, the replenishment of the fixing fluid 9 can be effected simply by replacing the coating roller 30 with the new one. Since there is no need to handle the fixing fluid 91*n* liquid form, it never occurs that the image forming apparatus 1 is interiorly contaminated with splashes of the fixing fluid 9.

Although the press force under which the coating roller 30 is brought into contact with the intermediary transfer belt 21 is not particularly restricted so long as the above-described effects can be achieved, preferably it is set to fall in a range of from 0.05 N/cm to 1.0 N/cm in terms of linear pressure. If the press force is less than 0.05 N/cm, the contact between the coating roller 30 and the intermediary transfer belt 21 becomes unstable, and thus the fixing fluid 9 cannot be applied evenly to the toner image borne on the intermediary transfer belt 21. Furthermore, the coating roller 30 fails to deform elastically in conformity with the subtle asperities of the intermediary transfer belt 21 and with the asperities of the toner image, wherefore the fixing fluid 9 cannot be applied sufficiently to the concavities of the toner image. This leads to lack of uniformity in the application of the fixing fluid 9 and thus to uneven fixation, which results in unevenness in glossiness and coloration in a resultant image. By contrast, if the press force is greater than 1.0 N/cm, the fixing fluid 9 on the surface of the coating roller 30 is inhibited from passing through the fixing fluid nip portion while the coating roller 30 and the intermediary transfer belt 21 are being rotated in a pressure-contact state. Therefore, the fixing fluid 9 is squeezed into meniscus at the entrance of the fixing fluid nip portion, and an excess of the fixing fluid 9 flows back toward the upstream side in the direction in which the coating roller 30 is rotated. As a result, the fixing fluid 9 flows violently at the entrance of the fixing fluid nip portion, which results in the occurrence of irregularity in the toner image. In this embodiment, the press force under which the coating roller 30 is brought into contact with the intermediary transfer belt 21 is set at 0.1 N/cm, and the coating roller 30 is driven to rotate following the rotation of the intermediary transfer belt 21.

Moreover, being made of an elastic material, the surface of the coating roller 30 is elastically deformable in conformity with the asperities of the toner image. Therefore, in the region where the toner image is present, the coating roller 30 is brought into pressure-contact with the toner image, with the lamellar fixing fluid 9 lying therebetween. This allows, even if the amount of toner varies from part to part, the fixing fluid 9 to be applied evenly to both the high-level part and the low-level part of the toner image. That is, even a multi-color toner image in which the amount of toner varies greatly from part to part can be fixed uniformly, wherefore a high-quality image can be produced. It is preferable that the coating roller 30 is made smaller in elasticity modulus than the toner 8. Specifically, the elasticity modulus of the coating roller 30 should preferably be equal to or less than 1/10 (particularly desirably 1/100) of that of the toner 8. Note that, in a multi-color toner image obtained by superimposing toner images of two or more colors, portions of high toner amount and portions of low toner amount are involved with one another as if to form a fine distribution, and that the multi-color toner image bears a larger amount of toner as a whole. For example, when a comparison is made between a portion of low density in a monochromatic toner image and a portion of high density in a multi-color toner image obtained by superimposing toner images of three colors, in some cases, the thickness (level) of the toner layer of the portion of high density in the multi-color toner image is three times or more larger than that of the portion of low density in the monochromatic toner image. In view of the foregoing, in order to apply the fixing fluid 9 in adequate amounts in accordance with the amount of toner, it is of particular importance that the elastic coating roller 30 is brought into a contact state under a predetermined press force.

Figure 4:
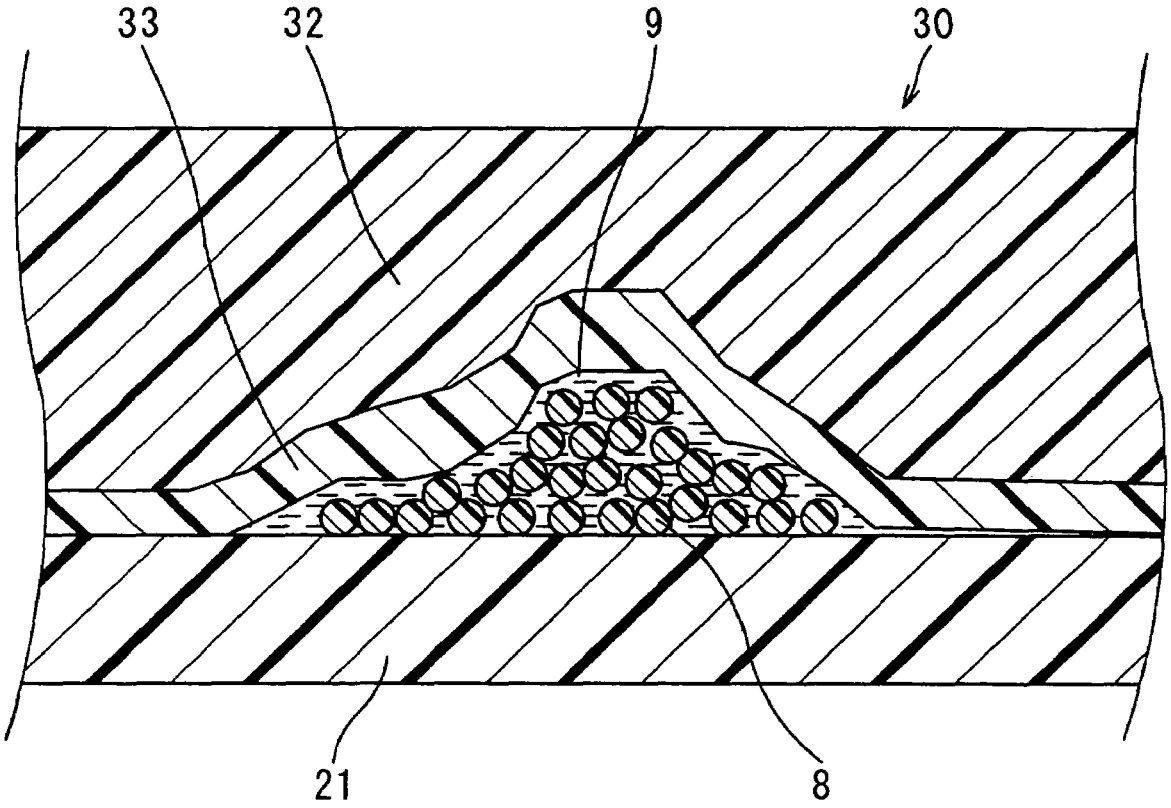
FIG. 4 is a view schematically illustrating how a fixing fluid is applied to a toner image borne on an intermediary transfer belt by a coating roller.

FIG. 4 is a view schematically illustrating how the fixing fluid 9 is applied to the toner image borne on the intermediary transfer belt 21 by the coating roller 30. At the instant when the coating roller 30 makes contact with the toner image (image portion) borne on the intermediary transfer belt 21, the impregnation control layer 32 and the porous layer 33 of the coating roller 30 are elastically deformed to eventually cave in. The toner image, namely the aggregation of the toner 8, has many crevices and is thus large in surface area per unit area when viewed macroscopically. Therefore, at this time, a large amount of the fixing fluid 9 exudes from the impregnation control layer 32 to the toner image, and the crevices around the toner particles 8 are filled with the fixing fluid 9. In this way, the toner particles 8 are swollen and softened. Herein "area viewed macroscopically" of "surface area per unit area when viewed macroscopically" means a section per unit area in which no thought is taken for asperities of the surface, and "surface area" of "surface area per unit area when viewed macroscopically" means a surface area in which asperities observed microscopically are taken into account. On the other hand, in the smooth surface region of the intermediary transfer belt 21 bearing no toner image (non-image portion), neither the impregnation control layer 32 nor the porous layer 33 undergoes elastic deformation. Moreover, the non-image portion is small in surface area per unit area when viewed macroscopically, wherefore a less amount of the fixing fluid 9 exudes thereto from the impregnation control layer 32. That is, the fixing fluid 9 is applied selectively to the image portion. This makes it possible to avoid that the intermediary transfer belt 21 is contaminated with the fixing fluid 9, as well as to achieve a reduction in fixing fluid 9 consumption. Moreover, that part of the toner image which has toner lamination, namely the part which is high in per-area toner amount, is larger in surface area per unit area, and thus receives application of a larger amount of the fixing fluid 9. In this way, the amount of application of the fixing fluid 9 can be controlled on the basis of per-area toner amount, wherefore the application amount of the fixing fluid 9 varies between the image portion and the non-image portion. The elastically deformable porous layer 33 retains the fixing fluid 9, and the surface of the coating roller 30 becomes deformed in conformity with the asperities of the toner image. This allows, even if the amount of toner varies from part to part, the fixing fluid 9 to be applied to the low-level part of the toner image properly. That is, even a multi-color toner image in which the amount of adherent toner varies greatly from part to part can be fixed uniformly, wherefore a high-quality image can be produced. Moreover, as the impregnation control layer 32 and the porous layer 33 undergo elastic deformation, the fixing fluid 9 is squeezed out of the pores. In a case where the smooth surface region of the intermediary transfer belt 21 has adherent toner in part, that part of the porous layer 33 which makes contact with the adherent toner becomes deformed locally. This makes it possible to apply a larger amount of the fixing fluid 9 to the surface region onto which the toner is adhered, namely the toner image-present surface region. Further, since the coating roller 30 and the toner image makes contact with each other with the fixing fluid 9 lying therebetween, it is possible to avoid easy, direct contact of the toner image with the coating roller 30, and thereby avoid the adhesion of the toner to the coating roller 30.

The fixing fluid storage chamber 35 is constructed of a tank-shaped member having the opening 35*c* formed on a side surface 35*b* thereof that faces the intermediary transfer belt 21. The coating roller 30 is housed in the fixing fluid storage chamber 35 in such away as to be rotatably supported. Moreover, the fixing fluid storage chamber 35 has pivots 36 and 37 formed at both lengthwise ends in the vicinity of the perpendicularly upper part of the side surface 35*b*. The pivots 36 and 37 are inserted slidably into the U-shaped guide grooves 39 and 40 formed on a side surface of the open/close gate 38 that confronts the fixing fluid storage chamber 35. As the pivot 36, 37 slides along the guide groove 39, 40, the fixing fluid storage chamber 35 is moved in a direction indicated by arrow 49, whereupon the coating roller 30 is brought into a substantially detached state to move to a working position such as to make contact with the intermediary transfer belt 21. When the pivot 36, 37 is located at the front end of the guide groove 39, 40, the coating roller 30 is in a position to make contact with the intermediary transfer belt 21. The fixing fluid storage chamber 35 is designed in the form of a detachable/attachable cartridge. When the fixing fluid accommodated inside the coating roller 30 had run out, the depletion is detected by a non-illustrated sensor, and the result of detection is inputted to the control unit 140. In response to the input, the control unit 140 effects control of a non-illustrated operation panel in a manner so as to display a notice of necessity to replace the fixing fluid storage chamber 35. This constitution makes it possible to minimize the possibility of splash and leakage of the fixing fluid 9 inside the image forming apparatus 1, and thereby avoid that the image forming apparatus 1 is interiorly contaminated with the fixing fluid 9.

The open/close gate 38 is formed on a side surface 1*a* of the image forming apparatus 1 so as to be opened and closed freely in a direction indicated by arrow 51. This helps facilitate the replacement of the fixing fluid storage chamber 35. In the open/close gate 38, as has already been described, the guide grooves 39 and 40 are formed on the side surface thereof facing with the fixing fluid storage chamber 35. Moreover, the press spring 41 has its one end supported by the said side surface. The other end of the press spring 41 is supported by a side surface of the fixing fluid storage chamber 35 that faces the open/close gate 38. Upon the open/close gate 38 being closed, the lower part of the fixing fluid storage chamber 35 is pressed by the press spring 41. At this time, the fixing fluid storage chamber 35 is so supported as to be rotatable about the pivot 36, 37. This allows the coating roller 30 housed inside the fixing fluid storage chamber 35 to be brought into pressure-contact with the intermediary transfer belt 21 under a predetermined press force. The press force required for the contact can be adjusted by making a change to the type of the press spring 41 or otherwise. As the press spring 41, for example, a coil spring, a leaf spring, and a torsion spring can be used. This constitution makes it possible to bring the coating roller 30 into pressure-contact with the intermediary transfer belt 21 under a predetermined light press force.

The eccentric cam 42 serves as a section for allowing the coating roller 30 to come near and move away from the intermediary transfer belt 21. The eccentric cam 42 is so supported as to be driven to rotate about a rotary shaft 42×in a direction indicated by arrow 42*a* (horizontal direction) by a non-illustrated driving section. The eccentric cam 42 is so disposed as to abut against the perpendicularly lower part of the side surface 35*b* of the fixing fluid storage chamber 35 that faces the intermediary transfer belt 21. As the eccentric cam 42 is rotated, the perpendicularly lower part of the fixing fluid storage chamber 35 is moved in a direction indicated by arrow 48, and thereby the coating roller 30 is allowed to come near or move away from the intermediary transfer belt 21. In the state illustrated in FIG. 3, the minor axis portion of the eccentric cam 42 and the side surface 35*b* of the fixing fluid storage chamber 35 confront each other with a spacing secured therebetween, and the coating roller 30 is kept in pressure-contact with the intermediary transfer belt 21. Then, upon a half-turn of the eccentric cam 42 in the direction of arrow 42*a*, the major axis portion of the eccentric cam 42 and the side surface 35*b* confront each other. At this time, the fixing fluid storage chamber 35 is pressed by the eccentric cam 42 to move toward the open/close gate 38. Upon the press action of the eccentric cam 42, the fixing fluid storage chamber 35 is rotated about the pivot 36, 37, and thereby the coating roller 30 is moved away from the intermediary transfer belt 21. In order to control the rotatable drive to the eccentric cam 42, the first thing to do is to detect whether the coating roller 30 is kept in contact with or kept away from the intermediary transfer belt 21 under the present condition. The contact and release detecting section 43, which is composed of a conducting member 44 and a conducting sensor 45, is provided to detect whether the coating roller 30 is kept in contact with or kept away from the intermediary transfer belt 21. The conducting member 44 is constructed of an electrically conductive platy member designed to make contact with the longer side of the eccentric cam 42 when the shorter side of the eccentric cam 42 confronts the side surface 35*b*. The conducting sensor 45 is electrically connected to the rotary shaft 42*x* of the eccentric cam 42 and the conducting member 44, for detecting the presence or absence of electric current passing through the region between the eccentric cam 42 and the conducting member 44. That is, in a case where the minor axis portion of the eccentric cam 42 confronts the side surface 35*b*, the eccentric cam 42 and the fixing fluid storage chamber 35 are kept away from each other, and the coating roller 30 is kept in contact with the intermediary transfer belt 21, then the conducting sensor 45 detects amperage under the state that the major axis portion of the eccentric cam 42 makes contact with the conducting member 44. Moreover, the rotation position of the eccentric cam 42 is determined on the basis of the detected amperage. On the other hand, in a case where the major axis portion of the eccentric cam 42 is kept in contact with the side surface 35*b*, the minor axis portion of the eccentric cam 42 and the conducting member 44 spacedly confront each other, and the coating roller 30 is kept away from the intermediary transfer belt 21, then the conducting sensor 45 does not detect amperage. The result of detection produced by the conducting sensor 45 is inputted to the non-illustrated control unit 140 for controlling all of the workings of the image forming apparatus 1. On the basis of the detection result produced by the conducting sensor 45, the control unit 140 recognizes the status of the coating roller 30 with respect to the intermediary transfer belt 21; that is, whether the coating roller 30 is kept in contact with or kept away from the intermediary transfer belt 21. With the understanding of the status of the coating roller 30 with respect to the intermediary transfer belt 21, the control unit 140 exercises control over the rotatable drive to the eccentric cam 42 in response to the results of detection produced by the temperature detecting section 29, a non-illustrated toner image detecting section, and so forth. As will be explained later on, the temperature detecting section 29 detects the temperature of the intermediary transfer belt 21. Moreover, the toner image detecting section is disposed, in a location upstream from the fixing fluid nip portion in the direction in which the intermediary transfer belt 21 is driven to rotate, in the vicinity of the toner image bearing surface 21*a*. The toner image detecting section detects the presence or absence of a toner image on the toner image bearing surface 21*a*. For example, an optical sensor is used for the toner image detecting section. The control unit 140 is provided with the storage section, the computation (determination) section, and the control section. The storage section receives input about the results of detection produced by the temperature detecting section 29, the non-illustrated toner image detecting section, and so forth, and physical property data such as the boiling point of the main constituent solvent of the fixing fluid 9 and the softening point and the glass transition temperature of the toner 8. In the computation section, a comparison is made between the result of detection inputted to the storage section and the physical property data provided in the storage section in advance. In the control section, in response to the result of computation produced by the computation section, a control signal is transmitted to the non-illustrated driving section for rotatably driving the eccentric cam 42 to adjust, for example, the rotation angle of the eccentric cam 42. For example, when it is determined to increase the amount of application of the fixing fluid 9 on the basis of the physical property data about the toner 8 and the fixing fluid 9 and the result of detection produced by the temperature detecting section 29, then the control unit 140 effects control of the control section in a manner so as to send a control signal to the driving section for driving the eccentric cam 42 to bring the front extremity of the major axis portion of the eccentric cam 42 into contact with the side surface 35*b*. In this way, the rotation angle of the eccentric cam 42 is so adjusted as to intensify the pressure under which the coating roller 30 is brought into contact with the intermediary transfer belt 21. Moreover, in a case where the coating roller 30 is kept away from the intermediary transfer belt 21, and the toner image detecting section detects the presence of a toner image on the intermediary transfer belt 21 in the location upstream from the fixing fluid nip portion in the direction in which the intermediary transfer belt 21 is driven to rotate, then the control unit 140 effects control of the control section in a manner so as to send a control signal to the driving section for driving the eccentric cam 42 to rotate the eccentric cam 42 so that the minor axis portion of the eccentric cam 42 and the side surface 35*b* spacedly confront each other. Further, in a case where the coating roller 30 is kept in contact with the intermediary transfer belt 21, and the toner image detecting section has not detected the presence of a toner image for a predetermined period of time, then the control unit 140 effects control of the control section in a manner so as to rotate the eccentric cam 42 so that the major axis portion of the eccentric cam 42 and the side surface 35*b* confront and make contact with each other.

The intermediary gear 46 and the driving gear 47 constitute, together with the coating roller gear 34 of the coating roller 30, the rotational driving section for driving the coating roller 30 to rotate about its axis. The intermediary gear 46, which is disposed coaxially with the pivot 36, 37, has its one side engaged with the coating roller gear 34, and the other side engaged with the driving gear 47. As the driving gear 47 is rotated, its rotation is transmitted through the intermediary gear 46 to the coating roller gear 34, whereupon the coating roller 30 is rotated. The driving gear 47 is engaged with the intermediary gear 46 and is rotated by a non-illustrated driving section. The pivot 36, 37 disposed coaxially with the intermediary gear 46 acts as a center of rotation of the fixing fluid storage chamber 35. Even if the fixing fluid storage chamber 35 is rotated by the eccentric cam 42, the center-to-center distance among the coating roller gear 34, the intermediary gear 46, and the driving gear 47 remains unchanged. Accordingly, regardless of whether the coating roller 30 is kept in contact with or kept away from the intermediary transfer belt 21, it is possible to drive the coating roller 30 to rotate. In this embodiment, the rotational circumferential velocity of the coating roller 30 being rotated by the rotational driving section is set to be lower than that of the coating roller 30 being rotated in abutment with the intermediary transfer belt 21. Moreover, although not shown in the figure, a one-way clutch may be disposed in the coating roller gear 34. In this case, the coating roller 30 is, when kept in contact with the intermediary transfer belt 21, trailingly rotated at the same rotational circumferential velocity as that of the intermediary transfer belt 21. This helps prevent the occurrence of irregularity in the toner image borne on the intermediary transfer belt 21 resulting from the difference in rotational circumferential velocity between the coating roller 30 and the intermediary transfer belt 21. In this constitution, the coating roller 30 is allowed to move approachably and separably with respect to the intermediary transfer belt 21, and also, regardless of whether the coating roller 30 is kept in contact with or kept away from the intermediary transfer belt 21, the coating roller 30 can be rotated.

In this embodiment, at the time of bringing the coating roller 30 into contact with the intermediary transfer belt 21 under the state that the coating roller 30 is kept away from the intermediary transfer belt 21 and the rotation of the coating roller 30 came to a stop, then it is preferable that the coating roller 30 is started in rotation before making contact with the intermediary transfer belt 21. The number of rotation of the coating roller 30 is set at one, at least, and preferably the rotation of the coating roller 30 is continued for 0.5 to 10 seconds. Inside the coating roller 30, since the fixing fluid 9 is gathered perpendicularly downwardly, that part of the porous layer 33 which lies on the lower surface of the coating roller 30 has a higher content of the fixing fluid 9, whereas that part of the porous layer 33 which lies on the upper surface thereof has a lower content of the fixing fluid 9. If the application of the fixing fluid 9 to a toner image is carried out in this state, there arises a problem of lack of uniformity in the application of the fixing fluid 9 on the intermediary transfer belt 21. This leads to unevenness in glossiness and density in the fixed image and thus to image degradation. In order to avoid this, by giving the coating roller 30 at least one turn before establishing contact between it and the intermediary transfer belt 21, the content of the fixing fluid 9 can be made uniform in the porous layer 33 over the entire surface of the coating roller 30. This makes it possible to prevent the occurrence of lack of uniformity in the application of the fixing fluid 9 on the intermediary transfer belt 21, and thereby produce a high-quality image free from irregularity. Note that, although such an objective can be attained by giving the coating roller 30 at least a half-turn, with a view toward still further uniformity, it is desirable to give the coating roller 30 one or more turns. The coating roller 30 is rotated under the control of the non-illustrated control unit 140. For example, at a command to start image formation issued to the control unit 140 from the non-illustrated operation panel disposed on the upper surface of the image forming apparatus 1, the control unit 140 determines at first whether the coating roller 30 is kept in contact with or kept away from the intermediary transfer belt 21 on the basis of the result of detection produced by the contact and release detecting section 43. When it is found that the coating roller 30 is kept away from the intermediary transfer belt 21, then the control unit 140 exercises control so as to issue a control signal to the non-illustrated driving section for rotatably driving the driving gear 47 to rotate the driving gear 47. In accompaniment with the rotation of the driving gear 47, the coating roller 30 is rotated. After that, under the control of the control unit 140, the eccentric cam 42 is rotated to bring the coating roller 30 into contact with the intermediary transfer belt 21.

In this embodiment, it is preferable that, even if the coating roller 30 is kept away from the intermediary transfer belt 21, the coating roller 30 is driven to rotate during the interval when the intermediary transfer belt 21 is being heated by the heating section 26 disposed inside the supporting roller 23. The coating roller 30 is rotated under the control of the control unit 140. The control unit 140 is able to recognize that the heating section 26 is in action because it issues a control signal thereto to effect an heating operation. The control unit 140 is also able to recognize that the coating roller 30 is kept away from the intermediary transfer belt 21 on the basis of the result of detection produced by the contact and release detecting section 43. In this case, as the driving gear 47 is rotated under the control of the control unit 140, the coating roller 30 can be rotated. With this constitution, it is possible to avoid that only that part of the surface of the coating roller 30 which faces the intermediary transfer belt 21 is heated through the radiation of heat from the intermediary transfer belt 21 and thus that this part undergoes a significant reduction in the content of the fixing fluid 9 in contrast to the other part. In consequence, a high-quality image can be produced with stability. Moreover, since the degree of the heating effect produced through the radiation of heat from the intermediary transfer belt 21 is not so high, with this constitution, it is possible to eliminate the occurrence of local variation in the content of the fixing fluid 9 over the surface of the coating roller 30. Note that, if the surface of the coating roller 30 undergoes a significant reduction in the content of the fixing fluid 9 in part, the ensuing variation of the content of the fixing fluid 9 cannot be got rid of even if the coating roller 30 is rotated before establishing contact between it and the intermediary transfer belt 21 as has already been explained. This leads to lack of uniformity in the application of the fixing fluid 9 and thus to unevenness in density and glossiness in the fixed image, which results in image degradation.

In this embodiment, it is preferable that the coating roller 30 is driven to rotate under the conditions that the coating roller 30 is kept away from the intermediary transfer belt 21, that the intermediary transfer belt 21 is kept heated by the heating section 26 disposed inside the supporting roller 23, and that the fixing fluid 9 contains two or more kinds of organic solvents. At this time, on the basis of the results of the temperature detecting section 29 and the contact and release detecting section 43, the control unit 140 exercises control so as to drive the coating roller 30 to rotate. For example, when the contact and release detecting section 43 detects that the coating roller 30 is kept away from the intermediary transfer belt 21 and the temperature detecting section 29 detects that the temperature of the intermediary transfer belt 21 is higher than, of the boiling points of the two or more kinds of organic solvents contained in the fixing fluid 9, the lowest boiling point, then the control unit 140 exercises control so as to issue a control signal to the non-illustrated driving section for rotatably driving the driving gear 47 to rotate the driving gear 47 and thus to rotate the coating roller 30. With this constitution, where the fixing fluid 9 contains two or more kinds of organic solvents, it is possible to avoid that the fixing fluid 9 undergoes a change in composition because of the volatilization of one kind of organic solvent resulting from the radiation of heat from the intermediary transfer belt 21, and thereby prevent the occurrence of improper fixation, a decline in image density, a degradation in image quality, and the like problems. It is also possible to avoid that the content of the fixing fluid 9 is locally varied on the surface of the coating roller 30 because of the volatilization of the organic solvent contained in the fixing fluid 9. That is, it never occurs that the application of the fixing fluid 9 is carried out by such a coating roller 30 as suffers from local variation in the content of the fixing fluid 9 that will eventually cause lack of uniformity in the application of the fixing fluid 9 and thus occurrence of image irregularity.

According to the fixing fluid applying section 4, only in the case of effecting image formation, the coating roller 30 is brought into contact with the intermediary transfer belt 21 after making at least one turn, and thereby the fixing fluid 9 is applied to the toner image borne on the intermediary transfer belt 21 in a contact manner. In this way, the toner 8 constituting the toner image is swollen and softened. At this time, the intermediary transfer belt 21 is heated by the heating section 26 disposed inside the supporting roller 23 to a temperature of a level where high power consumption is not involved, for example, approximately 100° C. This helps facilitate the swelling and softening of the toner achieved by the fixing fluid 9. When no image formation is carried out, the coating roller 30 is moved away from the intermediary transfer belt 21. In this state, the coating roller 30 is rotated on an as needed basis to avoid uneven distribution of the fixing fluid 9 on the surface of the coating roller 30. This helps prevent lack of uniformity in the application of the fixing fluid 9 and the ensuing problems at the next application step. Moreover, following the application of the fixing fluid 9, the toner image kept in a swollen/softened state on the intermediary transfer belt 21 is conveyed toward the transferring and fixing section 5 as the intermediary transfer belt 21 is driven to rotate. The transferring and fixing section 5 is composed of the supporting roller 24 and a transferring and fixing roller 55.

The transferring and fixing roller 55 is constructed of a roller-shaped member acting mainly as a pressurizing roller. The transferring and fixing roller 55 is brought into pressure-contact with the supporting roller 24, with the intermediary transfer belt 21 lying therebetween, and is made rotatable about its axis. As the transferring and fixing roller 55, those used customarily in this field can be used. In this embodiment, the transferring and fixing roller 55 is constructed of a roller-shaped member which is 30 mm in outer diameter and comprises a core bar, a 3 mm-thick silicon rubber layer having a hardness of 50 degrees (according to JIS-A) formed as an elastic layer on the surface of the core bar, and a 20 μm-thick PFA layer formed as an outer layer on the surface of the silicon rubber layer. Moreover, in this embodiment, the transferring and fixing roller 55 is brought into pressure-contact with the supporting roller 24 under a linear pressure of 8 N/cm, with the intermediary transfer belt 21 lying therebetween. Note that no electric charge is applied thereto. Upon the toner image kept in a swollen/softened state being conveyed to the location where the supporting roller 24 and the transferring and fixing roller 55 make contact with each other under pressure (a transfer-fixation nip portion), in synchronism therewith, the recording medium P is fed from the subsequently-described recording medium supply section 6. Thence, the toner image borne on the intermediary transfer belt 21 is pressed against and fixed to a surface of the recording medium P. In a case where the intermediary transfer belt 21 has its surface coated with a fluorine resin layer, the level of adhesion between the intermediary transfer belt 21 and the toner image is low. Therefore, the toner image, substantially in its entirety, is transferred onto the recording medium P. Moreover, in a case where the intermediary transfer belt 21 includes a rubber layer, the toner image bearing surface 21*a* becomes deformed in conformity with the asperities of the recording medium P, wherefore the toner image can be brought into contact even with the concavities of the recording medium P. This makes it possible to obtain a uniformly transferred/fixed image. Further, in a case where the recording medium P contains cellulose fibers, upon the toner image being pressed against the recording medium P, it is forced into the cellulose fibers and simultaneously the particles of the toner 8 fuse with one another, thereby leveling off the surface of the toner image on the recording medium P. Accordingly, by virtue of the subtractive color mixing effect and the surface smoothness, there is obtained a high-quality color image that is excellent in coloration and glossiness. Moreover, the intermediary transfer belt 21 is made of a material which is impervious to the fixing fluid 9, and the fixing fluid 9 is applied only to the toner image in substantially a selective manner. This makes it possible to prevent the fixing fluid 9 from finding its way into the recording medium P and thereby avoid generation of wrinkles, curls, or the like in the recording medium P, as well as to achieve a reduction in fixing fluid 9 consumption. Further, in this constitution, the coating roller 30 for applying the fixing fluid 9 makes no direct contact with the recording medium P. Accordingly, even if the recording medium P contains cellulose fibers, the surface of the coating roller 30 is free of adhesion of paper powder such as the cellulose fibers, wherefore no clogging occurs. That is, since lack of uniformity in the application of the fixing fluid 9 resulting from clogging can be prevented, it follows that high-quality images can be produced with stability for a longer period of time. According to the transferring and fixing section 5, the toner image kept in a swollen/softened state is transferred and fixed onto the recording medium P under a press force.

The recording medium supply section 6 is composed of a recording medium cassette 56 for stocking the recording media P, a pick-up roller 57 for directing the recording media P to a conveyance path one by one, and a pair of resist rollers 58 and 59 for feeding the recording medium P to the transfer-fixation nip portion in synchronism with the conveyance of the toner image borne on the intermediary transfer belt 21 toward the nip portion. According to the recording medium supply section 6, the recording media P placed within the recording medium cassette 56 are directed to the conveyance path one by one by the pick-up roller 57, and are then fed to the transfer-fixation nip portion by the resist rollers 58 and 59.

The ejection section 7 is composed of a conveyance belt 60, a driving roller 61, a tension roller 62, and a paper ejecting roller 63. The conveyance belt 60 is designed as an endless belt stretched across the driving roller 61 and the tension roller 62, for forming a loop-like conveyance path. The conveyance belt 60 conveys the recording medium P bearing an image formed by the transferring and fixing section 5 toward the paper ejecting roller 63. For example, the conveyance belt 60 may be constituted by forming a 10 μm-thick cover layer made of PTFE on at least a recording medium conveying surface of a 100 μm-thick polyimide film to which a conducting agent is added to impart electrical conductivity. The driving roller 61 is driven to rotate freely about its axis by a non-illustrated driving section. For example, the driving roller 61 may be composed of a hollow roller made of a metal material such as aluminum. The tension roller 62 imparts a tension of predetermined level to the conveyance belt 60 to prevent it from sagging down. For example, the tension roller 62 may be composed of a metal-made shaft body having its surface coated with a cover layer, or may be composed solely of a metal-made shaft body. For example, stainless steel is used to form the metal-made shaft body, and fluorine rubber is used to form the cover layer. The paper ejecting roller 63 serves to drop the recording medium P conveyed by the conveyance belt 60 into a paper output tray 64 disposed on an outer side surface of the image forming apparatus 1. The paper ejecting roller 63 is composed of a pair of rollers that are brought into pressure-contact with other, each of which is so supported as to be rotatable about its axis.

According to the image forming apparatus 1, a toner image is formed on the intermediary transfer belt 21, namely the toner image carrier, by the toner image forming section 2. Then, the fixing fluid 9 is applied to the toner image in a contact manner by the fixing fluid applying section 4, whereupon the toner image is swollen and softened. The toner image is then transferred and fixed onto the recording medium P by the transferring and fixing section 5. Lastly, the recording medium P bearing the image thus obtained is ejected onto the paper output tray 64. In this embodiment, inside the coating roller 30 is provided the fixing fluid storage layer, and the coating roller 30 in itself is designed in the form of a cartridge. The replenishment of the fixing fluid 9 is effected by replacing the coating roller 30 with the new one. However, the invention is not limited thereto. For example, although not shown in the drawings, it is also possible to provide, inside the image forming apparatus 1, a fixing fluid storage tank and a fixing fluid supply section for supplying the fixing fluid 9 from the fixing fluid storage tank to the coating roller 30. In this case, depending on how the fixing fluid 9 is consumed, the fixing fluid supply section operates to supply the fixing fluid 9 from the fixing fluid storage tank to the coating roller 30 until it reaches a predetermined fluid level in the coating roller 30. For example, the fixing fluid supply section is composed of non-illustrated piping for providing connection between the coating roller 30 and the fixing fluid storage tank and a non-illustrated fluid-feeding pump disposed above the piping. By providing the section for storing the fixing fluid 9 externally of the coating roller 30 in that way, it is possible to store a great amount of the fixing fluid 9, and thereby reduce the number of supply of the fixing fluid 9.

Figure 5:
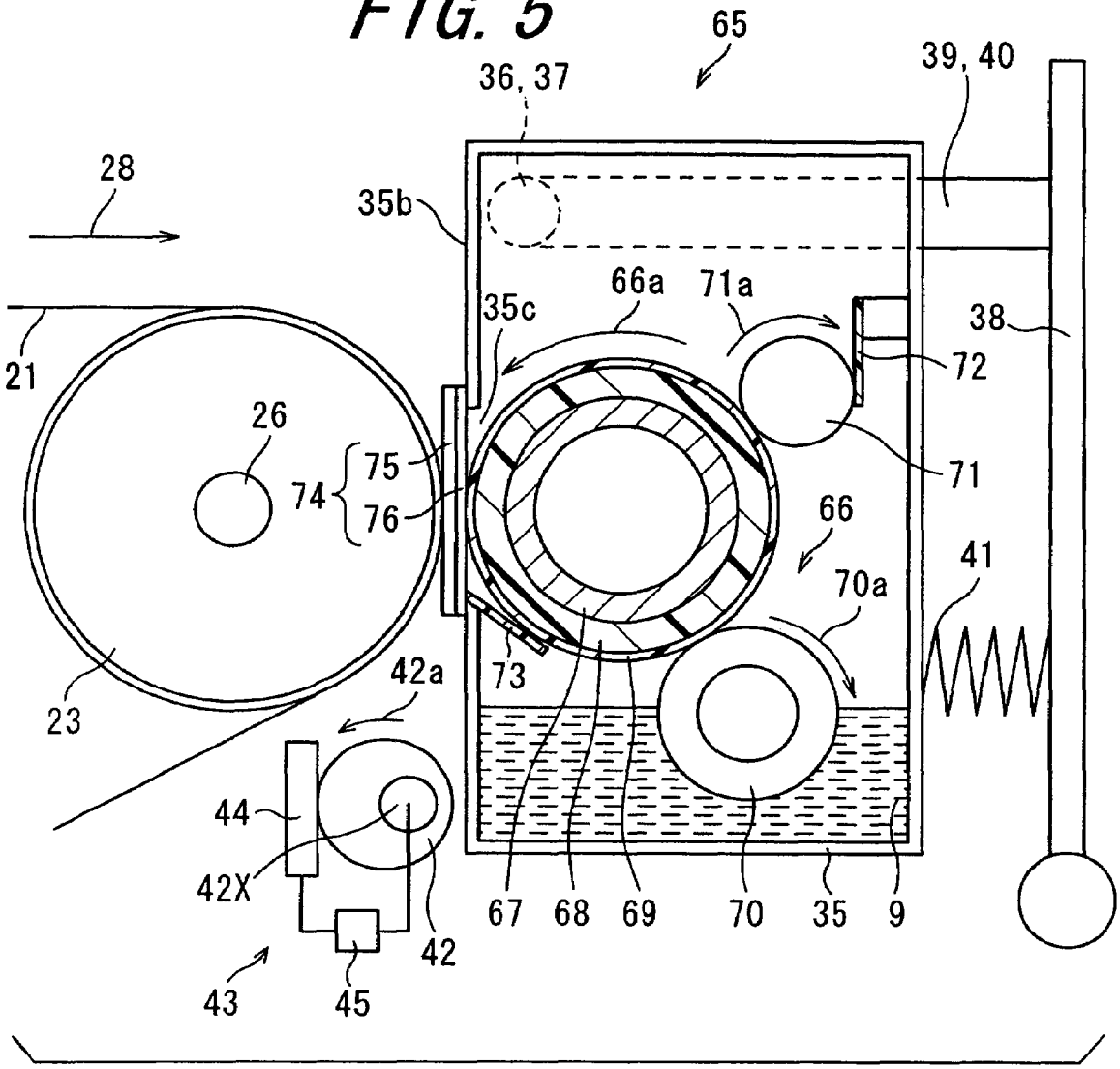
FIG. 5 is a sectional view schematically showing the constitution of differently-configured fixing fluid applying section.
Figure 6:
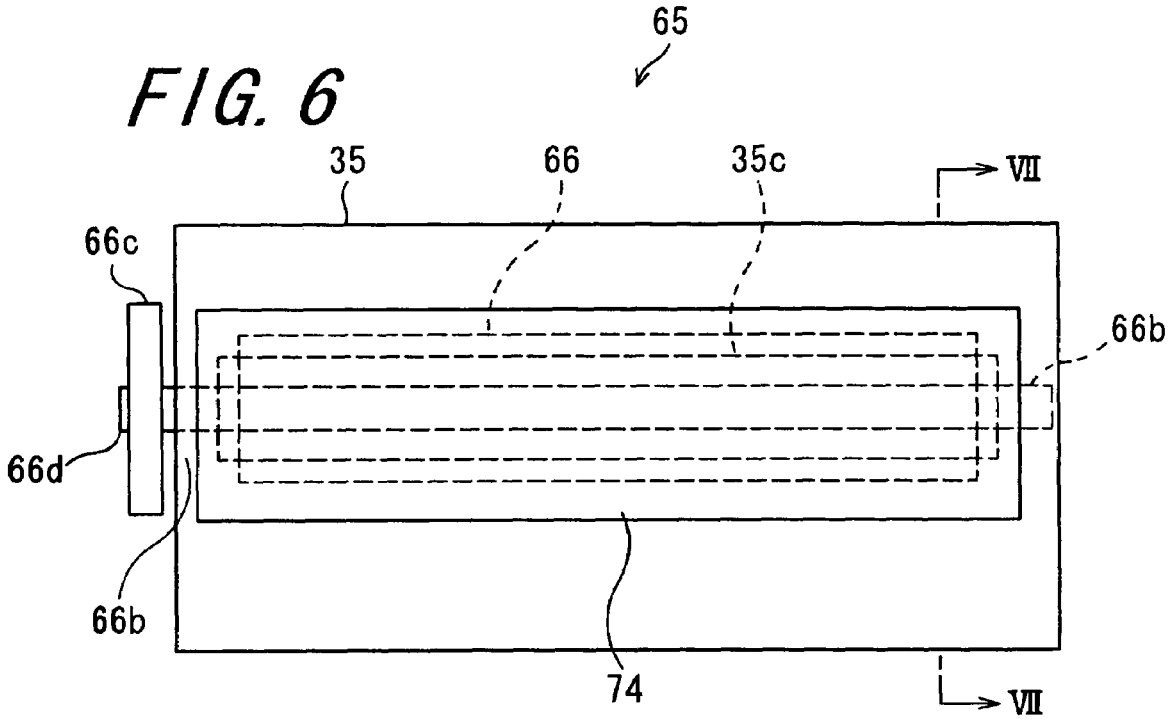
FIG. 6 is a front view of the fixing fluid applying section depicted in FIG. 5, as viewed in the direction of the intermediary transfer belt.
Figure 7:
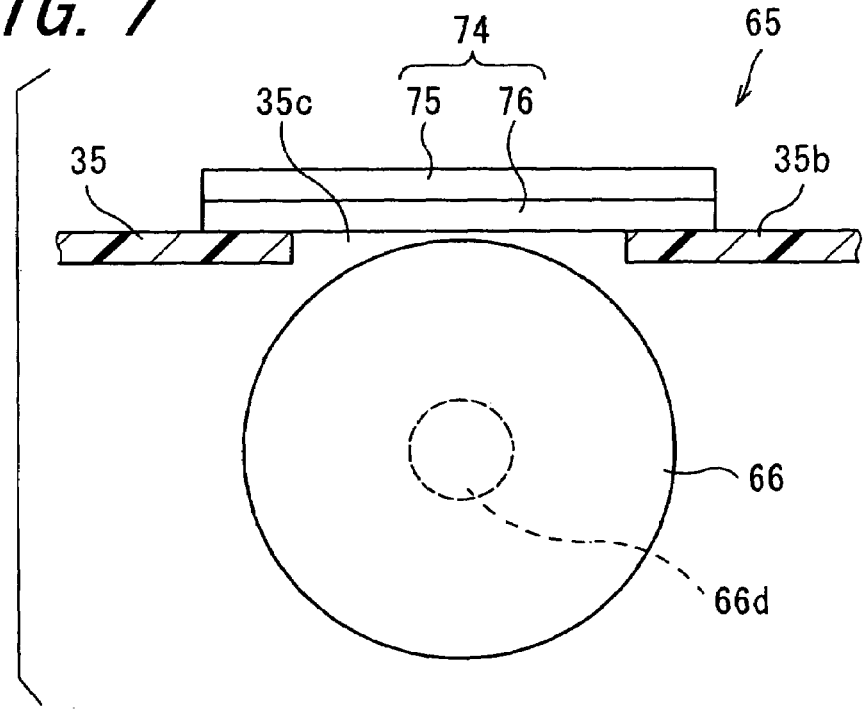
FIG. 7 is a sectional view of the fixing fluid applying section taken along the line VII-VII of FIG. 6.
Figure 8:
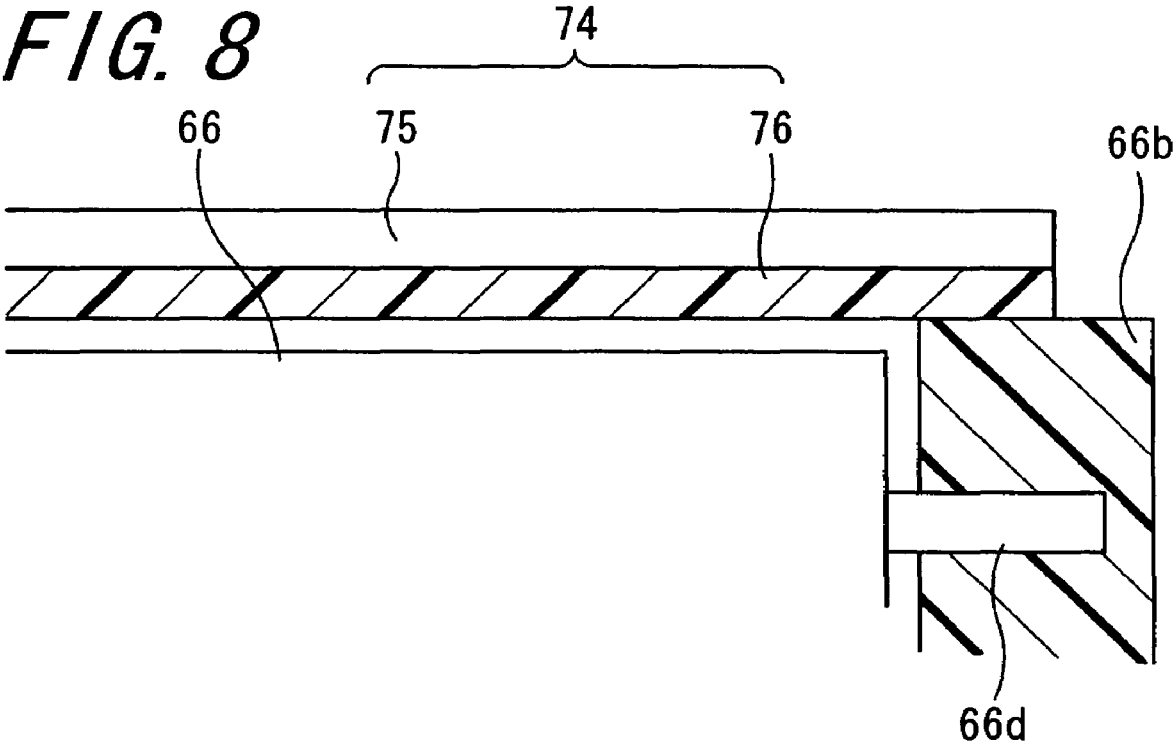
FIG. 8 is a partial sectional view of the fixing fluid applying section depicted in FIG. 6, as viewed in a direction longitudinally thereof.

While this embodiment employs the fixing fluid applying section 4 such as shown in FIG. 3, the fixing fluid applying section 4 is not limited to the configuration as suggested herein but may be of another configuration. FIG. 5 is a sectional view schematically showing the constitution of differently-configured fixing fluid applying section 65. FIG. 6 is a front view of the fixing fluid applying section 65, as viewed in the direction of the intermediary transfer belt 21. FIG. 7 is a sectional view of the fixing fluid applying section 65 taken along the line VII-VII of FIG. 6. Note that, in FIG. 7, a core metal, a fixing fluid retaining layer, and a porous layer constituting a coating roller 66 and part of the side wall of the fixing fluid storage chamber 35 are omitted. FIG. 8 is a partial sectional view of the fixing fluid applying section 65 depicted in FIG. 6, as viewed in a direction longitudinally thereof. The fixing fluid applying section 65 is analogous to the fixing fluid applying section 4, and therefore the constituent components that play the same or corresponding roles as in the fixing fluid applying section 4 will be identified with the same reference symbols, and overlapping descriptions will be omitted. The fixing fluid applying section 65 is composed of the coating roller 66, a supply roller 70, a regulatory roller 71, a first seal member 72, a second seal member 73, a heat-insulating protection member 74, the fixing fluid storage chamber 35, the pivot 36, 37, the open/close gate 38, the guide groove 39, 40, the press spring 41, the eccentric cam 42, and the contact and release detecting section 43.

The coating roller 66 is constructed of a roller-shaped member designed to move approachably and separably with respect to the intermediary transfer belt 21. Part of the coating roller 66 confronts the toner image bearing surface 21*a* of the intermediary transfer belt 21 through the opening 35*c* created on the side surface 35*b* of the fixing fluid storage chamber 35 that faces the intermediary transfer belt 21. The fixing fluid 9 is applied to the toner image borne on the toner image bearing surface 21*a* of the intermediary transfer belt 21 by the coating roller 66. Moreover, the coating roller 66 has a rotary shaft 66*d* formed integrally with non-illustrated flanges disposed at both lengthwise ends of a core metal 67. Both ends of the rotary shaft 66*d* are supported by a bearing portion 66*b* formed interiorly of and integrally with the fixing fluid storage chamber 35. In this way, the coating roller 66 is so supported as to be driven to rotate in a direction indicated by arrow 66*a* by the fixing fluid storage chamber 35. Moreover, the rotary shaft 66*d* of the coating roller 66 has its one end made to protrude outwardly through the bearing portion 66*b* in a direction longitudinally of the fixing fluid storage chamber 35. At the end is disposed, just as is the case with the coating roller 30, a coating roller gear 66*c* which is engaged with a non-illustrated intermediary gear. The intermediary gear is engaged with a non-illustrated driving gear. The coating roller gear 66*c*, the intermediary gear, and the driving gear constitute, together with a non-illustrated driving section for rotatably supporting the driving gear, rotatably driving section for driving the coating roller 66 to rotate about its axis. The coating roller 66 is composed of the core metal 67, a fixing fluid retaining layer 68 formed on the surface of the core metal 67, and a porous layer 69 formed on the surface of the fixing fluid retaining layer 68. As the core metal 67, those used customarily in this field can be used, for example, a core bar produced by using a metal material such as stainless steel and aluminum. This embodiment employs an aluminum-made core bar having an outer diameter of 14 mm. The fixing fluid retaining layer 68 is designed as follows. The fixing fluid 9 supplied from the supply roller 70 is fed through the porous layer 69 to the fixing fluid retaining layer 68. The fixing fluid 9 retained in the fixing fluid retaining layer 68 is fed to the porous layer 69 as the amount of the fixing fluid 9 existing in the porous layer 69 is decreased. In general, the fixing fluid retaining layer 68 is made of a material having a high fixing fluid retention ability. Therefore, even if the porous layer 69 is made small in layer thickness and thus has a poor fixing fluid retention ability, a sufficient amount of the fixing fluid 9 can be retained in the fixing fluid retaining layer 68. As the fixing fluid retaining layer 68, an elastic, liquid-absorptive material such as a felt and an open-celled rubber is used. By providing the fixing fluid retaining layer 68, even if the amount of the fixing fluid 9 to be retained in the porous layer 69 is low, it is possible to secure a sufficient amount of the fixing fluid 9 in the coating roller 66 as a whole, and thereby apply the fixing fluid 9 to the toner image borne on the intermediary transfer belt 21 sufficiently. This makes it possible to, as will be explained later, form the porous layer 69 of a thin porous membrane. That is, it is possible to use an expensive, fine porous membrane only for the thin outer layer, so that the inner layer can be made of an inexpensive material such as a felt and an open-celled rubber. The porous layer 69 has contained therein a multiplicity of minute pores for retaining part of the fixing fluid 9 supplied from the supply roller 70. An excess of the fixing fluid 9 is fed to the fixing fluid retaining layer 68. The fixing fluid 9 retained in the porous layer 69 is applied to the toner image borne on the intermediary transfer belt 21 at a fixing fluid nip portion lying between the coating roller 66 and the intermediary transfer belt 21. The coating roller 66 employed in this embodiment is constituted as follows. At first, a 3 mm-thick felt layer (elasticity modulus: 3 MPa) is formed on the surface of the 14 mm-outer-diameter core metal 67 as the fixing fluid retaining layer 68 to obtain a roller having an outer diameter of 20 mm. Then, on the surface of the felt layer is laminated a 0.1 mm-thick porous membrane made of urethane resin as the porous layer 69. Moreover, in this embodiment, at the time of bringing the coating roller 66 into contact with the intermediary transfer belt 21, the press force by which the contact is established stands at 0.5 N/cm in terms of linear pressure. Further, in this embodiment, when the coating roller 66 is brought into contact with the intermediary transfer belt 21, the coating roller 66 is rotated at the same velocity as the surface velocity of the intermediary transfer belt 21.

The supply roller 70 has its one part immersed in the fixing fluid 9 stored in the lower part of the inner space in the fixing fluid storage chamber 35, and the other part kept in pressure-contact with the coating roller 66. The supply roller 70 is constructed of a roller-shaped member designed to be driven to rotate in a direction indicated by arrow 70*a* by a non-illustrated driving section. As the supply roller 70 is rotated, the fixing fluid 9 is adhered to its surface, and the adherent fixing fluid 9 is fed to the surface of the coating roller 66 at the location where the supply roller 70 and the coating roller 66 make contact with each other under pressure. In this constitution, the fixing fluid 9 is fed to the outer peripheral surface of the coating roller 66. This eliminates the need for the fixing fluid 9 to be accommodated within the coating roller 66, wherefore the coating roller 66 can be made compact. For example, the supply roller 70 may be composed of a roller member constituted by laminating a resin foam layer on a surface of a core bar. This embodiment employs a sponge roller constituted by laminating a 5 mm-thick, open-celled urethane resin foam layer on a surface of a 10 mm-diameter core bar. Moreover, while this embodiment is so designed that the fixing fluid 9 is supplied to the coating roller 66 by the supply roller 70, the supply roller 70 does not necessarily have to be disposed. In this case, the coating roller 66 may be so designed that part of it is constantly immersed in the fixing fluid 9 to receive the supply of the fixing fluid 9 directly on its own. In the absence of the supply roller 70, the constitution can be simplified and thus the cost of manufacturing can be reduced. The regulatory roller 71, which is brought into pressure-contact with the coating roller 66, is made rotatable in a direction indicated by arrow 71*a*. The regulatory roller 71 is constructed of a roller member designed to properly adjust the amount of the fixing fluid 9 to be retained in the porous layer 69 constituting the outer layer of the coating roller 66. For example, a metal-made roller is used for the regulatory roller 71. This embodiment employs a stainless steel-made roller having an outer diameter of 12 mm as the regulatory roller 71. By virtue of the regulatory roller 71, the fixing fluid 9 can be prevented from adhering excessively to the surface of the coating roller 66. Accordingly, it never occurs that the fixing fluid 9 builds up at the entrance of the fixing fluid nip portion lying between the coating roller 66 and the intermediary transfer belt 21 that will eventually cause a meniscus. As a result, the toner image is free from irregularity caused by the flowing action of the fixing fluid 9, wherefore an image of high quality and high resolution can be produced.

The first seal member 72 is constructed of a platy member designed to have its one end kept in pressure-contact with the surface of the regulatory roller 71, and the other end supported by the fixing fluid storage chamber 35. The fixing fluid 9 on the surface of the regulatory roller 71 is collected by the first seal member 72. Specifically, the fixing fluid 9 removed from the surface of the regulatory roller 71 by the first seal member 72 travels along the first seal member 72 to drop into a fixing fluid storage portion located in the lower part of the fixing fluid storage chamber 35. In this embodiment, a 40 μm-thick urethane rubber sheet is used for the first seal member 72. The second seal member 73 is constructed of a platy member designed to have its one end kept in pressure-contact with the surface of the coating roller 66, and the other end supported by the fixing fluid storage chamber 35. The fixing fluid 9 on the surface of the coating roller 66 is scraped off by the second seal member 73, and the gathered fixing fluid 9 is dropped into the fixing fluid storage portion located in the lower part of the fixing fluid storage chamber 35, whereupon the collection of the fixing fluid 9 is achieved. That is, the first and second seal members 72 and 73 function about the same. In this embodiment, a 40 μm-thick urethane rubber sheet is used also for the second seal member 73. The first and second seal members 72 and 73, in conjunction with the coating roller 66 and the regulatory roller 71, create closed space inside the fixing fluid storage chamber 35. This helps prevent the volatilization of the fixing fluid 9, the leakage of the volatilized fixing fluid 9 to outside of the fixing fluid storage chamber 35, and so forth.

The heat-insulating protection member 74 is disposed between the intermediary transfer belt 21 and the fixing fluid storage chamber 35. The heat-insulating protection member 74 is constructed of a platy member designed to be movably supported by a non-illustrated protection member moving section. The heat-insulating protection member 74 is made larger in both longitudinal length and length in a direction perpendicular to the longitudinal direction (width) than the opening 35*c* of the fixing fluid storage chamber 35. Moreover, the heat-insulating protection member 74 is shifted between a closing position and an opening position by the protection member moving section. When the heat-insulating protection member 74 is shifted to the closing position, the opening 35*c* of the fixing fluid storage chamber 35 is blocked completely, thus making the inner space of the fixing fluid storage chamber 35 closed space. On the other hand, when the heat-insulating protection member 74 is shifted to the opening position, the coating roller 66 can be brought into direct confrontation with the intermediary transfer belt 21 through the opening 35*c*. When the heat-insulating protection member 74 is sitting at the opening position, by the action of the eccentric cam 42, the contact and release detecting section, the coating roller 66 is brought into contact with the surface of the intermediary transfer belt 21, whereupon the fixing fluid 9 is applied to the toner image borne thereon. The heat-insulating protection member 74 is of a platy member composed of a base layer 75 and a heat insulating layer 76 stacked together in layers. When the heat-insulating protection member 74 is sitting at the closing position, one thickness-wise surface thereof, namely the surface of the base layer 75 faces the intermediary transfer belt 21; part of the other thickness-wise surface, namely part of the surface of the heat insulating layer 76 faces the coating roller 66 through the opening 35*c* of the fixing fluid storage chamber 35, with a spacing secured therebetween; and other part of the surface of the heat insulating layer 76 makes contact with the side surface 35*b* of the fixing fluid storage chamber 35. Moreover, during the movement of the heat-insulating protection member 74 between the closing position and the opening position, the surface of the heat insulating layer 76 and the surface of the coating roller 66 are kept out of contact with each other. With this arrangement, the heat-insulating protection member 74 is inhibited from making contact with the coating roller 66 while on the move, in consequence whereof there results no problem such as surface flaw and abrasion on the coating roller 66. Another advantage is that, in the absence of contact between the heat-insulating protection member 74 and the coating roller 66, the heat-insulating protection member 74 is free of the adhesion of the fixing fluid 9. As a result, it never occurs that the fixing fluid 9 travels along the heat-insulating protection member 74 to leak outside of the fixing fluid storage chamber 35 that will eventually cause contamination of the interior of the image forming apparatus.

The base layer 75 is formed to impart mechanical strength to the heat-insulating protection member 74. This helps keep the heat-insulating protection member 74 in shape for a longer period of time. It is desirable to use, as the base layer 75, a resin material which is excellent in chemical resistance, organic solvent resistance, and so forth. The preferred examples thereof include fluorine resin such as PTFE, and polyphenylene sulfide (PPS). The heat insulating layer 76 should preferably be made of a material which is higher in heat insulation ability than the material used to form the fixing fluid storage chamber 35. In general, the fixing fluid storage chamber 35 is constituted by using ABS (acrylnitrile butadiene styrene) resin, high-density polyethylene, epoxy resin, or the like material. Therefore, for example, silicon rubber may be used because it is higher in heat insulation ability than these materials. Silicon rubber may be used in the form of a foamed silicon sponge having an open-cell or closed-cell structure. As shown in FIGS. 6 to 8, when the heat-insulating protection member 74 is sitting at the closing position, contact is established between it and the side surface 35*b* of the fixing fluid storage chamber 35, with no gap existing therebetween. Moreover, at both lengthwise ends of the fixing fluid applying section 65, contact is established between the heat-insulating protection member 74 and the bearing portion 66*b* formed integrally with the fixing fluid storage chamber 35, with no gap existing therebetween. Accordingly, when the heat-insulating protection member 74 is sitting at the closing position, the opening 35*c* of the fixing fluid storage chamber 35 is blocked completely thereby, thus making the inner space of the fixing fluid storage chamber 35 closed space. This helps prevent the diffusion of air containing vapors from the fixing fluid 9 existing around the coating roller 66, and thereby prevent further volatilization of the fixing fluid 9 from the surface of the coating roller 66. Moreover, when the heat-insulating protection member 74 is sitting at the closing position, the arrangement is such that the heat-insulating protection member 74 is interposed between the intermediary transfer belt 21 and the coating roller 66. This helps protect the surface of the coating roller 66 against heat, and thereby avoid variation in the content of the fixing fluid 9 over the surface. That is, in applying the fixing fluid 9 to the toner image borne on the intermediary transfer belt 21, by giving the coating roller 66 at least one turn, and preferably continuing the rotation for 0.5 to 10 seconds before establishing contact between it and the intermediary transfer belt 21, it is possible to get rid of the unevenness of the fixing fluid 9 distribution on the surface of the coating roller 66 with ease. As a result, lack of uniformity in the application of the fixing fluid 9 and the ensuing problems such as unevenness in density and glossiness can be prevented successfully. This makes it possible to produce high-quality images having high image density and uniform glossiness with stability for a longer period of time. Although, in this embodiment, the heat-insulating protection member 74 is designed to have a multi-layer structure of the base layer 75 and the heat insulating layer 76, the heat-insulating protection member 74 is not limited to such a configuration but may assume a single-layer structure of the heat insulating layer 76 alone. In this case, to form the heat insulating layer 76, it is desirable to use a material which exhibits high mechanical strength and excellent stability in shape. The preferred examples thereof include porous or honeycomb-shaped resin or metal materials.

Figure 9:
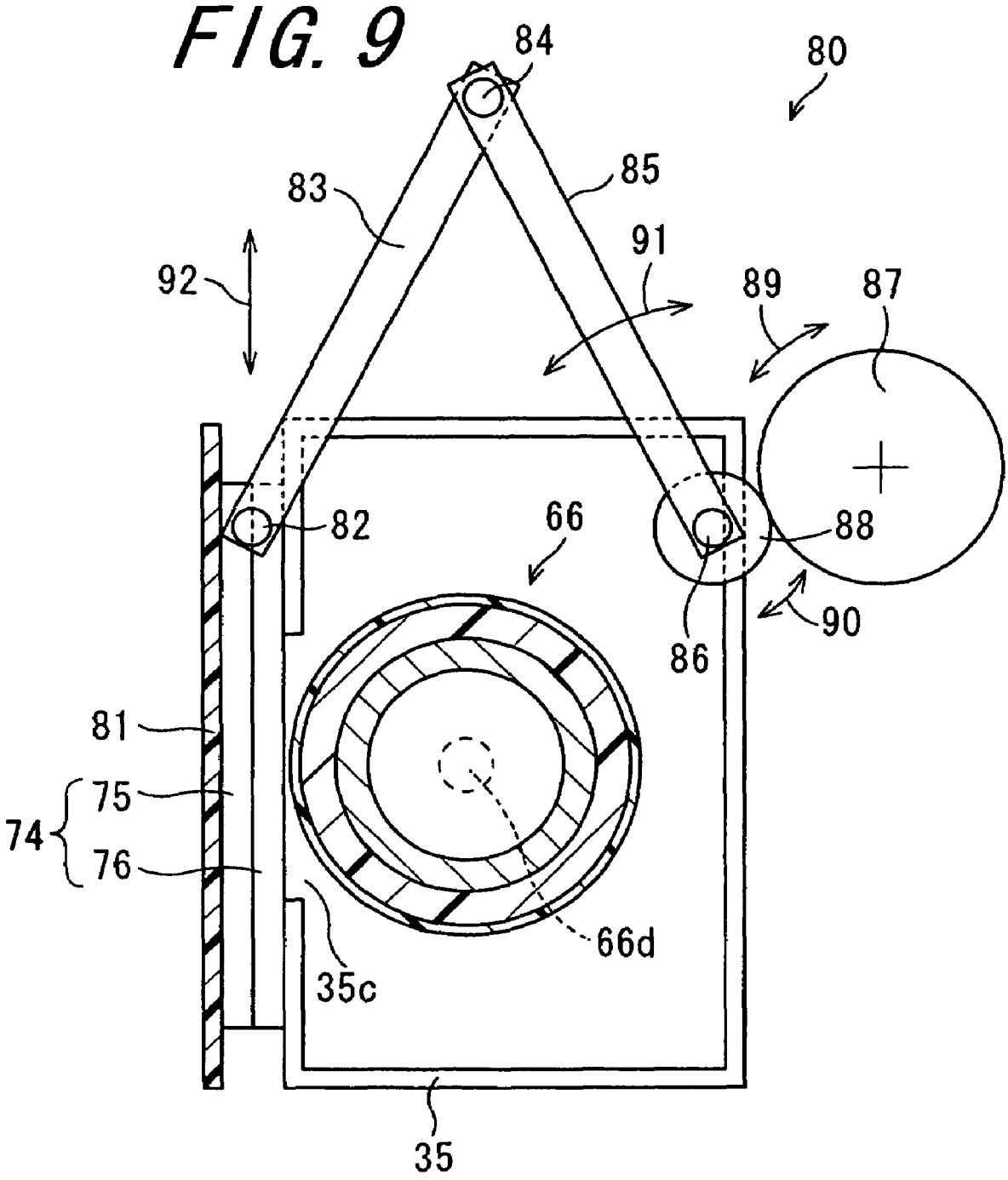
FIG. 9 is a side view schematically showing the constitution of the protection member moving section.

FIG. 9 is a side view schematically showing the constitution of the protection member moving section 80. The heat-insulating protection member 74 is so supported as to be movable between the opening position and the closing position by the protection member moving section 80. In FIG. 9, the heat-insulating protection member 74 is illustrated as sitting at the closing position. The protection member moving section 80 is composed of a guide member 81, a first pin 82, an open/close arm 83, a second pin 84, a rocker arm 85, a third pin 86, a first gear 87, and a second gear 88. The first pin 82 and the second pin 84 are made to rotate freely. The third pin 86 and the rocker arm 85 are fixedly attached to the second gear 88, and are rotatably moved in a direction indicated by arrow 91 as the first gear 87 is rotated in a direction indicated by arrow 90. The guide member 81 is disposed uprightly in contact with both lengthwise ends, on the surface of the base layer 75, of the heat-insulating protection member 74, for regulatingly moving the heat-insulating protection member 74 in a direction indicated by arrow 92. Being held between the fixing fluid storage chamber 35 and the guide member 81, the heat-insulating protection member 74 is allowed to move only in the direction of arrow 92. By the first pin 82, one end of the open/close arm 83 is universally pivotably fixed to a transverse side end of the heat-insulating protection member 74. The open/close arm 83 has its one end supported on the heat-insulating protection member 74 universally pivotably by the first pin 82, and the other end coupled to the rocker arm 85 universally pivotably by the second pin 84. The open/close arm 83 rocks on the first and second pins 82 and 84 acting as a fulcrum under the stress exerted by the rocker arm 85, and thereby the heat-insulating protection member 74 is moved in the direction of arrow 92. By the second pin 84, the open/close arm 83 and the rocker arm 85 are universally pivotably coupled to each other. The rocker arm 85 is rotated in accompaniment with the rotation of the second gear 88. By the rotatory motion of the rocker arm 85, the rotation of the second gear 88 is converted, via the rotation of the open/close arm 83, into the movement of the heat-insulating protection member 74 in the direction of arrow 92. The second gear 88 is engaged with the first gear 87 to transmit the rotatable drive to the first gear 87 to the rocker arm 85. The first gear 87', which is engaged with the second gear 88, is so supported as to be rotatable in the image forming apparatus. By a non-illustrated driving section, the first gear 87 is driven to rotate in either of a clockwise direction and a counterclockwise direction. According to the protection member moving section 80, the rotation of the first gear 87 in a direction indicated by arrow 89 is transmitted, via the second gear 88, the third pin 86, the rocker arm 85, and the second pin 84, to the open/close arm 83, to move the heat-insulating protection member 74 reciprocally in the direction of arrow 92. The protection member moving section 80 is operated under the control of the control unit 140 for controlling all of the workings of the image forming apparatus. In the course of an image forming process, the heat-insulating protection member 74 is sitting at the opening position. Following the completion of the image forming process, the control unit 140 effects control of the eccentric cam 42 acting as a contact and release operation section in a manner so as to move the coating roller 66 away from the intermediary transfer belt 21. Then, upon the detection that the coating roller 66 is kept away from the intermediary transfer belt 21 by the contact and release detecting section 43, then the control unit 140 issues a control signal to the driving section for rotatably driving the first gear 87 to rotate the first gear 87 in a predetermined rotation direction. In this way, the heat-insulating protection member 74 is moved from the opening position to the closing position, thus making the inner space of the fixing fluid storage chamber 35 closed space. Meanwhile, during standby, the heat-insulating protection member 74 is sitting at the closing position. In order to effect a shift from a standby mode to an image forming operation mode, at first, the control unit 140 issues a control signal to the driving section for rotatably driving the first gear 87 to rotate the first gear 87. At this time, the first gear 87 is rotated in a direction reverse to the direction in which it is rotated to move the heat-insulating protection member 74 from the opening position to the closing position. In this way, the heat-insulating protection member 74 is moved from the closing position to the opening position.

The fixing fluid storage chamber 35 is designed in the form of a cartridge so as to be freely attachable to and detachable from the image forming apparatus. Accordingly, when the fixing fluid 9 accommodated in the fixing fluid storage chamber 35 becomes depleted, the fixing fluid storage chamber 35 is replaced with the new one. Note that the fixing fluid storage chamber 35 is not limited to the cartridge configuration as suggested herein but may be of another configuration. For example, although not shown in the figure, it is also possible to provide, inside the image forming apparatus, a fixing fluid storage tank and fixing fluid supply section for supplying the fixing fluid 9 from the fixing fluid storage tank to the fixing fluid storage chamber 35. In this case, depending on how the fixing fluid 9 is consumed, the fixing fluid supply section operates to supply the fixing fluid 9 from the fixing fluid storage tank to the fixing fluid storage chamber 35 until it reaches a predetermined fluid level in the fixing fluid storage chamber 35. For example, the fixing fluid supply section is composed of non-illustrated piping for providing connection between the fixing fluid storage chamber 35 and the fixing fluid storage tank and a non-illustrated fluid-feeding pump disposed above the piping. With this constitution, it is possible to store a great amount of the fixing fluid 9 inside the image forming apparatus, and thereby reduce the number of supply of the fixing fluid 9.

According to the fixing fluid applying section 65, under standby conditions, the heat-insulating protection member 74 is sitting at the closing position, thereby protecting the coating roller 66 disposed within the fixing fluid storage chamber 35 against the radiation of heat from the intermediary transfer belt 21. On the other hand, under operating conditions for image formation, the heat-insulating protection member 74 is sitting at the opening position, so that the coating roller 66 can be brought into contact with the intermediary transfer belt 21 to apply the fixing fluid 9 to the toner image borne thereon. In this embodiment, with the heat-insulating protection member 74 placed at the closing position, it is desirable to give the coating roller 66 at least one turn, and preferably continue the rotation for 0.5 to 10 seconds before getting an image forming operation started. The coating roller 66 is rotated by the rotational driving section composed of the coating roller gear 66*c*, the non-illustrated intermediary gear, the non-illustrated driving gear, and the non-illustrated driving section for rotatably supporting the driving gear. The rotational driving section is analogous to that of the image forming apparatus 1. Moreover, just as is the case with the image forming apparatus 1, the rotational driving section is operated under the control of the control unit 140. Since the supply roller 70 and the regulatory roller 71 abut against the surface of the coating roller 66, part of the surface subjected to abutment often differs in fixing fluid amount from other part. Therefore, if, upon the shift from the standby mode to the operation mode, the application of the fixing fluid 9 is carried out with the coating roller 66 kept in a non-rotating state, there arises a problem of lack of uniformity in the application of the fixing fluid 9 on the intermediary transfer belt 21. This could lead to unevenness in density and glossiness in the fixed image. Accordingly, by giving the coating roller 66 at least one turn before the start of an image forming operation; that is, before bringing the coating roller 66 into contact with the intermediary transfer belt 21, it is possible to avoid occurrence of uneven distribution of the fixing fluid 9 on the surface of the coating roller 66, and thereby apply the fixing fluid 9 evenly. As a result, high-quality images having, for example, uniform density and uniform glossiness can be produced with stability for a longer period of time. Moreover, in this embodiment, with the heat-insulating protection member 74 placed at the closing position, it is desirable to rotate the coating roller 66 under standby conditions where no image formation is carried out. In this case, although the rotation of the coating roller 66 may be continued for the duration of standby, preferably the coating roller 66 is rotated a predetermined number of times at evenly spaced time intervals. The time interval and the number of rotation are selected, in consideration of the kind of the organic solvent contained in the fixing fluid 9 and the length of standby time, in a range such as to avoid occurrence of uneven distribution of the fixing fluid 9 on the surface of the coating roller 66. This allows the coating roller 66 to have on its surface substantially uniform distribution of the fixing fluid 9 at all times. Even if the coating roller 66 has on its surface uneven distribution of the fixing fluid 9, there is very little, if any. Accordingly, by giving the coating roller 66 at least one turn, and preferably continuing the rotation for 0.5 to 10 seconds before the start of an image forming operation, it is possible to make the distribution of the fixing fluid 9 uniform on the surface of the coating roller 66. When the coating roller 66 in this state is brought into contact with the intermediary transfer belt 21, the fixing fluid 9 is applied evenly to the toner image borne thereon. Further, in this embodiment, in a case where the fixing fluid 9 contains two or more kinds of organic solvents, the coating roller 66 may be rotated in accordance with the result of detection as to the temperature of the intermediary transfer belt 21 produced by the temperature detecting section. Note that, as has already been described, the heat-insulating protection member 74 and the coating roller 66 are so arranged that the surface of the heat insulating layer 76 and the surface of the coating roller 66 are kept out of contact with each other. With this arrangement, the coating roller 66 is free from problems such as surface flaw and abrasion while on the move. Accordingly, when the heat-insulating protection member 74 is sitting at the closing position, the coating roller 66 can be rotated continuously while the volatilization of the fixing fluid 9 and the ensuing dryness of the surface of the coating roller 66 can be suppressed. Another advantage is that, since the inner space of the fixing fluid storage chamber 35 is kept closed under standby conditions, it is possible to prevent the volatilization of the fixing fluid 9 without fail in relation to vapor pressure, and thereby eliminate unnecessary fixing fluid 9 consumption.

Figure 16:
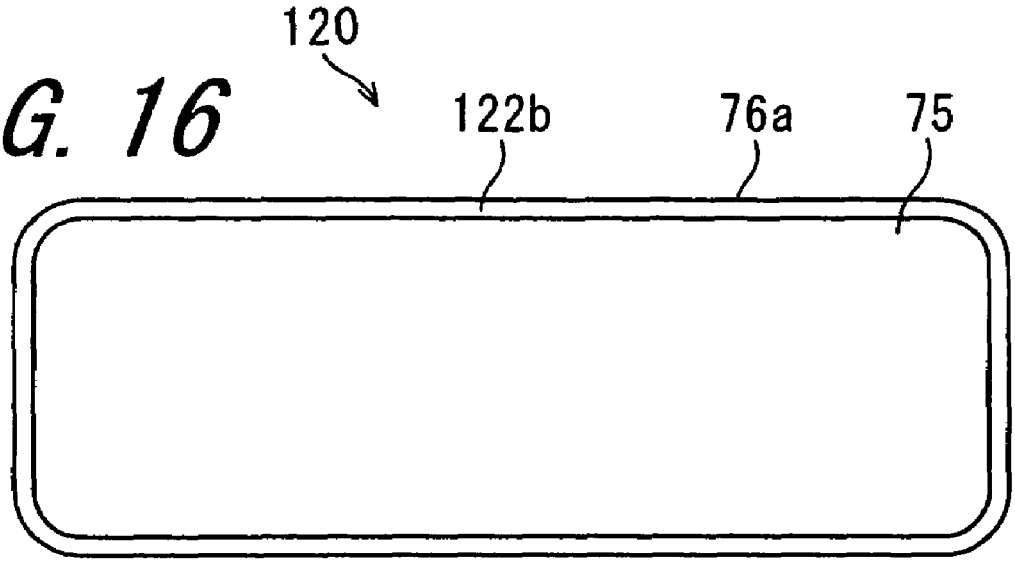
FIG. 16 is a plan view schematically showing the constitution of differently-configured heat-insulating protection member.
Figure 17:
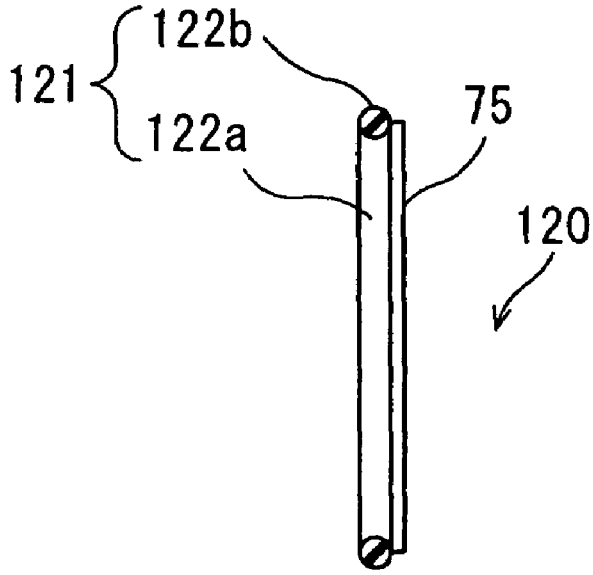
FIG. 17 is a sectional view of the heat-insulating protection member depicted in FIG. 16.

While this embodiment employs the heat-insulating protection member 74, the invention is not limited thereto. A heat-insulating protection member 120 as shown in FIGS. 16 and 17 may be employed instead. FIG. 16 is a plan view schematically showing the constitution of the heat-insulating protection member 120. FIG. 17 is a sectional view of the heat-insulating protection member 120 depicted in FIG. 16. The heat-insulating protection member 120 is analogous to the heat-insulating protection member 74, and therefore the constituent components that play the same or corresponding roles as in the heat-insulating protection member 74 will be identified with the same reference symbols, and overlapping descriptions will be omitted. The heat-insulating protection member 120 is characterized by having a fixing fluid retaining portion 122*b*, which is formed along the outer periphery of a heat insulating layer 121. The heat insulating layer 121 is composed of a heat insulating film 122*a* and the fixing fluid retaining portion 122*b* formed along the outer periphery of the heat insulating film 122*a*. The heat insulating film 122*a* is made of the same material as that used to form the heat insulating layer 76 of the heat-insulating protection member 74. The fixing fluid retaining portion 122*b* is made of a material having both a liquid absorption ability and a liquid retention ability for retaining absorbed liquid therein. For example, a porous material such as a felt serves the purpose. The heat insulating film 122*a* and the fixing fluid retaining portion 122*b* are bonded to each other by means of an adhesive or otherwise. It is preferable that the heat insulating layer 121 is made a size larger than the base layer 75. With use of the heat-insulating protection member 120, even though the fixing fluid 9 accommodated inside the fixing fluid storage chamber 35 is adhered to the heat insulating layer 121, the adherent fixing fluid 9 can be absorbed and retained in the fixing fluid retaining portion 122*b* formed along the outer periphery of the heat insulating layer 121. This helps prevent even further the fixing fluid 9 from leaking outside of the fixing fluid storage chamber 35 that will eventually cause contamination of the interior of the image forming apparatus 1.

Figure 10:
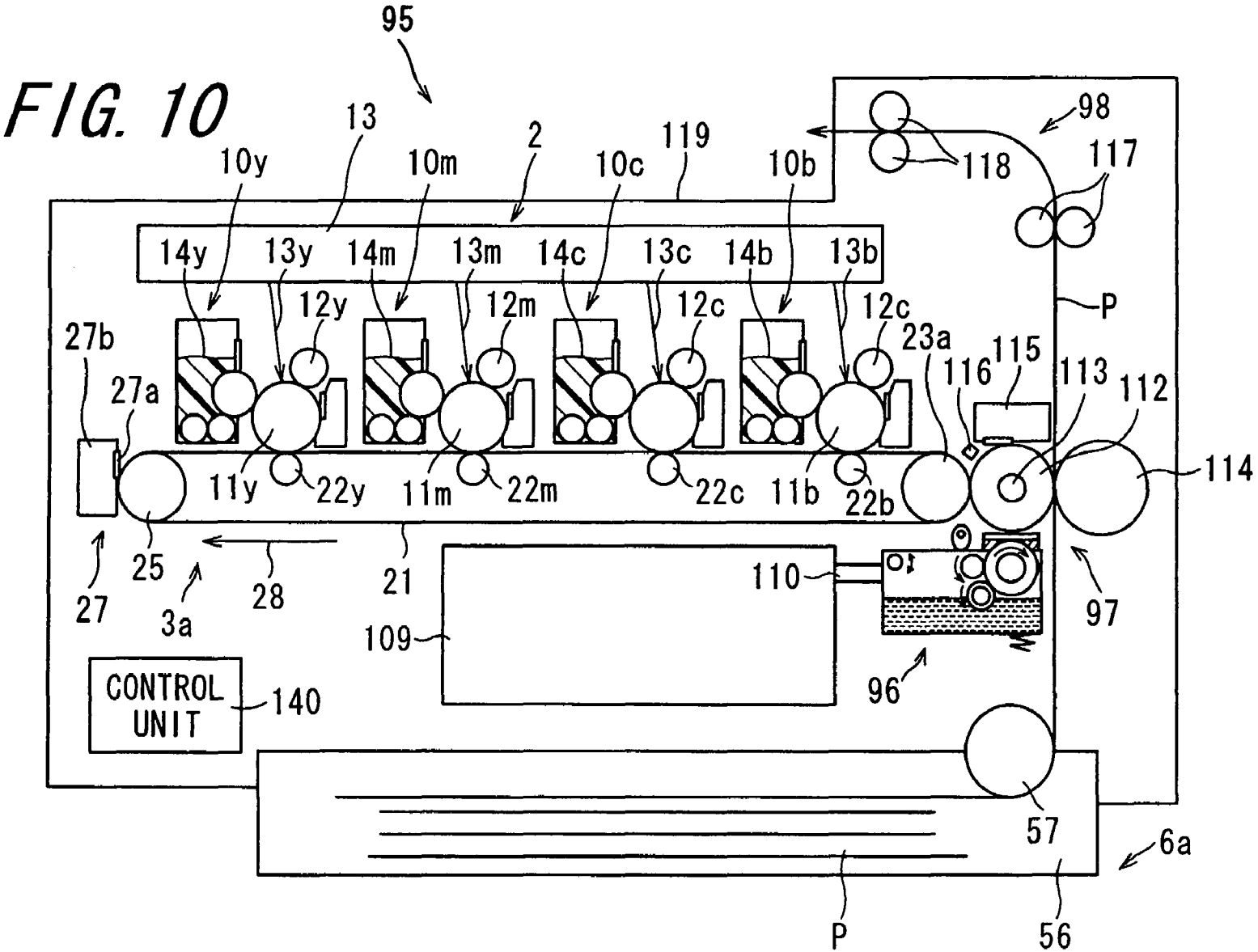
FIG. 10 is a sectional view schematically showing the constitution of an image forming apparatus according to a second embodiment of the invention.
Figure 11:
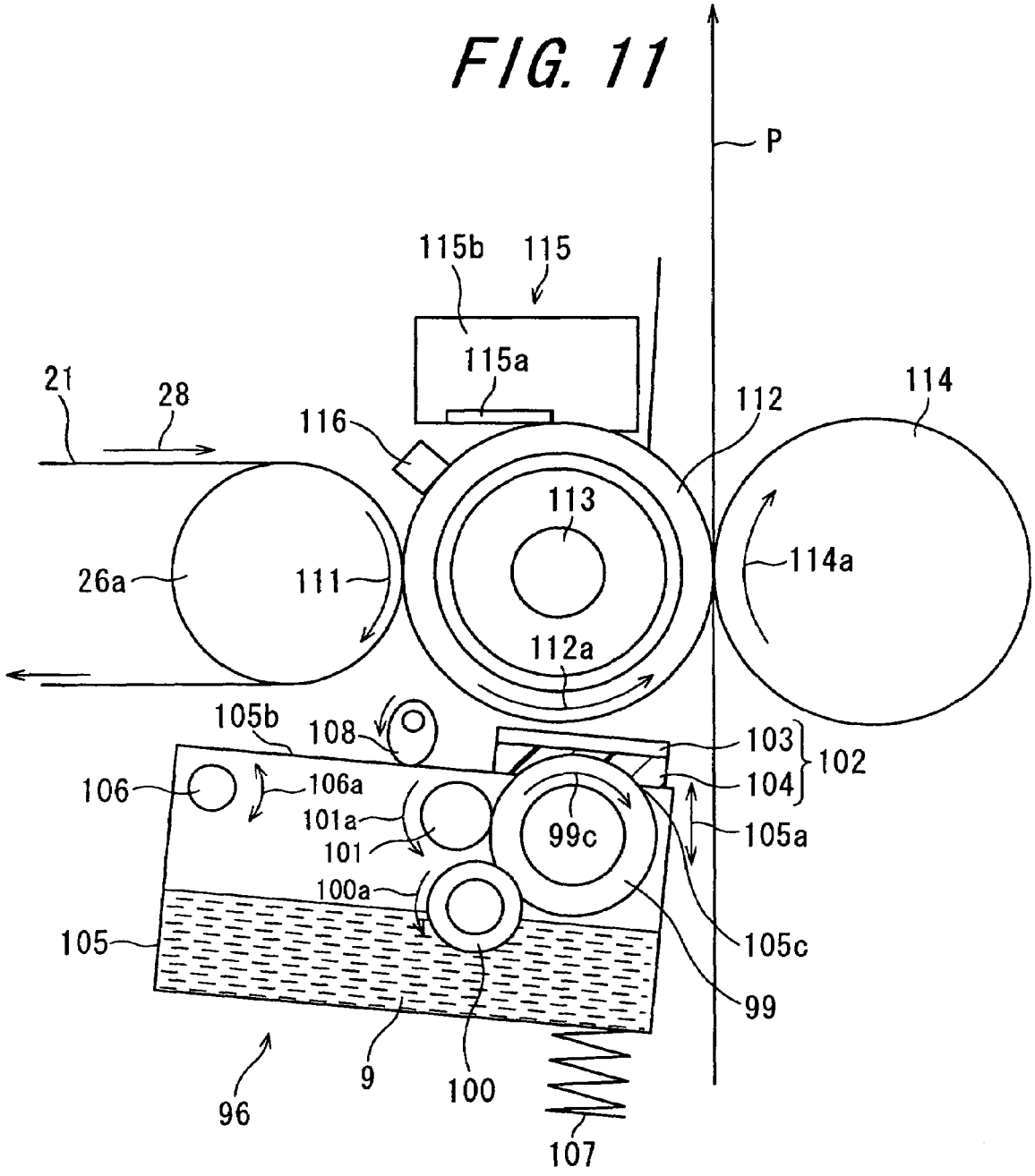
FIG. 11 is a sectional view schematically showing the structure of the main portion of the image forming apparatus depicted in FIG. 10.
Figure 12:
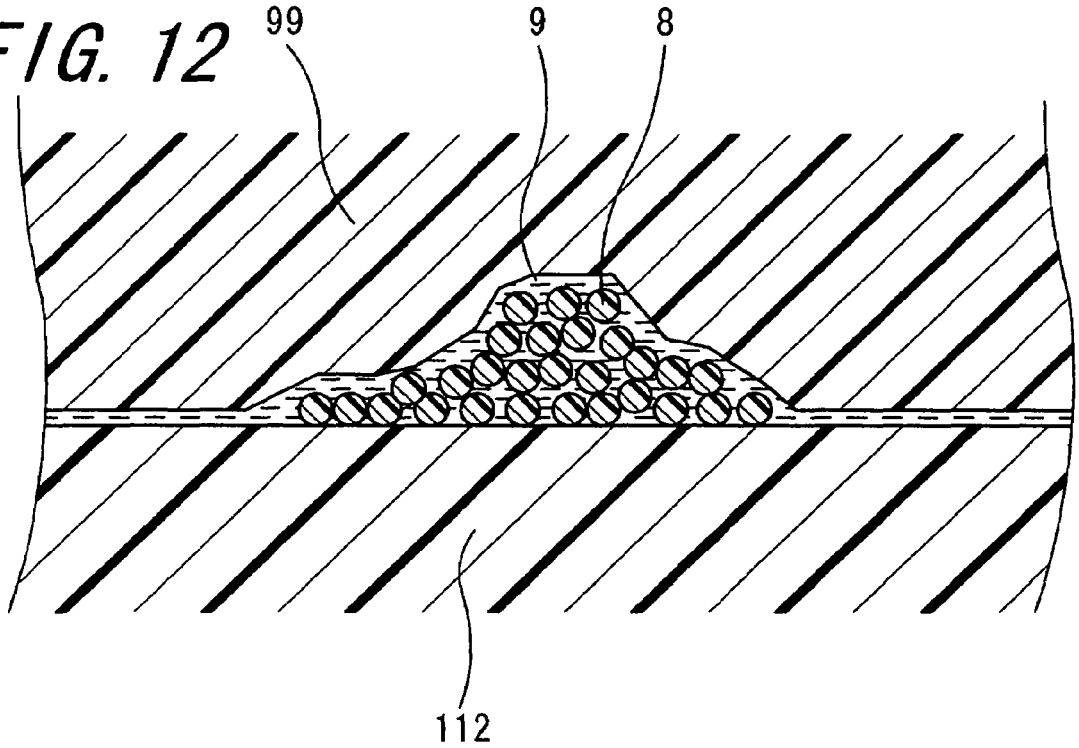
FIG. 12 is a view schematically illustrating how the fixing fluid is applied to a toner image borne on a transferring and fixing roller by a coating roller.
Figure 13:
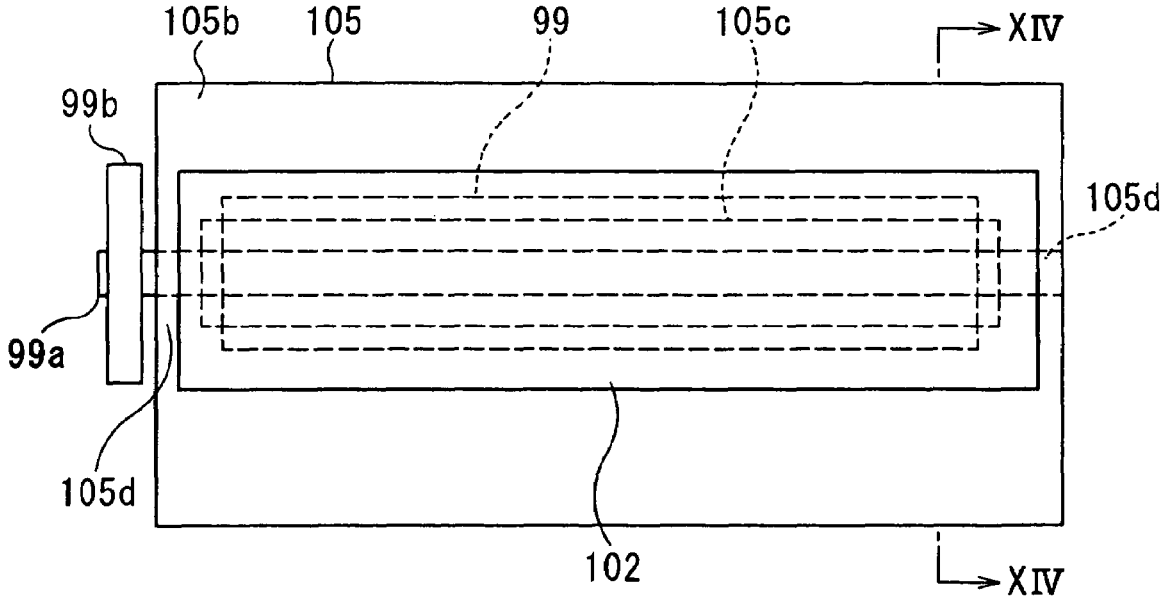
FIG. 13 is a front view of the fixing fluid applying section, as viewed in the direction of the transferring and fixing roller.
Figure 14:
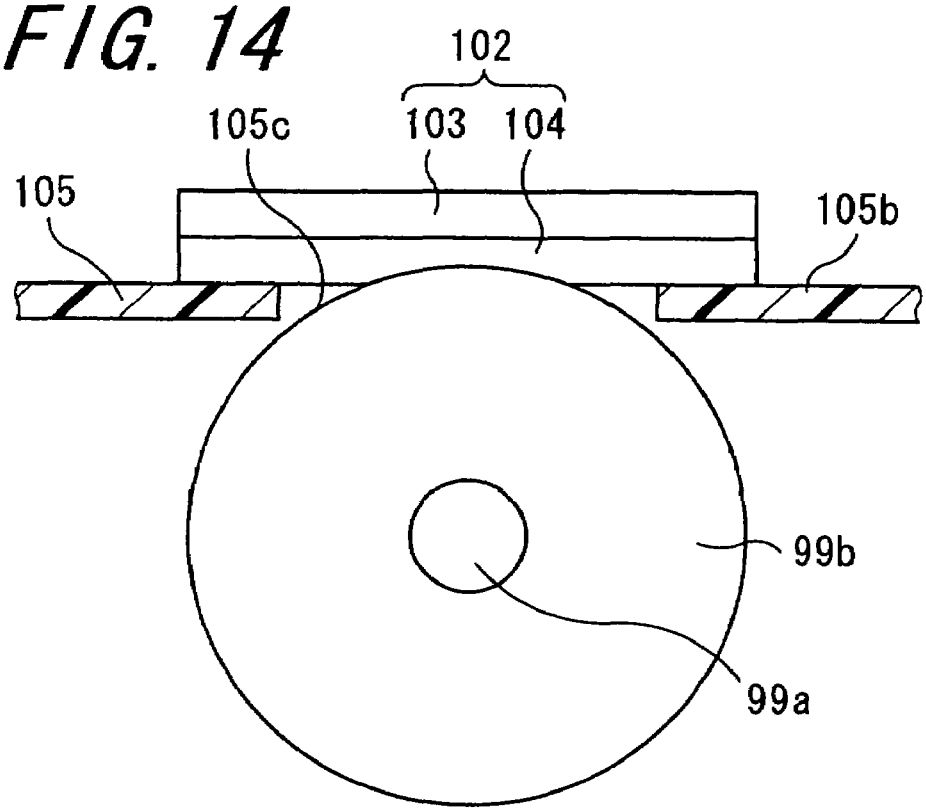
FIG. 14 is a sectional view of the fixing fluid applying section taken along the line XIV-XIV of FIG. 13.
Figure 15:
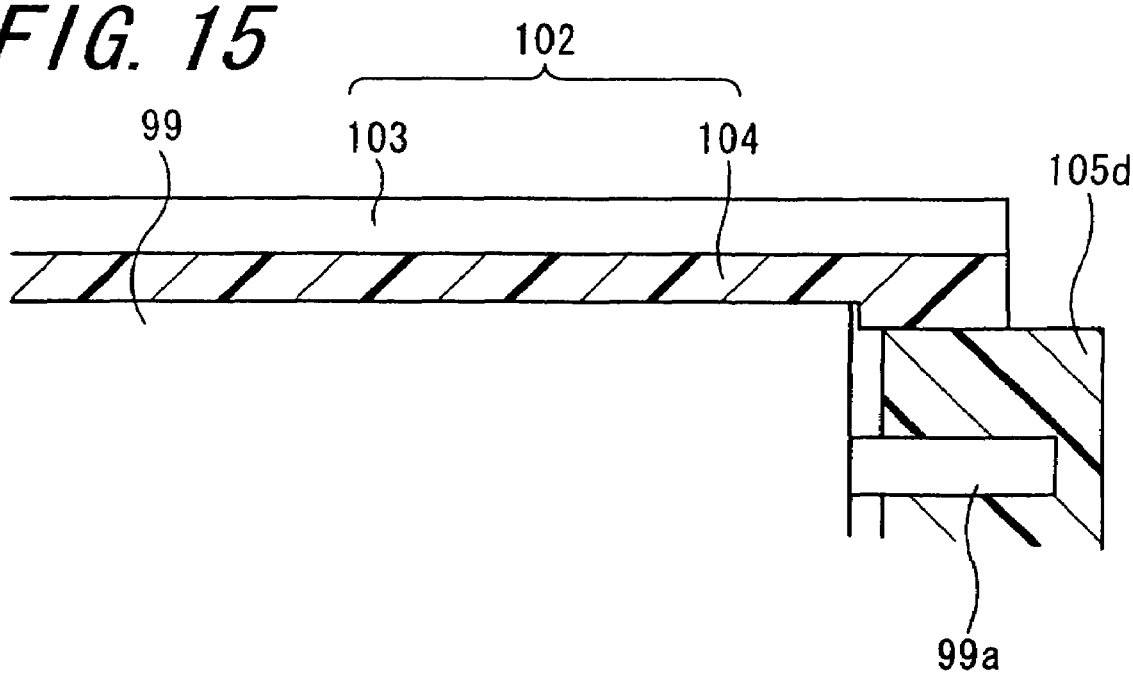
FIG. 15 is a partial sectional view of the fixing fluid applying section depicted in FIG. 13, as viewed in a direction longitudinally thereof.

FIG. 10 is a sectional view schematically showing the constitution of an image forming apparatus 95 according to a second embodiment of the invention. FIG. 11 is a sectional view schematically showing the structure of the main portion (a fixing fluid applying section 96 and a transferring and fixing section 97) of the image forming apparatus 95 depicted in FIG. 10. FIG. 12 is a view schematically illustrating how the fixing fluid 9 is applied to a toner image borne on a transferring and fixing roller 112 by a coating roller 99. FIG. 13 is a front view of the fixing fluid applying section 96, as viewed in the direction of the transferring and fixing roller 112. FIG. 14 is a sectional view of the fixing fluid applying section 96 taken along the line XIV-XIV of FIG. 13. FIG. 15 is a partial sectional view of the fixing fluid applying section 96 depicted in FIG. 13, as viewed in a direction longitudinally thereof. The image forming apparatus 95 is analogous to the image forming apparatus 1, and therefore the constituent components that play the same or corresponding roles as in the image forming apparatus 1 will be identified with the same reference symbols, and overlapping descriptions will be omitted. The image forming apparatus 95 differs from the image forming apparatus 1 in terms of an intermediary transfer section 3*a*, the fixing fluid applying section 96, the transferring and fixing section 97, a recording medium supply section 6*a*, and an ejection section 98. More specifically, the image forming apparatus 95 is not designed to transfer and fix a toner image borne on the intermediary transfer belt 21 included in the intermediary transfer section 3*a* directly onto the recording medium P, but designed as follows. That is, the transferring and fixing roller 112 acting also as a toner image bearing section is interposed between the intermediary transfer belt 21 and the recording medium P, and the fixing fluid applying section 96 applies the fixing fluid 9 to a toner image borne on the surface of the transferring and fixing roller 112 in a contact manner under a heating condition. In the image forming apparatus 95, since the fixing fluid 9 is applied to the toner image on the transferring and fixing roller 112, no fixing fluid 9 is adhered to the intermediary transfer belt 21. Moreover, since the toner image is heated on the transferring and fixing roller 112, the intermediary transfer belt 21 is less prone to a rise in temperature. This helps prevent the toner 8 from undergoing quality degradation in the course of toner image formation due to the rise in temperature of the components constituting the toner image forming section 2, the adhesion of the fixing fluid 9 to the constituent components, or other factors. As a result, high-quality images can be produced with stability for a longer period of time. Further, the image forming apparatus 95 is characterized in that the fixing fluid applying section 96 is provided with a heat-insulating protection member 102.

The intermediary transfer section 3*a* is composed of the intermediary transfer belt 21, intermediary transfer rollers 22*y*, 22*m*, 22*c*, and 22*b*, supporting rollers 23*a* and 25, and a belt cleaner 27. In the intermediary transfer section 3*a*, the supporting roller 23*a* is arranged downstream from the intermediary transfer roller 22*b* in the direction in which the intermediary transfer belt 21 is driven to rotate (direction indicated by arrow 28). A no heating section is disposed inside the supporting roller 23*a*. That is, in the intermediary transfer section 3*a*, neither the intermediary transfer belt 21 nor the toner image is subjected to application of heat, wherefore the provision of a temperature sensor is optional. In contrast to the intermediary transfer belt 21 of the image forming apparatus 1 that is supported at three points, the intermediary transfer belt 21 of the image forming apparatus 95 is supported at two points; that is, supported by the supporting rollers 23*a* and 25. Note that, in this embodiment, the intermediary transfer belt 21 is constituted by laminating a fluorine resin layer on a surface of a polyimide-made substrate.

The fixing fluid applying section 96 is composed of the coating roller 99, a supply roller 100, a regulatory roller 101, the heat-insulating protection member 102, a fixing fluid storage chamber 105, a pivot 106, an elastic member 107, and an eccentric cam 108. Moreover, the fixing fluid applying section 96 is arranged below the transferring and fixing roller 112 designed as a heating element. This makes it possible to lessen the rise in temperature of the coating roller 99, the fixing fluid 9, and so forth resulting from the radiation of heat from the transferring and fixing roller 112, and thereby suppress the volatilization of the fixing fluid 9.

The coating roller 99 is constructed of a roller-shaped member designed to move approachably and separably with respect to the surface of the transferring and fixing roller 112. Part of the coating roller 99 protrudes upwardly from an opening 105*c* created on a surface of the fixing fluid storage chamber 105 that faces the transferring and fixing roller 112. The fixing fluid 9 is applied to the toner image borne on the transferring and fixing roller 112 by the coating roller 99. In this embodiment, the coating roller 99 is so arranged as to be kept clear of the fixing fluid 9 stored inside the fixing fluid storage chamber 105. Moreover, it is apparent from FIGS. 13 and 14 that the coating roller 99 has a rotary shaft 99*a* formed integrally with non-illustrated flanges disposed at both lengthwise ends of a non-illustrated core metal. Both ends of the rotary shaft 99*a* are supported by a bearing portion 105*d* formed interiorly of and integrally with the fixing fluid storage chamber 105. In this way, the coating roller 99 is so supported as to be driven to rotate about its axis by the fixing fluid storage chamber 105. Moreover, the rotary shaft of the coating roller 99 has its one end made to protrude outwardly through the bearing portion 105*d* in a direction longitudinally of the fixing fluid storage chamber 105. At the end is disposed a coating roller gear 99*b*, just as is the case with the coating roller 30. The coating roller gear 99*b*, together with a non-illustrated driving gear disposed so as to be driven to rotate by a non-illustrated driving section, an intermediary gear which is engaged with the driving gear and is disposed coaxially with the pivot 106, and a plurality of other intermediary gears disposed between the intermediary gear and the coating roller gear 99*b*, constitutes a rotational driving section for driving the coating roller 99 to rotate in a direction indicated by arrow 99*c*.

For example, the coating roller 99 is constructed of a roller-shaped member composed of a core metal having formed on its surface an elastic layer. The elastic layer is made of a material which has elasticity and exhibits wettability with respect to the fixing fluid 9. Herein, an index of elasticity corresponds to elasticity modulus of the elastic layer in the direction of thickness thereof. It is preferable that the elastic layer is smaller in thickness-wise elasticity modulus than the toner 8 or the toner material contained in the toner 8 such as the binder resin and the mold releasing agent. Preferably, the thickness-wise elasticity modulus of the elastic layer is equal to or smaller than 1/10, especially preferably 1/100, of that of the toner 8 or the toner material. An index of wettability with respect to the fixing fluid 9 corresponds to an angle of contact between the fixing fluid 9 and a pertinent material. The contact angle should preferably stand at or below 50 degrees. The examples of materials that satisfy such a requirement include: an elastic metal such as aluminum; a hydrophilic resin; and a rubber material such as ethylene propylene rubber and urethane rubber. This embodiment employs, as the coating roller 99, a 20 mm-outer-diameter roller-shaped member composed of a 12 mm-outer-diameter core metal having formed on its surface an elastic layer made of ethylene propylene rubber having a Young's modulus of 2 MPa. By virtue of the elastic layer made of a material having a high affinity for the fixing fluid 9, the fixing fluid 9 can be retained in the form of a lamella on the surface of the coating roller 99. Therefore, a small amount of the lamellar fixing fluid 9 can be applied evenly over a wide area of the surface of the coating roller 99. This makes it possible to achieve a reduction in fixing fluid 9 consumption, as well as to avoid that an excess amount of the fixing fluid 9 is adhered to the surface of the coating roller 99 that will eventually sweep an unfixed toner image away, and thereby prevent occurrence of image irregularity.

The coating roller 99 is elastically deformable under pressure because of having the elastic layer on its surface. As shown in FIG. 12, at the location where the coating roller 99 and the transferring and fixing roller 112 make contact with each other under pressure, that part of the surface of the coating roller 99 which makes pressure-contact with that part of the surface of the transferring and fixing roller 112 in which a toner image is present becomes elastically deformed in conformity with the asperities of the toner image to eventually cave in. During pressurization by the surface of the coating roller 99, on the transferring and fixing roller 112, the toner image, in contrast to the region free of the toner image, is subjected to higher pressure. The lamellar fixing fluid 9 is present on the surface of the coating roller 99, and, when the fixing fluid 9 is brought into contact, in contrast to the region free of the toner image (non-image portion), the toner image (image portion) is subjected to higher pressure. This allows, even if the toner image has asperities, the fixing fluid 9 to be applied evenly to both the high-level part (the part having a large amount of the adherent toner 8) and the low-level part (the part having a small amount of the adherent toner 8) of the toner image. The amount of the fixing fluid 9 to be applied to the non-image portion is reduced. Accordingly, the fixing fluid 9 can be applied evenly and selectively to a multi-color toner image having appreciable asperities. Meanwhile, the toner image (image portion) is formed of the aggregation of the powdery toner 8, and is thus large in surface area per unit area when viewed macroscopically. A toner image bearing a large amount of toner in particular, such as a multi-color toner image obtained by superimposing toner images of a plurality of colors, is still larger in surface area per unit area when viewed macroscopically. On the other hand, the toner image-absent region (non-image portion) of the transferring and fixing roller 112 has substantially a smooth surface, and is thus small in surface area per unit area when viewed macroscopically. Therefore, the amount of the fixer fluid 9 to be applied to the image portion is far larger than that to be applied to the non-image portion. In this way, the application amount of the fixing fluid 9 can be adjusted on the basis of per-area toner amount; that is, the application amount of the fixing fluid 9 varies between the image portion and the non-image portion. This makes it possible to apply the fixing fluid 9 only to the toner image, and thereby produce high-quality images having high fixability with respect to the recording medium P with stability for a longer period of time.

In the case of bringing the coating roller 99 into pressure-contact with the transferring and fixing roller 112, the press force for establishing contact therebetween should preferably fall in a range of from 0.05 N/cm to 1.0 N/cm in terms of linear pressure. If the press force is less than 0.05 N/cm, the contact between the coating roller 99 and the transferring and fixing roller 112 becomes unstable, and thus the fixing fluid 9 cannot be applied evenly to the toner image. Furthermore, the coating roller 99 fails to elastically deform sufficiently, and thus the fixing fluid 9 cannot be applied sufficiently to the concavities of the toner image. This leads to lack of uniformity in the application of the fixing fluid 9 and thus to unevenness in glossiness, density, and coloration in a resultant image. By contrast, if the press force is greater than 1.0 N/cm, at the location where the coating roller 99 and the transferring and fixing roller 112 make contact with each other under pressure, the fixing fluid 9 on the surface of the coating roller 99 is unable to pass through the pressure-contact location, and is eventually squeezed into meniscus at the entrance of the pressure-contact location. An excess of the fixing fluid 9 flows back toward the upstream side in the direction in which the coating roller 99 is rotated. As a result, the fixing fluid 9 flows violently at the entrance of the fixing fluid nip portion, which results in the occurrence of irregularity in the toner image. In this embodiment, in the case of bringing the coating roller 99 into pressure-contact with the transferring and fixing roller 112, the press force for establishing contact therebetween is set at 0.5 N/cm. Moreover, in this embodiment, when the coating roller 99 is brought into pressure-contact with the transferring and fixing roller 112, the coating roller 99 is rotated at the same velocity as the surface velocity of the transferring and fixing roller 112.

The supply roller 100 is constructed of a roller-shaped member designed to make pressure-contact with the coating roller 99, at least part of which is immersed in the fixing fluid 9 stored inside the fixing fluid storage chamber 105. Moreover, the supply roller 100 is rotated in a direction indicated by arrow 100*a* by a non-illustrated driving section. This embodiment employs, as the supply roller 100, a sponge roller constituted by laminating a 5 mm-thick, open-celled urethane foam layer on a surface of a 10 mm-outer-diameter core bar. The supply roller 100 is rotated in the direction of arrow 100*a* while being immersed in the fixing fluid 9 to hold the fixing fluid 9 on its surface. The fixing fluid 9 deposited on the surface of the supply roller 100 is applied to the surface of the coating roller 99 at the location where the coating roller 99 and the supply roller 100 make contact with each other under pressure. The regulatory roller 101 is constructed of a roller-shaped member which makes pressure-contact with the coating roller 99 and is rotated by the non-illustrated driving section. The regulatory roller 101 is so arranged as to be kept clear of the fixing fluid 9 stored inside the fixing fluid storage chamber 105. At the location where the coating roller 99 and the regulatory roller 101 make contact with each other under pressure, the amount of the fixing fluid 9 on the surface of the coating roller 99 is adjusted (or regulated) properly by the regulatory roller 101 to create a uniform lamella of the fixing fluid 9. This embodiment employs a stainless steel-made roller having an outer diameter of 12 mm as the regulatory roller 101.

The heat-insulating protection member 102, which is interposed between the fixing fluid storage chamber 105 and the transferring and fixing roller 112, is designed to be movable between an opening position and a closing position. When the heat-insulating protection member 102 is shifted to the opening position, the coating roller 99, which protrudes upwardly from the opening 105*c* created on a side surface 105*b* of the fixing fluid storage chamber 105 that faces the transferring and fixing roller 112, is brought into direct confrontation with the transferring and fixing roller 112 through the opening 105*c*. That is, when the heat-insulating protection member 102 is sitting at the opening position, the coating roller 99 makes contact with the transferring and fixing roller 112, whereupon the fixing fluid 9 is applied to the toner image borne on the surface of the transferring and fixing roller 112. On the other hand, when the heat-insulating protection member 102 is sitting at the closing position, in the region between the fixing fluid storage chamber 105 and the transferring and fixing roller 112, the heat-insulating protection member 102 makes contact with part of the coating roller 99 protruding upwardly from the side surface 105*b* of the fixing fluid storage chamber 105 through the opening 105*c* created thereon to block the opening 105*c*. At this time, the heat-insulating protection member 102 is spaced away from the transferring and fixing roller 112. The heat-insulating protection member 102 is disposed above the fixing fluid storage chamber 105 and the coating roller 99 in contacting relation. That is, in terms of the positional relationship between the heat-insulating protection member 102 and the fixing fluid 9 stored inside the fixing fluid storage chamber 105, the heat-insulating protection member 102 is located spacedly above the fixing fluid 9. Being prepared in the form of liquid, the fixing fluid 9 is never adhered to the heat-insulating protection member 102 in relation to gravitation. Moreover, even if there is a little gap between the heat-insulating protection member 102 and the case of the fixing fluid storage chamber 105, there is no leakage of the fixing fluid 9 from the fixing fluid storage chamber 105 under gravitational force. The heat-insulating protection member 102 is of a platy member composed of a base layer 103 and a heat insulating layer 104 stacked together in layers. The heat-insulating protection member 102 has its base layer 103-side surface spacedly opposed to the transferring and fixing roller 112, and the other heat insulating layer 104-side surface made to make contact with part of the coating roller 99 and the side surface 105*b* of the fixing fluid storage chamber 105. The base layer 103 is made of a synthetic resin. It is desirable to use a synthetic resin which exhibits excellent stability in shape to keep the sheet-like configuration of the base layer 103, but it is more desirable to use a synthetic resin which is excellent both in shape stability and in flexibility. This allows the heat-insulating protection member 102 to deform in conformity with the surface shape of a member in abutment therewith. The heat insulating layer 104 is made of a material having, in addition to a heat insulation ability, elasticity, liquid repellency, and resistance to chemical attack. As an index of liquid repellency, an angle of contact between the material in use and the fixing fluid 9 should preferably stand at or above 60 degrees. The preferred examples of such a material include silicon rubber and fluorine resin such as PTFE and PFA. Even if part of the coating roller 99 juts out from the side surface 105*b* of the fixing fluid storage chamber 105, the heat insulating layer 104 becomes elastically deformed in conformity with the projection of the coating roller 99 so long as it is made of a material having the aforementioned characteristics. Therefore, the heat insulating layer 104 is brought into intimate contact with the surface of the coating roller 99 to block the opening 105*c* completely, thus making the inner space of the fixing fluid storage chamber 105 closed space. As a result, the volatilization of the fixing fluid 9 from the surface of the coating roller 99 can be avoided, which results in a reduction infixing fluid 9 consumption. Moreover, since the constitution is such that the heat insulating layer 104 undergoes deformation, the surface of the coating roller 99 is free from a trace of abutment and is thus free from lack of uniformity in the amount of the fixing fluid deposited thereon. Although the heat-insulating protection member 102 is moved while making contact with the coating roller 99, by virtue of the heat insulating layer 104 made of a material such as described hereinabove, the coating roller 99 is free from surface flaw.

Moreover, the heat insulating layer 104 exhibits liquid repellency and thus its surface is free of the adhesion of the fixing fluid 9. Therefore, it never occurs that the fixing fluid 9 travels along the heat-insulating protection member 102 to leak outside of the fixing fluid storage chamber 105 that will eventually cause contamination of the interior of the image forming apparatus 95. Also in the case where the heat-insulating protection member 102 is placed at the opening position, the surface of the heat insulating layer 104 is free of the adhesion of the fixing fluid 9. Therefore, it never occurs that the fixing fluid 9 drops down from the heat-insulating protection member 102 that will eventually cause contamination of the interior of the image forming apparatus 95. Moreover, the heat insulating layer 104 is free from fixing fluid 9-induced quality degradation. In this embodiment, the heat insulating layer 104 is made of a silicon rubber material having a hardness of 10 degrees according to JIS-A. As shown in FIGS. 13 to 15, when the heat-insulating protection member 102 is sitting at the closing position, contact is established between it and part of the coating roller 99 protruding upwardly from the side surface 105*b* of the fixing fluid storage chamber 105 through the opening 105*c* created thereon. Moreover, at both lengthwise ends of the fixing fluid applying section 96, because of the elastic deformation of the heat insulating layer 104 of the heat-insulating protection member 102, contact is established between the heat-insulating protection member 102 and the bearing portion 105*d* formed integrally with the fixing fluid storage chamber 105, with no gap existing therebetween. Accordingly, when the heat-insulating protection member 102 is sitting at the closing position, the opening 105*c* of the fixing fluid storage chamber 105 is blocked completely thereby, thus making the inner space of the fixing fluid storage chamber 105 closed space. This helps prevent the diffusion of air containing vapors from the fixing fluid 9 existing around the surface of the coating roller 99 in the atmosphere, and thereby prevent further volatilization of the fixing fluid 9 from the surface of the coating roller 99. Moreover, when the heat-insulating protection member 102 is sitting at the closing position, the arrangement is such that the heat-insulating protection member 102 is interposed between the transferring and fixing roller 112 and the coating roller 99. This helps protect the surface of the coating roller 99 against heat, and thereby avoid variation in the content of the fixing fluid 9 over the surface of the coating roller 99. As a protection member moving section for moving the heat-insulating protection member 102 between the opening position and the closing position, the one similar to the protection member moving section 80 of the image forming apparatus 1 may be used. Although, in this embodiment, the heat-insulating protection member 102 is constructed of a platy member comprising the base layer 103 and the heat insulating layer 104 stacked together in layers, the heat-insulating protection member 102 is not limited to such a configuration but may be of a platy member of a single element. In this case, for example, the platy member may be composed of a synthetic resin-made thin-walled sheet with a metal-made frame body disposed therearound. More specifically, the platy member is constituted by disposing a frame body made of a 1 mm-diameter wire around a 50 μm-thick urethane rubber sheet. The heat-insulating protection member 102 is, when constructed of such a platy member, brought into intimate contact with the coating roller 99 and the fixing fluid storage chamber 105 as the synthetic resin-made thin-walled sheet becomes deformed. With this constitution, even if the surface of the coating roller 99 makes contact with the synthetic resin-made thin-walled sheet in accompaniment with the opening and closing of the platy member, since the synthetic resin-made thin-walled sheet is deformable flexibly, the coating roller 99 is free from surface flaw. Moreover, when the heat-insulating protection member 102 is sitting at the closing position, the coating roller 99 does not undergo deformation and thus its surface is free from a trace of abutment. Further, the heat-insulating protection member 102 can be made lower in profile, wherefore the interval between the coating roller 99 and the transferring and fixing roller 112 can be reduced. Still further, the heat-insulating protection member 102 can be brought into intimate contact with the surface of the coating roller 99, wherefore the volatilization of the fixing fluid 9 from the surface of the coating roller 99 can be avoided, which results in a reduction in fixing fluid 9 consumption. Note that, as the synthetic resin-made thin-walled sheet, it is possible to use a sheet made of a synthetic resin material which is resistant to chemical attack and is deformable more readily than does the coating roller 99, for example, a urethane rubber sheet.

The fixing fluid storage chamber 105 is deigned as a vessel having an interior space, in which is accommodated, in addition to the coating roller 99, the supply roller 100, and the regulatory roller 101, the fixing fluid 9. Connected to the fixing fluid storage chamber 105 via piping 110 is a fixing fluid storage tank 109 which is a large-capacity tank for storing therein the fixing fluid 9. The piping 110 provides connection between the fixing fluid storage chamber 105 and the fixing fluid storage tank 109, so that the fixing fluid 9 stored in the fixing fluid storage tank 109 is supplied to the fixing fluid storage chamber 105. Depending on how the fixing fluid 9 stored in the fixing fluid storage chamber 105 is consumed, the replenishment of the fixing fluid 9 is carried out in a manner so as to insure that it is kept at a predetermined fluid level in the fixing fluid storage chamber 105. Moreover, the pivot 106 is disposed at each lengthwise end of the fixing fluid storage chamber 105 for supporting the fixing fluid storage chamber 105 universally pivotably in a direction indicated by arrow 106*a*. The fixing fluid storage chamber 105 also has, on its side surface opposite to the side surface 105*b*, the elastic member 107 having its one end fixed to the side surface, and the other end supported by a non-illustrated supporting member disposed inside the image forming apparatus 95. The elastic member 107 may be made of any given material so long as it is capable of pressing the fixing fluid storage chamber 105 upward. For example, a coil spring, a leaf spring, a torsion spring, or the like press spring can be used. Over the side surface 105*b* of the fixing fluid storage chamber 105 is disposed the eccentric cam 108 acting as a section for moving the coating roller 99 approachably and separably with respect to the transferring and fixing roller 112. The eccentric cam 108 is rotated by a non-illustrated driving section. The eccentric cam 108 abuts against the side surface 105*b* when its major axis portion is located in a vertically lower position, thereby pressing the fixing fluid storage chamber 105 downward. When its minor axis portion is located in a vertically lower position, the eccentric cam 108 is spaced a certain distance away from the side surface 105*b*. Although not shown in the figure, in the vicinity of the eccentric cam 108 is a disposed contact and release detecting section analogous to the contact and release detecting section 43 of the image forming apparatus 1 to detect whether the coating roller 99 is kept in contact with or kept away from the transferring and fixing roller 112. The cooperative actions of the pivot 106, the elastic member 107, and the eccentric cam 108 permits up-and-down movements of the fixing fluid applying section 96, in particular the fixing fluid storage chamber 105, in a direction indicated by arrow 105*a*. In this way, the coating roller 99 is moved approachably and separably with respect to the transferring and fixing roller 112. The control mechanism therefor is analogous to that which is employed in the image forming apparatus 1.

According to the fixing fluid applying section 96, during operating conditions for image formation, the heat-insulating protection member 102 is shifted to the opening position, so that the coating roller 99 can be brought into contact with the transferring and fixing roller 112 to apply the fixing fluid 9 to a toner image. On the other hand, during standby conditions where no image formation is carried out or power-off conditions, the coating roller 99 is moved away from the transferring and fixing roller 112 and the heat-insulating protection member 102 is shifted to the closing position, whereupon the inner space of the fixing fluid storage chamber 105 is turned into closed space. This helps prevent occurrence of problems such as the volatilization of the fixing fluid 9. In this embodiment, before the start of an image forming operation, it is possible to give the coating roller 99 at least one turn, and preferably continue the rotation for 0.5 to 10 seconds during the interval from when the heat-insulating protection member 102 is shifted to the opening position and the coating roller 99 is brought into contact with the transferring and fixing roller 112. While the distribution of the fixing fluid 9 on the surface of the coating roller 99 is originally uniform, by giving the coating roller 99 at least one turn, it is possible to impart further uniformity to the distribution of the fixing fluid 9, and thereby achieve further improvement in the quality of an image to be formed.

The transferring and fixing section 97 is composed of the transferring and fixing roller 112, a pressurizing roller 114, a roller cleaner 115, and a temperature detecting section 116. The transferring and fixing roller 112 is constructed of a roller-shaped member designed to be driven to rotate in a direction indicated by arrow 112*a* by a non-illustrated driving section, one side of which is brought into pressure-contact with a supporting roller 26*a*, with the intermediary transfer belt 21 lying therebetween, and the other side of which is brought into pressure-contact with the pressurizing roller 114. Moreover, the transferring and fixing roller 112 is separated by a certain gap from the transferring and fixing roller 112-facing surface of the heat-insulating protection member 102 of the fixing fluid applying section 96. In this embodiment, the transferring and fixing roller 112 is constructed of a 30 mm-outer-diameter roller-shaped member composed of a core metal made of a 1 mm-thick carbon steel, a 8 mm-thick silicon rubber layer formed on the surface of the core metal, the volumetric resistance of which falls in a range of from $10^8$ to $10^9 \Omega \cdot cm$, and a 20 μm-thick PFA layer formed on the surface of the silicon rubber layer. Moreover, in this embodiment, the transferring and fixing roller 112 receives application of a transfer voltage of +1 kV at a potential reverse to the potential of the charged toner 8 constituting a toner image. In this way, the toner 8 is electrostatically attracted thereto, whereupon toner transference from the intermediary transfer belt 21 to the transferring and fixing roller 112 can be accomplished. The transferring and fixing roller 112 is rotated in the direction of arrow 112*a* while holding on its surface the toner image transferred from the intermediary transfer belt 21. Inside the transferring and fixing roller 112 is a disposed heating section 113 for applying heat to the transferring and fixing roller 112. By the interiorly-disposed heating section 113, the transferring and fixing roller 112 can be heated at a uniform temperature throughout its circumferential surface. For example, a halogen lamp is used for the heating section 113. In this embodiment, since the toner 8 for use contains such a binder resin as has a glass transition temperature of 90° C., it follows that the surface temperature of the transferring and fixing roller 112 is maintained at a temperature of 100° C. Upon the toner image being heated to a temperature equal to or higher than the glass transition temperature of the binder resin contained in the toner 8, then the binder resin is softened and thus the adherability between the toner 8 and the transferring and fixing roller 112 can be increased. This makes it possible to avoid that the toner 8 is offset with respect to the coating roller 99 and that the toner image suffers from irregularity during the application of the fixing fluid 9, and thereby apply the fixing fluid 9 to the toner image, from its surface, by the coating roller 99 properly in a contact manner. Note that, when the fixing fluid 9 is applied, in a contact manner, from the coating roller 99 to the toner image transferred to the surface of the transferring and fixing roller 112, the toner image and the transferring and fixing roller 112 undergo a drop in temperature due to the application. At this time, since the surface of the transferring and fixing roller 112 is maintained at a temperature which is higher by 10° C. than the glass transition temperature of the binder resin contained in the toner 8, it is possible to make up for the decrease of temperature immediately, and thereby bring the toner 8 constituting the toner image into a swollen/softened state without a hitch. From the energy saving standpoint, it will be sufficient if the surface of the transferring and fixing roller 112 is heated to a temperature which is higher by approximately 10° C. than the glass transition temperature of the binder resin contained in the toner 8. By keeping the heating temperature at such a level, it is possible to keep the loss of thermal energy resulting from heat dissipation low. As another advantage, upon setting the apparatus in motion, a temperature rise can be achieved at a lower energy expenditure and the temperature reaches a predetermined level in a short time, which permits a reduction in warm-up time. In the end, no heat-retaining operation is necessary during standby, wherefore the apparatus as a whole serves the purpose of realizing energy saving. The mechanism for controlling the surface temperature of the transferring and fixing roller 112 will be explained later on.

The pressurizing roller 114 is constructed of a roller-shaped member which makes pressure-contact with the transferring and fixing roller 112 and is driven to rotate in a direction indicated by arrow 114*a* by a non-illustrated driving section. This embodiment employs, as the pressurizing roller 114, a roller having an outer diameter of 40 mm composed of a core metal, a 2 mm-thick elastic layer made of silicon rubber having a hardness of 50 degrees (according to JIS-A) formed on the surface of the core metal, and a 20 μm-thick PFA-made outer layer formed on the surface of the elastic layer. In this embodiment, the pressurizing roller 114 is brought into contact with the transferring and fixing roller 112 under a linear pressure of 10 N/cm (press force). The roller cleaner 115, which includes a cleaning blade 115*a* and a reservoir 115*b*, serves to remove the residual toner 8 and/or fixing fluid 9 remaining on the transferring and fixing roller 112 following the completion of the transference of the toner image borne on the transferring and fixing roller 112 onto the recording medium P. The cleaning blade 115*a* is brought into pressure-contact with the transferring and fixing roller 112 by a non-illustrated pressurizing section to scrape off the residual toner 8 and so forth remaining on the transferring and fixing roller 112. The reservoir 115*b* stores therein the toner 8, the fixing fluid 9, and so forth that have been scraped off by the cleaning blade 115*a*. In order to detect the surface temperature of the transferring and fixing roller 112, the temperature detecting section 116 is arranged upstream from the nip portion between the transferring and fixing roller 112 and the supporting roller 26*a* in the direction in which the transferring and fixing roller 112 is driven to rotate, namely in the direction of arrow 112*a*. The temperature detecting section 116 is arranged in contact with or in the proximity of the transferring and fixing roller 112. For example, a temperature sensor is used for the temperature detecting section 116. The result of detection produced by the temperature detecting section 116 is inputted to a control unit 140 for controlling all of the workings of the image forming apparatus 95. In response to the input about the detection result, the control unit 140 issues a control signal to the heating section 113 to control application of heat to the transferring and fixing roller 112 properly. In this way, the transferring and fixing roller 112 can be heated at a uniform temperature throughout its circumferential surface. In this embodiment, as has already been described, the surface temperature of the transferring and fixing roller 112 is maintained at 100° C. According to the transferring and fixing section 97, the toner image borne on the intermediary transfer belt 21 is electrostatically transferred to the surface of the transferring and fixing roller 112 maintained at a predetermined temperature, and then the fixing fluid 9 is applied to the toner image in a contact manner by the fixing fluid applying section 96. After that, the toner image, now kept in a swollen/softened state, is fixed onto the recording medium P at the location where the transferring and fixing roller 112 and the pressurizing roller 114 make contact with each other under pressure (a transfer-fixation nip portion) Following the completion of the transference of the toner image onto the recording medium P, the residual toner 8, paper powder, and so forth remaining on the surface of the transferring and fixing roller 112 are removed by the roller cleaner 115, so that another toner image can be transferred from the intermediary transfer belt 21 onto the transferring and fixing roller 112.

The recording medium supply section 6*a* is composed of a recording medium cassette 56 for stocking the recording media P and a pick-up roller 57 for directing the recording media P to a conveyance path one by one. According to the recording medium supply section 6*a*, the recording media P placed within the recording medium cassette 56 are directed one by one to the transfer-fixation nip portion by the pick-up roller 57. The ejection section 98 is composed of a conveyance roller 117 and a paper ejecting roller 118. According to the ejection section 98, the recording medium P bearing the toner image transferred and fixed thereon is conveyed toward the paper ejecting roller 118 by the conveyance roller 117, and is then ejected out of the image forming apparatus 95 by the paper ejecting roller 118 to be placed onto a paper output tray 119 disposed on the top surface of the image forming apparatus 95. According to the image forming apparatus 95, a toner image is formed on the intermediary transfer belt 21 by the toner image forming section 2. The toner image is transferred onto the transferring and fixing roller 112, and the fixing fluid 9 is applied thereto in a contact manner by the fixing fluid applying section 96, whereupon the toner image is swollen and softened. The toner image is then transferred onto the recording medium P at the fixation nip portion. Lastly, the recording medium P bearing the image transferred thereon is ejected onto the paper output tray 119 by the ejection section 98. In this embodiment, since the fixing fluid 9 is applied to the toner image on the transferring and fixing roller 112, which is a toner image carrier other than the intermediary transfer belt 21, it follows that the intermediary transfer belt 21 is free of the adhesion of the fixing fluid 9. Moreover, aside from the intermediary transfer belt 21, the transferring and fixing roller 112 is subjected to heating. Therefore, the intermediary transfer belt 21 does not undergo a rise in temperature. This constitution makes it possible to prevent the toner 8 from undergoing quality degradation in the course of toner image formation due to the rise in temperature of the components constituting the toner image forming section 2, the adhesion of the fixing fluid 9, or other factors, and thereby produce high-quality images with stability for a longer period of time. Note that, in a case where a toner image is held on the toner image bearing section in a heated state so that the toner image is softened and molten only by the heating effect, although that surface of the toner image which makes contact with the toner image bearing section can be softened and molten smoothly, the other surface, namely the outer surface of the toner image cannot be softened and molten sufficiently. This leads to the drawback of lowering the adherability of the toner image with respect to the recording medium P. On the other hand, in this embodiment, the fixing fluid 9 is applied, in a contact manner, to the surface of the toner image held on the toner image bearing section in a heated state. This constitution allows the toner image as a whole to be swollen and softened satisfactorily, wherefore the adherability of the toner image with respect to the recording medium P can be enhanced.

Figure 18A:
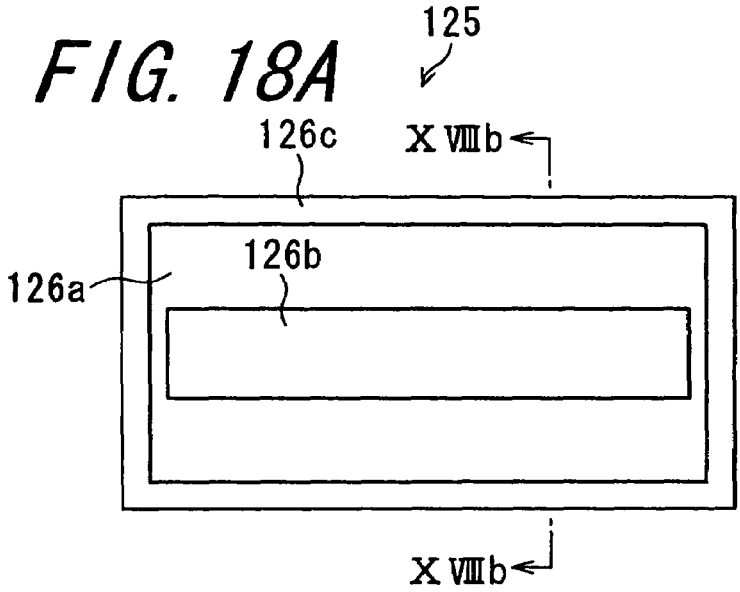
FIG. 18A is a plan view schematically showing the constitution of the heat-insulating protection member.
Figure 18B:
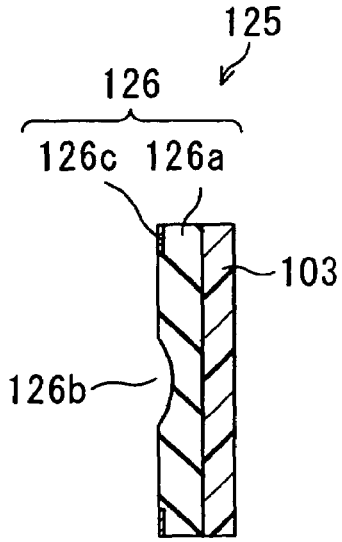
FIG. 18B is a sectional view of the heat-insulating protection member taken along the line XVIIIb-XVIIIb of FIG. 18A.

While this embodiment employs the heat-insulating protection member 102, the invention is not limited thereto. A heat-insulating protection member 125 as shown in FIGS. 18A and 18B may be employed instead. FIG. 18A is a plan view schematically showing the constitution of the heat-insulating protection member 125. FIG. 18B is a sectional view of the heat-insulating protection member 125 taken along the line XVIIb-XVIIb of FIG. 18A. The heat-insulating protection member 125 is analogous to the heat-insulating protection member 102, and therefore the constituent components that play the same or corresponding roles as in the heat-insulating protection member 102 will be identified with the same reference symbols, and overlapping descriptions will be omitted. The heat-insulating protection member 125 is characterized in that most part of a heat insulating layer 126 is made of a material having low liquid repellency, and that a fixing fluid retaining portion 126*c* is formed along the outer periphery of the heat insulating layer 126. The heat insulating layer 126 is composed of a heat insulating layer main body 126*a* and the fixing fluid retaining portion 126*c*. The heat insulating layer main body 126*a* is laminated on the base layer 103. On a surface of the heat insulating layer main body 126*a* opposite to the surface in contact with the base layer 103 is created a concavity 126*b* with which part of the coating roller 99 is brought into contact. Thus, the heat insulating layer main body 126*a* makes contact with the side surface 105*b* of the fixing fluid storage chamber 105 and the coating roller 99. The heat insulating layer main body 126*a* is made of a material which is lower in liquid repellency than the material used to form the heat insulating layer 104 of the heat-insulating protection member 102, but is substantially equal in surface hardness thereto. As such a material, for example, rubber materials such as butyl rubber and EPDM may be used. The fixing fluid retaining portion 126*c* is formed along the outer periphery of the surface of the heat insulating layer main body 126*a* that makes contact with the side surface 105*b* of the fixing fluid storage chamber 105 and the coating roller 99. In this embodiment, the fixing fluid retaining portion 126*c* is composed of a plurality of holes arranged at a pitch of 1.5 mm. The hole is 1 mm in diameter and 1 mm in depth in the direction of thickness of the heat-insulating protection member 125, and is brought into contact with the side surface 105*b*. The fixing fluid retaining portion 126*c* extends 3 mm-width from the end of the heat insulating layer 126. By creating small-diameter holes along the outer periphery of the heat insulating layer 126 as asperities, it is possible to increase the surface area of the outer periphery of the heat insulating layer 126, and thereby improve the liquid retention ability at the outer periphery. Therefore, it never occurs that the fixing fluid 9 flowing along the surface of the heat insulating layer 126 travels along the heat-insulating protection member 125 that will eventually develop a leak inside the image forming apparatus 95. Note that the method for increasing the surface area of the outer periphery of the heat insulating layer 126 is not limited to creating holes as suggested herein. For example, an increase in surface area can also be achieved by creating grooves, ribs, or the like on the surface by section of cutting, molding, or otherwise, or by subjecting the surface to a polishing treatment, a blasting treatment, a chemical treatment, or the like. In the case of employing such a heat-insulating protection member as has a heat insulating layer made of a material having low liquid repellency, the fixing fluid 9 is easily adhered to and spread over the surface of the heat insulating layer. Therefore, even if the heat-insulating protection member is sitting at the closing position to make the inner space of the fixing fluid storage chamber closed space, there is a possibility that the fixing fluid 9 is adhered to and flows through the surface of the heat insulating layer. Furthermore, when the heat-insulating protection member with the fixing fluid 9 adhered thereto is moved from the closing position to the opening position, there is a possibility that the fixing fluid 9 drops down from the heat-insulating protection member that will eventually cause contamination of the interior of the image forming apparatus 95. This can have a detrimental effect on electrical circuitry. However, in the constitution described above, even if the fixing fluid 9 travels along the surface of the heat insulating layer 126 and reaches its outer periphery, the fixing fluid 9 can be retained at the outer periphery. This helps protect the interior of the image forming apparatus 95 against contamination caused by the leakage or drop of the fixing fluid 9. Note that, since the fixing fluid 9 for use exhibits high volatility, there is no need to store a large quantity of the fixing fluid 9 for a longer period of time. It is thus unnecessary to design the fixing fluid retaining portion 126*c* to retain a large quantity of fluid. By providing the fixing fluid retaining portion 126*c*, it is possible to form the heat insulating layer main body 126*a* of an inexpensive material instead of an expensive material which is excellent in liquid repellency, and thereby enhance the versatility of the heat-insulating protection member 125.

Figure 19A:
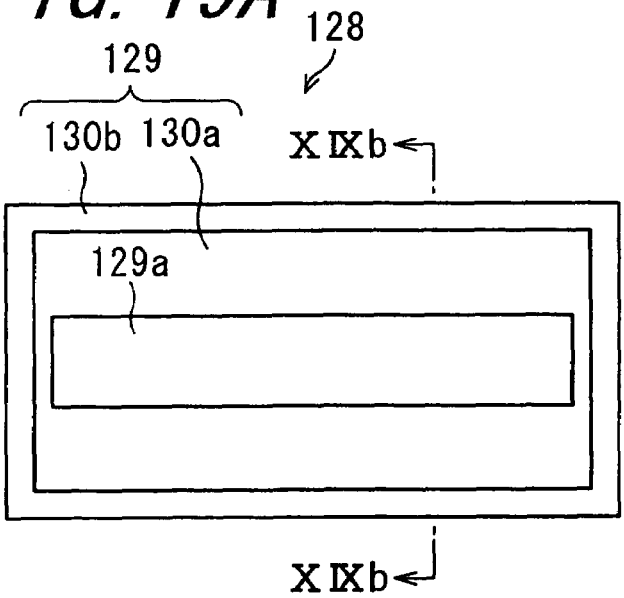
FIG. 19A is a plan view schematically showing the constitution of the heat-insulating protection member.
Figure 19B:
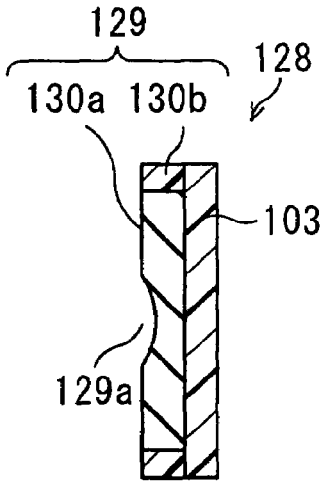
FIG. 19B is a sectional view of the heat-insulating protection member taken along the line XIX-XIX b of FIG. 19A.

FIGS. 19A and 19B are views showing a heat-insulating protection member of another configuration. FIG. 19A is a plan view schematically showing the constitution of the heat-insulating protection member 128. FIG. 19B is a sectional view of the heat-insulating protection member 128 taken along the line XIXb-XIXb of FIG. 19A. The heat-insulating protection member 128 is analogous to the heat-insulating protection member 102, and therefore the constituent components that play the same or corresponding roles as in the heat-insulating protection member 102 will be identified with the same reference symbols, and overlapping descriptions will be omitted. The heat-insulating protection member 128 is characterized in that a heat insulating layer 129 includes a heat insulating layer main body 130*a* and a fixing fluid retaining portion 130*b*. The heat insulating layer main body 130*a* has, on its surface which makes contact with the side surface 105*b* of the fixing fluid storage chamber 105 and the coating roller 99, a concavity 129*a* with which the coating roller 99 is brought into contact. The heat insulating layer main body 130*a* may be made either of a material having high liquid repellency or of a rubber material having relatively low liquid repellency. In this embodiment, it is preferable that the heat insulating layer main body 130*a* is made of the rubber material used to form the heat insulating layer main body 126*a* of the heat-insulating protection member 125. The fixing fluid retaining portion 130*b*, which is made of a porous material, is formed along the outer periphery of the heat insulating layer main body 130*a*. It is desirable to use a porous material which exhibits high wettability with respect to the fixing fluid 9 and is large in area contacted by the fixing fluid 9 (surface area), in particular a porous material which is excellent in liquid retention ability, elasticity, geometrical accuracy, workability, and so forth. Specific examples of such a porous material include a felt and an open-celled foam such as a sponge. In the case of using a felt, fibers constituting the felt never come off, and thus it never occurs that fallen fibers are attached to the surface of the coating roller 99 that will eventually cause lack of uniformity in the amount of the fixing fluid deposited thereon. In this embodiment, the fixing fluid retaining portion 130*b* is made of a felt. In this constitution, even if the fixing fluid 9 flows through the surface of the heat insulating layer main body 130*a* and reaches the outer periphery of the heat-insulating protection member 128, since the fixing fluid retaining portion 130*b* is capable of retaining the fixing fluid 9, it is possible to prevent the fixing fluid 9 from running from the heat-insulating protection member 128, and thereby prevent the leakage of the fixing fluid 9 inside the image forming apparatus 95.

While the image forming apparatus embodying the invention employs an admixture of water and one kind or two kinds or more of organic solvent as the fixing fluid 9 for swelling and softening toner, the fixing fluid 9 is not limited thereto. It is possible to use instead any conventionally-known fixing fluid for toner, or a fixing fluid containing a publicly-known bonding or adhesive ingredient. Specific examples of the bonding ingredient include: a rubber-base adhesive predominantly composed of polymeric elastomer such as chloroprene rubber, nitrile rubber, and SBR rubber; and an emulsion adhesive prepared by dispersing, in water, hydrophilic synthetic resin such as vinyl acetate, ethylene-vinyl acetate copolymer (EVA), and acrylic resin. In this case, not only a toner-swelling/softening effect, but also an adhesive power exerted by the bonding or adhesive ingredient contributes to the adherability between the toner and the recording medium P. This makes it possible to attain enhanced adherability and thereby fix a toner image onto the recording medium P with higher fixation strength. Moreover, as the fixing fluid, any of those used and known customarily in this field can be used. In the image forming apparatus of the invention, the conditions, such as materials for use, layer structures, and dimensions, to be fulfilled by the constituent components including the intermediary transfer belt, the conveyance belt, and the individual rollers are not limited to those as suggested hereinabove. Those customarily adopted in the field of electrophotographic image forming technology may be used in their as-is state or with alterations. Moreover, instead of a roller element, an endless member such as a belt may be used. Further, the belt components such as the intermediary transfer belt and the conveyance belt may be constructed in the form of a roller instead of the form of an endless belt. Besides, although the image forming apparatus according to each of the embodiments of the invention is exemplified as a tandem-system color image forming apparatus, the technique of the invention is not limited thereto, but may be applied also to, for example, a so-called 4-rotation system color image forming apparatus in which an image of one given color is superimposedly produced each time an intermediary transfer belt makes one turn. Moreover, the invention is not limited to a color image forming apparatus, and it may find application in a monochromatic image forming apparatus. For example, the image forming apparatus of the invention may be built as a copier, a printer, a facsimile, or a multi-function machine that combines two or more kinds of functions mentioned just above.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a toner image forming section for forming a toner image;

a toner image bearing section which is rotated while bearing an unfixed toner image thereon;

a fixing fluid applying section for applying a volatile fixing fluid, which provides an effect of fixing toner onto a recording medium, to the unfixed toner image formed on the toner image bearing section; and a transferring and fixing section for transferring and fixing the unfixed toner image formed on the toner image bearing section onto the recording medium, wherein the fixing fluid applying section comprises:

an applying section including an applying member which is rotated to apply the volatile fixing fluid to the unfixed toner image formed on the toner image bearing section;

a contact and release operation section for supporting the applying section in a manner such that the applying member is moved approachably and separably with respect to the toner image bearing section;

a contact and release detecting section for detecting whether the applying member is kept in contact with or kept away from the toner image bearing section;

a rotational driving section for driving the applying member to rotate about its axis; and a control unit for controlling of the contact and release operation section in a manner so as to assure contact or separation between the applying member and the toner image bearing section, and controlling of the rotational driving section according to the detection result of the contact and release detecting section in a manner so as to assure the rotation of the applying member.

2. The image forming apparatus of claim 1, wherein the applying section is disposed vertically below the toner image bearing section so as for the applying member to face a toner image bearing surface of the toner image bearing section.

3. The image forming apparatus of claim 1, wherein the control unit controls the rotational driving section in a manner so as to give the applying member at least one rotating before bringing the applying member into contact with the toner image bearing section.

4. The image forming apparatus of claim 1, wherein the control unit effects controlling of the rotational driving section in a manner so as to assure the rotation of the applying member for 0.5 to 10 seconds before bringing the applying member into contact with the toner image bearing section.

5. The image forming apparatus of claim 1, further comprising a heating section for heating the toner image bearing section that is arranged upstream from a location where the volatile fixing fluid is applied to the toner image bearing section by the applying member in a direction in which the toner image bearing section is driven to rotate, wherein, under the control of the control unit, heating of the toner image bearing section by the heating section is carried out, and the applying member kept away from the toner image bearing section is rotated by the rotational driving section during an interval when the toner image bearing section is being heated by the heating section.

6. The image forming apparatus of claim 1, further comprising:

a heating section for heating the toner image bearing section that is arranged upstream from a location where the volatile fixing fluid is applied to the toner image bearing section by the applying member in a direction in which the toner image bearing section is driven to rotate; and a temperature detecting section for detecting the temperature of the toner image bearing section, wherein the volatile fixing fluid which is applied to the toner image bearing section by the applying member contains at least two kinds of organic solvents and water, and wherein, under the control of the control unit, heating of the toner image bearing section by the heating section is carried out, and the applying member kept away from the toner image bearing section is rotated by the rotational driving section on the basis of the result of the temperature detecting section.

7. The image forming apparatus of claim 6, wherein, when it is detected by the temperature detecting section that the temperature of the toner image bearing section is higher than, of the boiling points of at least two kinds of organic solvents contained in the volatile fixing fluid, the lowest boiling point, then the applying member kept away from the toner image bearing section is rotated by the rotational driving section under the control of the control unit.

8. The image forming apparatus of claim 1, further comprising:

a heat-insulating protection member interposed between the toner image bearing section and the applying member in contact with or away from the applying member, the heat-insulating protection member being so supported as to be movable between a closing position for closing between the toner image bearing section and the applying member and an opening position for allowing the toner image bearing section and the applying member to face each other in a space between the toner image bearing section and the applying member; and a protection member moving section for moving the heat-insulating protection member between the closing and opening positions.

9. The image forming apparatus of claim 8, wherein the heat-insulating protection member is disposed in contact with the applying member, and that at least a surface thereof contacted by the applying member is made of a material whose hardness is lower than the surface hardness of the applying member.

10. The image forming apparatus of claim 9, wherein, in the heat-insulating protection member, at least the surface thereof contacted by the applying member is made of a material which exhibits a contact angle of 60 degrees or above with respect to the volatile fixing fluid.

11. The image forming apparatus of claim 9, wherein the heat-insulating protection member is constructed of a flexible film.

12. The image forming apparatus of claim 9, wherein the heat-insulating protection member has, at least along its outer periphery, a fixing fluid retaining portion for retaining the fixing fluid.

13. The image forming apparatus of claim 12, wherein the fixing fluid retaining portion is composed of a porous material capable of adsorbing and retaining the volatile fixing fluid.

14. The image forming apparatus of claim 13, wherein the porous material is a sponge having an open-cell structure inside.

15. The image forming apparatus of claim 1, wherein the applying section comprises:

a fixing fluid storage chamber for storing the fixing fluid in its interior space, which has an opening formed so as to face the toner image bearing section;

an applying member which is supported within the fixing fluid storage chamber so as to be rotated, at least part of which confronts the toner image bearing section through the opening;

a heat-insulating protection member interposed between the toner image bearing section and the fixing fluid storage chamber, which is so supported as to be movable between a closing position for blocking the opening of the fixing fluid storage chamber to make the interior space of the fixing fluid storage chamber closed space and an opening position for bringing the toner image bearing section and the applying member faced with each other through the opening of the fixing fluid storage chamber; and a protection member moving section for moving the heat-insulating protection member between the closing and opening positions.

16. The image forming apparatus of claim 8, wherein the control unit effects controlling of the rotational driving section in a manner so as to assure the rotation of the applying member that has been separated from the toner image bearing section by the heat-insulating protection member.

* * * * *